US007556160B2

(12) United States Patent
Porebski et al.

(10) Patent No.: US 7,556,160 B2
(45) **Date of Patent: *Jul. 7, 2009**

(54) PORTABLE LIFT, SUPPORT, REMOVAL AND/OR INSTALLATION SYSTEM AND METHOD

(75) Inventors: James J. Porebski, North Tonawanda, NY (US); Edward A. DePietro, Manchester, NH (US)

(73) Assignee: Universal Hinge Corporation, Ashburnham, MA (US)

( * ) Notice: Subject to any disclaimer, the term of this patent is extended or adjusted under 35 U.S.C. 154(b) by 361 days.

This patent is subject to a terminal disclaimer.

(21) Appl. No.: 11/178,787

(22) Filed: Jul. 11, 2005

(65) Prior Publication Data

US 2005/0242051 A1 Nov. 3, 2005

Related U.S. Application Data

(60) Continuation-in-part of application No. 10/662,571, filed on Sep. 15, 2003, now abandoned, which is a division of application No. 09/481,599, filed on Jan. 12, 2000, now Pat. No. 6,786,343.

(60) Provisional application No. 60/115,657, filed on Jan. 13, 1999.

(51) Int. Cl.
*B66C 23/18* (2006.01)

(52) U.S. Cl. ..... 212/179; 414/684.3

(58) Field of Classification Search ..... 212/166, 212/169, 179; 414/684.3; 29/426.1; 294/27.1, 294/6

See application file for complete search history.

(56) References Cited

U.S. PATENT DOCUMENTS

| | | | | | |
|---|---|---|---|---|---|
| 510,300 | A * | 12/1893 | Stilwell | 312/330.1 |
| 4,398,649 | A * | 8/1983 | Labbe | 220/327 |
| 4,519,519 | A * | 5/1985 | Meuschke et al. | 220/211 |
| 4,664,586 | A * | 5/1987 | Vassalotti | 414/590 |
| 4,865,513 | A * | 9/1989 | Norris | 414/684.3 |
| 5,228,825 | A * | 7/1993 | Fruchtbaum et al. | 414/684.3 |
| 6,786,343 | B1 * | 9/2004 | Porebski et al. | 212/179 |
| 2006/0219649 | A1 * | 10/2006 | Wolfford | 212/166 |

* cited by examiner

*Primary Examiner*—Charles A Fox
(74) *Attorney, Agent, or Firm*—Robert R Deleault, Esq.; Mesmer & Deleault, PLLC

(57) ABSTRACT

A removable cover support system and method for supporting a cover of a cover assembly having a cover support extension and a cover flange having cover flange holes has a cover flange securing base assembly having a base member and a securing mechanism slidably insertable through at least one of a cover flange hole of a cover assembly having a cover support extension and a cover flange, a retaining sleeve connected to the securing base assembly, a swingarm assembly rotatably supported by the retaining sleeve, and a lifting mechanism connected to the swingarm assembly. The securing mechanism is operably connected to the base member and the lifting mechanism is operably connected to the cover.

9 Claims, 38 Drawing Sheets

*PRIOR ART*

PORTABLE LIFT, SUPPORT, REMOVAL AND/OR INSTALLATION SYSTEM AND METHOD

This application is a Continuation-in-Part application of Ser. No. 10/662,571, filed on Sep. 15, 2003 now abandoned, which is a divisional application of Ser. No. 09/481,599, filed on Jan. 12, 2000, now U.S. Pat. No. 6,786,343, issued on Sep. 7, 2004, which claims the benefit of U.S. Provisional Application No. 60/115,657, filed on Jan. 13, 1999.

FIELD OF THE INVENTION

The present invention relates to field installation and removal of movement objects/components from equipment fixtures and the like. These applications are typically within industrial environments where the movement objects are large, heavy, and difficult to manipulate.

BACKGROUND OF THE INVENTION

This invention relates generally to the removal and/or installation of equipment from a wide variety of locations. It provides the necessary support mechanism, lifting mechanism and temporary storage of the equipment to be removed and/or installed. In addition, the invention is portable in nature and can be moved from location to location as needed.

DESCRIPTION OF THE PRIOR ART

Overview

Generally, power plants, co-generation power plants, chemical plants, petrochemical plants, refineries, dairies, tank farms, gas storage facilities, liquid natural gas storage facilities, manufacturing facilities and/or any facility that has tanks, vessels, piping, heat exchangers and/or equipment of any kind have had the need to install and/or remove (temporally or permanently) various components from the site or from the location that the component is installed, for a wide variety of reasons. Some of these reasons include but are not limited to:

1. maintenance of equipment and/or components,
2. replacement of equipment and/or components,
3. inspection of equipment or components, and/or
4. installation of equipment or components.

Current methods for temporary and/or permanent removal and/or installation of equipment and/or components rely on a number of options including:

1. Utilizing forklift trucks to lift the item to be removed and/or installed (movement object).
2. Utilizing lifting tables to lift the movement object.
3. Utilizing a crane to lift the movement object.
4. Locating a structural member of the facility, near the movement object, securing some kind of a fixture to the structure and attaching a "chain pull" or other device to the fixture to support and remove and/or install the item.

Each of these methods has limitations and deficiencies. Forklifts and lifting tables are suitable for use only from the floor. Items to be removed and/or installed, that are located beyond the reach of the forklift and/or lifting table or that are located in an area that is congested with other equipment such that the forklift or lifting table cannot be brought into reasonable proximity to the equipment to be removed and/or installed cannot reasonably be handled with these devices. In addition, not all facilities have forklift trucks and/or lifting tables.

Cranes have the ability to support, remove and/or install items from overhead. Items that are not within the range of the crane cannot be handled by the crane. Items that are in a congested and/or confined area may not be accessible to a crane. Not all facilities have a crane.

Suitable structural members may not be in reasonable proximity of the movement object thereby negating the possibility of installing a fixture on which to attach a "chain pull" or other device.

Finally, it should be mentioned that the size and weight of many of the components (such as manway covers and the like) make these normal operational and maintenance functions quite hazardous. Typical manway covers may weigh on the order of 50-2000 pounds or more and may be as much as 6-inches thick. As such, the potential that this equipment could fall and injure a worker is significant, and thus manipulating these objects should be considered a hazardous activity.

Permanent Installation/Removal Equipment (Davits)

During the manufacture and/or fabrication of equipment, permanent devices have been used to provide a method of removal of components. These devices are permanent in nature in that they are affixed to the specific equipment and are used to facilitate removal of a specific item on the equipment only. These devices are uniformly not portable and cannot be moved from location to location as needed. The actual design of these devices differs from the invention described herein. An example of one of these permanent structures (termed a "davit") is illustrated in FIG. 1. This exemplary structure will now be described in detail.

Referencing FIG. 1, the prior art davit (100) is illustrated from a top view (110) and an end-view (120). The davit (100) is attached to the outer ring of a manway flange (111) on which a manway cover (122) is fastened with bolts or other fastening means. The manway cover (122) is supported by a support rod (123) that is typically a threaded member approximately 0.75-inch in diameter. This support rod (123) is retained by one or more hexagonal nuts (124) or other fastening means that fix the support rod to a swingarm (125) that rotates within a pipe sleeve (127) that is permanently fixed to the manway flange (111) or some other support via a support plate (128).

To give some perspective on the unwieldiness of a conventional permanently attached davit system, the support rod (123) is typically 0.75-inch in diameter and is fixed by two 0.75-inch nuts (124) to a 2-inch diameter swingarm (125) that fits into a large pipe sleeve (127).

While the davit system is effective in removing a given manway cover, it suffers from the following disadvantages:

1. To be of use, the davit must be permanently installed on the manway flange. This is often not practical, as many times access to a manway cover occurs as an afterthought in plant maintenance.

2. There is added cost for fabrication/installation of the davit on each manway cover, regardless of whether the manway cover is accessed on a regular basis. This may be cost prohibitive in a large industrial plant.

3. There are safety concerns regarding the threaded member (123) and/or the fastening means (124) that may fail during installation/removal of the manway cover (122). The davit currently supports no failsafe mechanisms to prevent injury to maintenance personnel. Current equipment movement techniques that utilize lifting lugs/devices typically provide no failsafe method to prevent injury should the lifting lug/device fail or become compromised.

While one skilled in the art may find other deficiencies in the conventional davit construction and use, the above mentioned items are sufficient to indicate that any system and/or method that has the potential of eliminating any of these deficiencies would be welcome in the marketplace.

Prior Art Patents

With respect to the present invention, the following non-exhaustive list of patents is relevant:

1. U.S. Pat. No. 3,665,958 issued to Evald Dunkelis on May 30, 1972 for VENT CLOSURE DEVICE.

2. U.S. Pat. No. 4,297,072 issued to Siddharth A. Shah, Sidney J. Woodcock, and Robert D. Fagan on Oct. 27, 1981 for MANWAY HANDLING APPARATUS.

3. U.S. Pat. No. 4,398,649 issued to Thomas Labbe on Aug. 16, 1983 for PRIMARY MANWAY COVER REMOVAL.

4. U.S. Pat. No. 4,519,519 issued to Robert E. Meuschke, Donald G. Sherwood, and Bernard L. Silverblatt on May 28, 1985 for FUEL TRANSFER TUBE QUICK OPENING HATCH.

5. U.S. Pat. No. 4,669,628 issued to Keizo Hatta on Jun. 2, 1987 for SAFETY DEVICE FOR AUTOMATICALLY OPENABLE AND CLOSABLE LID.

6. U.S. Pat. No. 4,865,513 issued to John J. Norris on Sep. 12, 1989 for PORTABLE MANWAY OVER HANDLING APPARATUS.

7. U.S. Pat. No. 5,038,520 issued to Franklyn J. Amorese, Robert R. Loomis, and Douglas H. Rigerman on Aug. 13, 1991 for MANWAY LIFT ASSIST.

8. U.S. Pat. No. 5,050,628 issued to Ian Ripley and Anthony H. Needham on Sep. 24, 1991 for TANK ENTRY PROCEDURE AND APPARATUS.

9. U.S. Pat. No. 5,092,963 issued to Richard J. Barker, Frank A. DiGiacomo, James M. Hardy, Robert F. Lamm, and Allen S. Malsbury on Mar. 3, 1992 for AUTOMATED TOP HEAD AND STEM GUIDE ASSEMBLY FOR COKING DRUMS.

10. U.S. Pat. No. 5,184,422 issued to William W. Wade and Vincent W. Eshnaur on Feb. 9, 1993 for SWING AWAY MANWAY ASSEMBLY.

11. U.S. Pat. No. 5,394,650 issued to Robert H. Dean on Mar. 7, 1995 for MANWAY COVER BALANCING MECHANISM.

12. U.S. Pat. No. 5,431,248 issued to Donald Willaughby on Jul. 11, 1995 for CONFINED SPACE LOWERING AND RETRIEVING APPARATUS.

None of these prior art citations discloses the teachings, features, and advantages of the present invention as described herein.

OBJECTS OF THE INVENTION

Accordingly, the objects of the present invention are (among others) to circumvent the deficiencies in the prior art and affect one or more of the following objectives:

1. Provide a device that can be quickly and easily installed to remove and/or install, support, and/or store an item or component.

2. Provide a device that can be used in confined or congested areas to remove and/or install, support, and/or store an item or component.

3. Provide a device that does not require its use from the floor to remove and/or install, support, and/or store an item or component.

4. Provide a device that is portable and that can be used as required in different locations to remove and/or install, support, and/or store an item or component.

5. Provide a device that one man can handle and install to remove and/or install, support, and/or store an item or component.

6. Provide a device that does not require welding for installation. Given that welding to some equipment structures (pressure vessels and the like) may adversely affect the integrity/reliability of the equipment structure, welding in many circumstances is not tolerable/permitted. An alternative to this procedure is required for these applications and applications in which the equipment structure is non metallic.

7. Provide a device that may be used on non-ferrous and/or non-metallic equipment components. Since many equipment structures are constructed of non-metallic materials such as Fiberglas™, a method of manipulating movement objects in this environment is highly desirable.

While these objectives should not be understood to limit the teachings of the present invention, in general these objectives are achieved by the disclosed invention that is discussed in the following sections.

BRIEF SUMMARY OF THE INVENTION

One embodiment of the present invention includes a fixture, a removable cover support system, fabricated from structural members, rods (threaded or otherwise) pipe, pipe fittings and/or fasteners. A number of models and sizes are provided for various different sizes of equipment. U.S. Pat. No. 6,786,343, issued on Sep. 7, 2004, describes some of the models and sizes and is hereby incorporated by reference. The securing base assembly of the fixture is attached to a portion of the equipment or piping that is not to be removed—generally the cover support extension near the cover flange. The fixture is secured in place by a securing mechanism, such as a u-shaped retaining member, one or more channel members, or directly to the base member by bolts or pins. Once the fixture is in place, the swingarm assembly section is installed by inserting it into the retaining sleeve section of the fixture.

The swingarm assembly is free to rotate within the retaining sleeve. The swingarm assembly section contains a swingarm on which a threaded rod or other lifting mechanism is attached. This threaded rod or other lifting mechanism is used to lift the movement object to be removed and/or installed. Once the item to be removed and/or installed is attached to the threaded rod or lifting mechanism and is supported by the swingarm assembly, the swingarm assembly may be rotated within the sleeve thereby removing the movement object from its position and locating or installing the item to its desired position. The movement object can remain on the swingarm assembly for storage or temporarily for inspection.

In another embodiment of the present invention, the securing mechanism uses a bolt/pin-type system that includes the use of a bolt from the cover or a pin/rod of similar diameter to that of the cover bolt to slide into a cover flange hole through an opening in the channel member or support plate instead of creating a 'capture plane' or 'capture opening' that is used to attach the invention to the equipment support. In the embodiments without a set screw, the bolt or pin diameter is a major portion of the cover flange hole such that it prevents the channel member, which is supported by the cover flange extension, from sliding or pivoting away from the cover flange extension. This embodiment allows the swingarm assembly to be removably attached to the cover flange and cover flange extension without forming a clamping type capture opening. A set screw may optionally be provided to provide added lockdown protection, but is not necessary to the functioning of the present invention. This other embodiment also includes various structural arrangements of the bolt/pin type mechanism that will equally secure the swingarm assembly to the cover flange and cover flange extension. The optional set screw may be configured for use against the cover flange extension or it may be configured for use against the peripheral edge of the cover flange. One or more bolts/pins may be used, but a single bolt/pin is sufficient. This embodiment can also be configured for vertical or horizontal cover removal use.

In another embodiment of the present invention, the channel member of the securing mechanism is replaced with a plate, a gusset, an angle or other member and the like and a bolt/pin type securing system. This embodiment uses a similar mechanism for maintaining the swingarm assembly in a secure relationship with the cover flange and cover flange extension as described above except that a spacer rod is incorporated between the retaining sleeve that receives one end of the swingarm assembly and the peripheral edge of the cover flange.

In yet another embodiment of the present invention, the swingarm assembly is modified in such a way that the curved swingarm is replaced by a plate or gusset or angle or other member and the like that is fixedly secured on one end to a swingarm post and incorporates a bolt/pin type system (described above for securing the swingarm assembly to the cover flange) for supporting the cover. The bolt/pin type system supports the cover through the bolt holes in the cover.

To use any of the bolt/pin type system embodiments, the present invention is attached to the equipment object by removing at least one bolt from the cover and inserting either the cover bolt or a pin/rod through the base member of the present invention and into the cover flange hole. The base member with through bolt/pin secures the present invention to the cover flange. The cover is then attached to the swingarm using a lifting member or a swingarm post plate incorporating a similar bolt/pin type securing mechanism. This embodiment of the cover lifting member is described more fully later.

Exemplary Advantages

Overall the present invention can in some exemplary embodiments provide one or more of the following advantages over the prior art:

1. The present invention may be constructed using standard structural members or components that are readily available. The use of custom fabricated or machined components is also possible but not required.

2. Worker safety is increased by eliminating dangerous procedures often used in a plant environment. A typical example of a dangerous procedure includes leaving one bolt in a manway cover at the 6 o'clock position and allowing the cover to "swing down." Reinstallation often requires multiple individuals to "swing the cover up", pivoting it on the one bolt that was left in and "catching" another bolt hole to secure the cover. This often results in personal injury when the cover catches someone's finger in the process or abruptly swings down and strikes an individual. The present invention eliminates this unsafe practice and affords a safe method in which components may be removed and reinstalled.

3. The present invention permits installation and operation by a single individual.

4. The present invention utilizes a bolt-on installation and does not require welding for assembly and use. Installation may be effected by a single individual.

5. The present invention is portable. It may be used in more than one location. The prior art employed custom fabricated devices that were permanently fixed to the component being manipulated.

6. The present invention eliminates rigging to remove and reinstall components.

7. The present invention eliminates cranes, hoists, and/or other heavy machinery to remove and reinstall components.

8. The present invention provides access to components otherwise inaccessible by other means.

9. The present invention provides access to components that are located in confined areas and tight places.

10. The present invention is capable of removing, lifting, supporting, storing, lowering, and/or reinstalling components.

11. The invention may be used on ferrous and non-ferrous components such as but not limited to fiberglass and plastic components.

One skilled in the art will realize that these advantages may be present in some embodiments and not in others, as well as noting that other advantages may exist in the present invention that are not specifically listed above. Nothing in the above-itemized list should be interpreted as limiting the scope of the present invention.

BRIEF DESCRIPTION OF THE DRAWINGS

For a fuller understanding of the advantages provided by the invention, reference should be made to the following detailed description together with the accompanying drawings wherein.

DESCRIPTION OF THE PRESENTLY PREFERRED EXEMPLARY EMBODIMENTS

Embodiments are Exemplary

Figure 1:
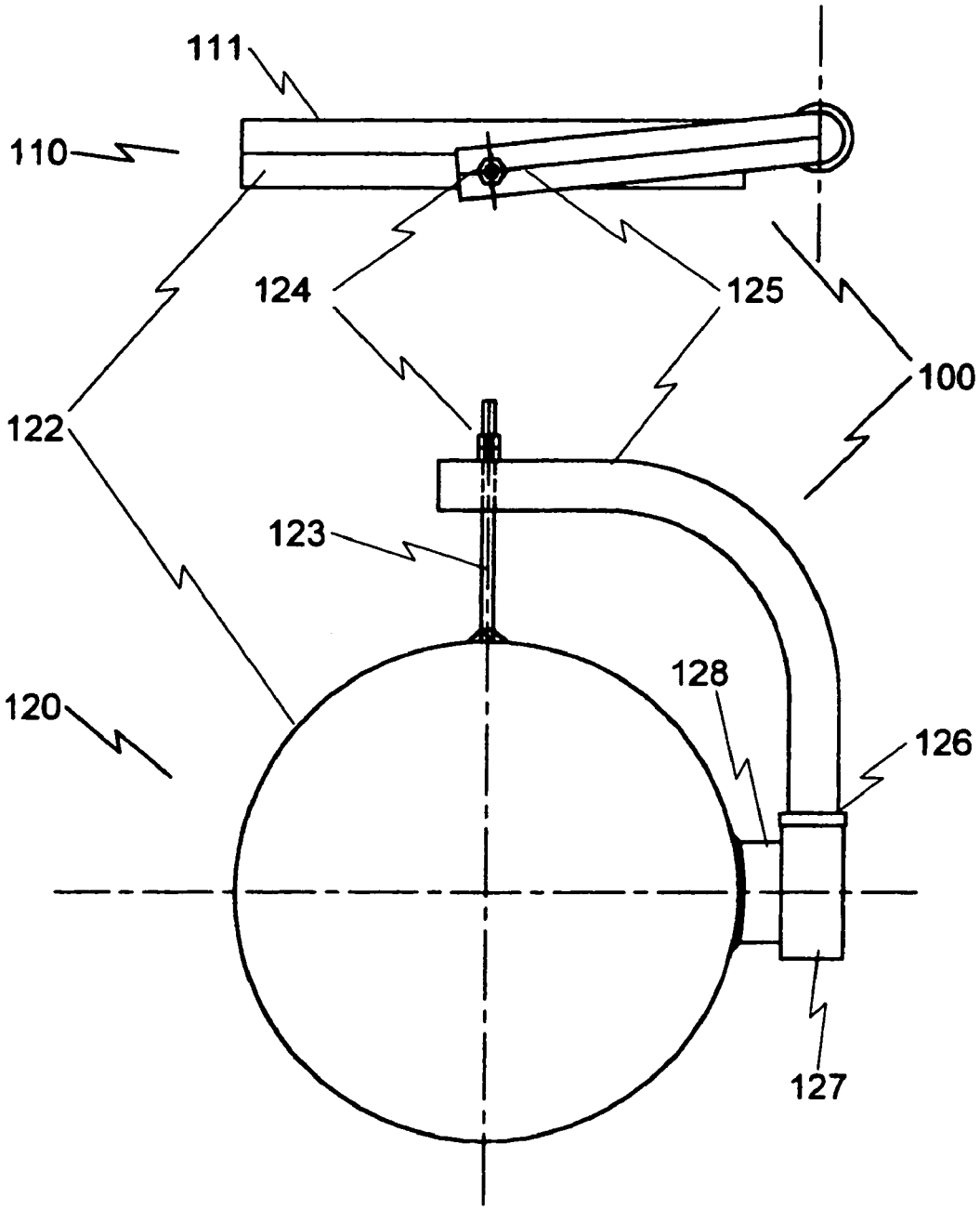
FIG. 1 illustrates an exemplary prior art davit-style installation and removal apparatus that is permanent in nature in that they are affixed to the specific equipment and are generally used to facilitate removal of a specific item on the equipment only.

While this invention is susceptible of embodiment in many different forms, there is shown in the drawings and will herein be described in detailed preferred embodiment with the understanding that the present disclosure is to be considered as an exemplification of the principles and is not intended to limit the broad aspect to the embodiment illustrated.

The numerous innovative teachings of the present application will be described with particular reference to the presently preferred embodiments, wherein these innovative teachings are advantageously applied to the particular problems of a portable lift, support, removal, and/or installation system and method. However, it should be understood that these embodiments are only examples of the many advantageous uses of the innovative teachings herein. In general, statements made in the specification of the present application do not necessarily limit any of the various claimed inventions. Moreover, some statements may apply to some inventive features but not to others. In general, unless otherwise indicated, singular elements may be in the plural and visa versa with no loss of generality.

DEFINITIONS

Throughout the discussion in this document the following definitions will be utilized:

System Blocks/Procedural Steps Not Limitive

The present invention may be aptly described in terms of exemplary system block diagrams and procedural flowcharts. While these items are sufficient to instruct one of ordinary skill in the art the teachings of the present invention, they should not be strictly construed as limiting the scope of the present invention. One skilled in the art will be aware that system block diagrams may be combined and rearranged with no loss of generality, and procedural steps may be added or subtracted, and rearranged in order to achieve the same effect with no loss of teaching generality. Thus, it should be understood that the present invention as depicted in the attached exemplary system block diagrams and procedural flowcharts is for teaching purposes only and may be reworked by one skilled in the art depending on the intended target application.

Parts Generally Interchangeable

Throughout the following discussion there will be five exemplary embodiments discussed in detail. Many of the teachings associated with the present invention will use the embodiment in FIG. 2 as the prototype for discussion. However, the teachings when addressed to elements in this figure are equally applicable to other embodiments of the present invention. Thus, for example, the channel member (201) in FIG. 2 may generally correspond to one or more channel members (601, 611) in FIG. 6 or (901, 902) in FIG. 9 with no loss of generality in the scope of the invention. One skilled in the art will quickly recognize these correspondences and realize that references to one embodiment may in many circumstances have applicability to other embodiments, both those specifically illustrated and those that are taught but not illustrated.

Manway Not Limited

Throughout the description of the present invention it will be explained in the context of lifting, supporting, and/or installing a manway cover. As one skilled in the art will recognize, the present invention is not limited to the manipulation of manway covers, but may be used anywhere there is a need for manipulation of any mobile device, removable fixture, or movable equipment. Thus, the term 'manway' and its variants should be broadly interpreted within the scope of the present invention consistent with this observation. Generally, the present invention is applicable in a very broad class of situations where a device/object must be manipulated (moved, hoisted, transported, maintained, etc.) with safety and efficiency by one or more persons.

Device Manipulation Not Limitive

Within the context of this disclosure, the phrases 'device/object manipulation' and its variants should be broadly construed to include but not be limited to maintenance, replacement, inspection, lifting, supporting, temporary/permanent storage, removal and/or installation of any device including but not limited to manway covers and the like.

Since the present invention may be broadly applied to a wide variety of object that are subject to movement, the phrase 'movement object' will be used to define any object that has the capability of movement and as such is amenable to use with the present invention system and/or method.

Portable Not Limitive

While the present invention is applied with particular advantage in situations where it may be used in a portable manner, nothing in the scope of the present invention disclosure should limit the teachings to that of a portable device manipulator. As one skilled in the art will recognize, it is perfectly acceptable to utilize the teachings of the present invention to integrate device/equipment manipulation capabilities into a permanent or semi-permanent structure attached to the device/equipment to be manipulated.

Horizontal/Vertical Not Limitive

Throughout the discussion of the present invention various embodiments will be illustrated that are particularly suited for use in manipulating devices/objects that are assembled in a horizontal or vertical orientation. Nothing within this disclosure should be interpreted to limit the scope of the present invention to configurations in either of these two orientations. Thus, while horizontal and vertical embodiments of the present invention may be preferable in many circumstances, the invention is not limited to these orientations.

Figure 6:
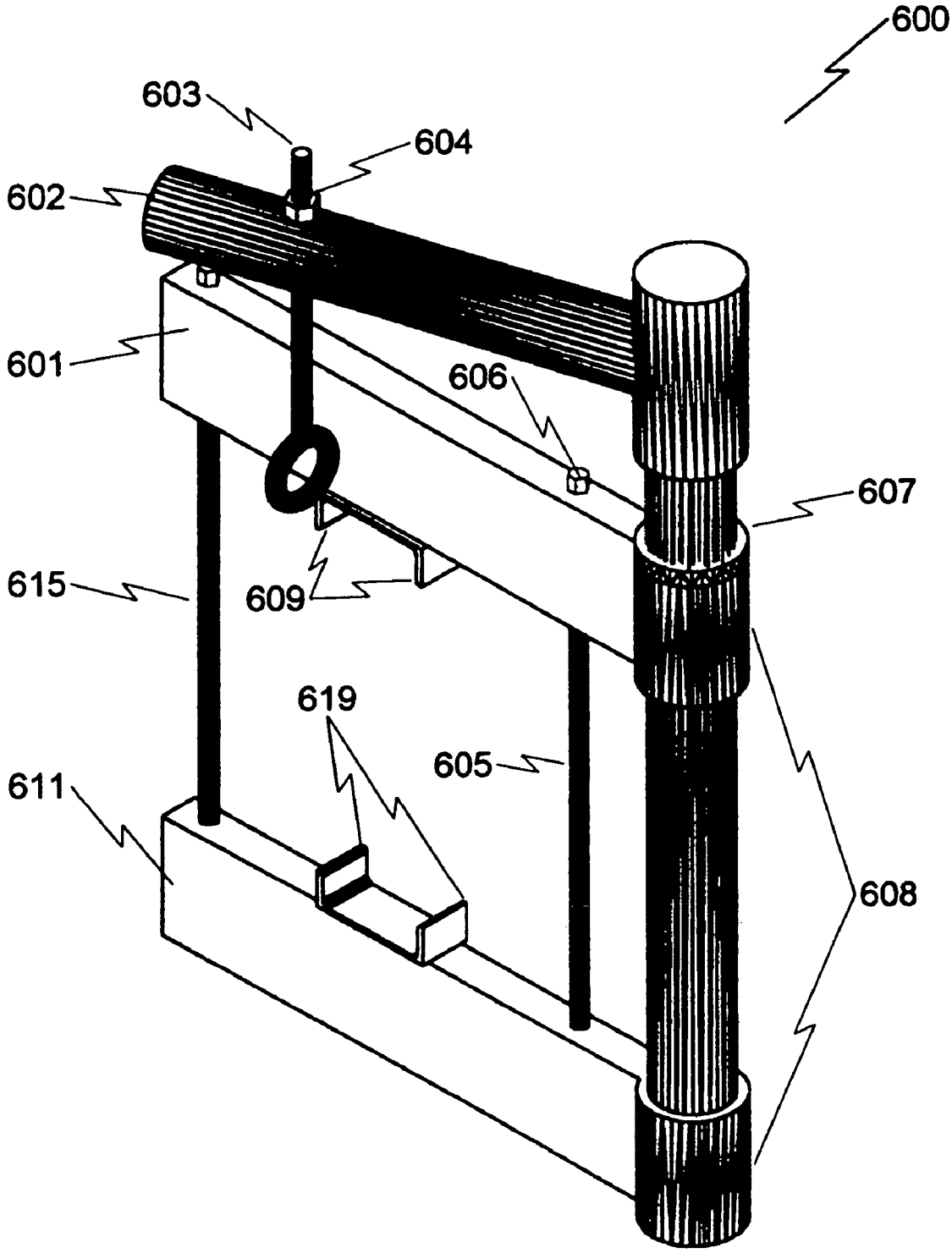
FIG. 6 illustrates an exemplary HDCV-style embodiment of the present invention.
Figure 9:
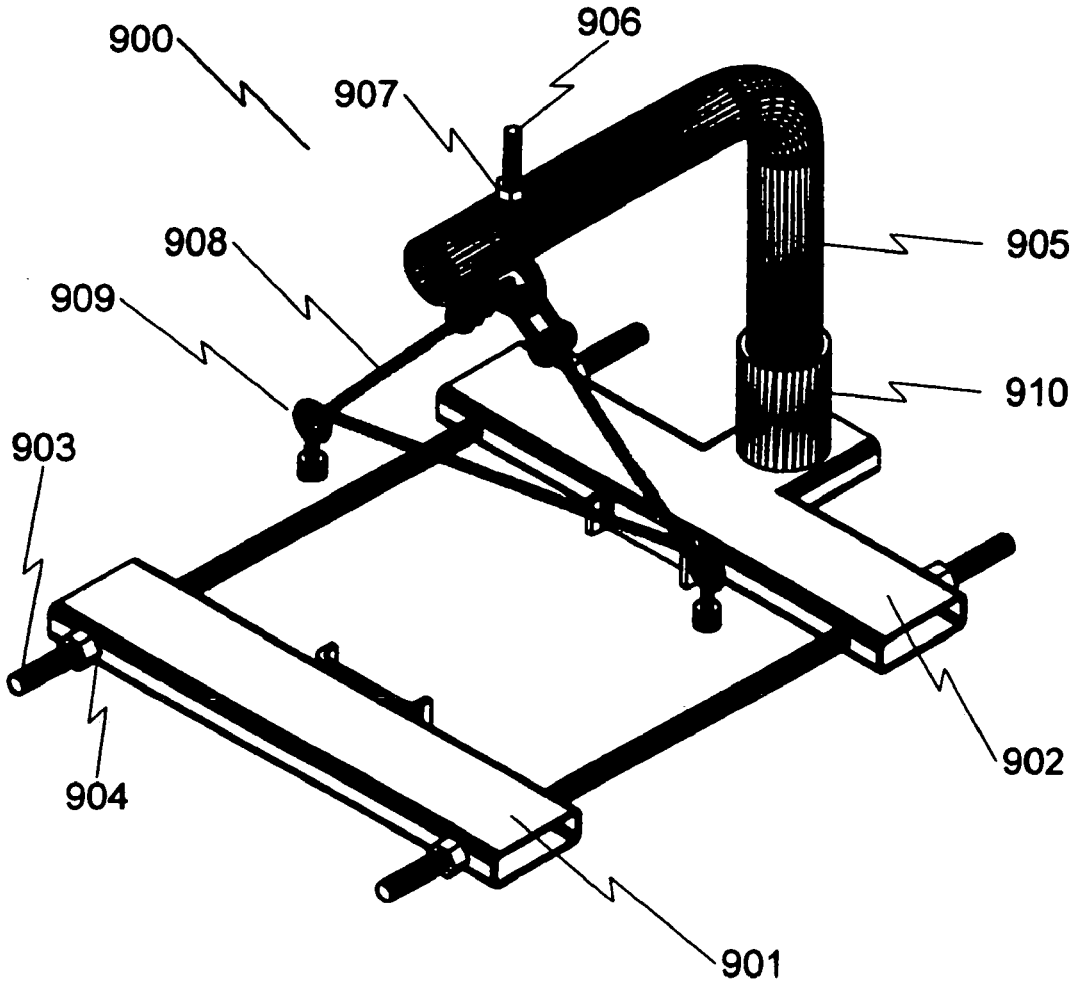
FIG. 9 illustrates an exemplary HDCH-style embodiment of the present invention.

Note that within this discussion the term 'capture plane' will be used to indicate the plane in which the invention attaches to the equipment support. Thus, for example, the present invention may as in FIG. 2 be oriented such that the swingarm is oriented/retained in a plane parallel to the capture plane (the U-bolt (202) orientation), or as illustrated in FIG. 6 with channel members (601, 611). Conversely, there are preferred embodiments as illustrated in FIG. 9 such that the swingarm is oriented/retained in a plane perpendicular to the capture plane of channel members (901, 902). One skilled in the art will recognize that the teachings of the present invention are applicable to any orientation and not specifically to parallel or perpendicular capture plane orientations.

T-Couplings Not Limitive

It should be noted in the following embodiments that various T-couplings and members are illustrated and described in terms of the accompanying drawings. These T-members may be equivalently replaced by L-shaped members or combinations of T-members and L-members as would be well known by one skilled in the mechanical arts. These substitutions do not impact the functionality of the embodiment, but rather provide an alternative construction technique in the spirit of the disclosed invention.

Fastening Means Not Limitive

Throughout the explanation of various embodiments of the present invention the phrase 'fastening means' should be broadly interpreted to include any mechanical means of fastening, whether temporary or permanent. Thus, nuts, bolts, cap screws, wing nuts, rubber plugs with screw-in inserts, and/or the like are included within this definition but the term 'fastening means' should not be interpreted to be limited to just these means of mechanical connection. For example, ropes, pulleys, chains, and other mechanical means of fastening would also be included within this broadly defined term.

It should be noted that in many embodiments it has been found that the use of rubber inserts combined with screw-in inserts may be utilized to affect fastening in circumstances where holes are available in the movement object for this purpose as illustrated by the exemplary embodiment (909) illustrated in FIG. 9. In other circumstances clamps and other similar structures may be used to affect fastening to the movement object.

Channel Members (201) Not Limitive

Figure 2:
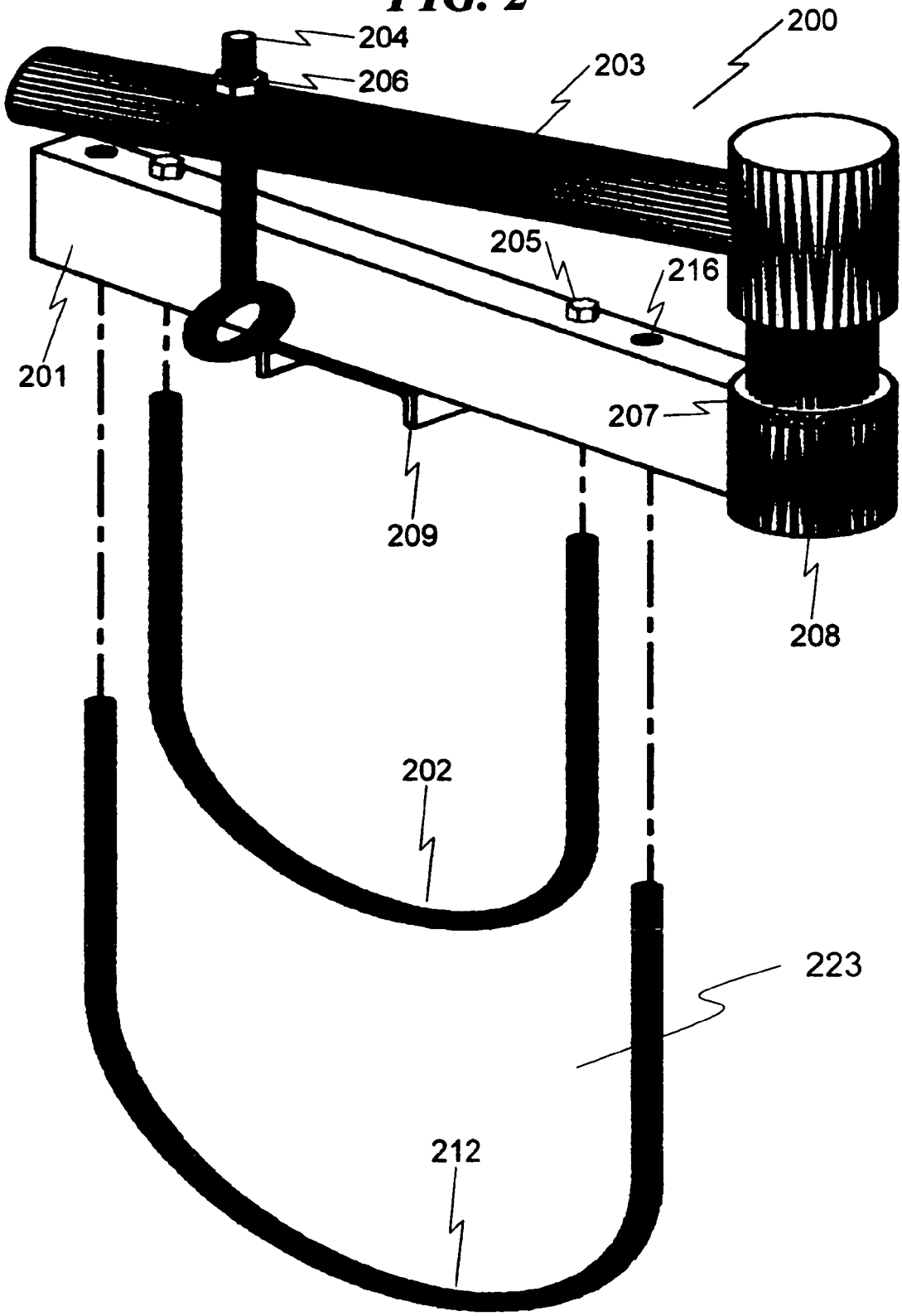
FIG. 2 illustrates an exemplary MDUV-style embodiment of the present invention with an optional alternate retaining rod member configuration.

Within the context of the present invention the channel members (201) as exemplified in FIG. 2 may be comprised of a wide variety of materials and configurations, such as (but not limited to) channel pieces, extruded members, tubing, I-beam type construction materials, rectangular tubing, square tubing, round tubing, pipe, beams, angles, Z-shapes, structured shapes, plastic tubing, plastic shapes, fabricated sections, and/or the like.

No limitation on the composition of materials for the channel members (201) is imposed by the present invention. The exact type of construction material is immaterial to the proper functioning of the invention, but may be in some cases dictated by the loads that the invention is designed to lift. However, it is specifically anticipated that the channel members (201) are amenable to construction using metal, plastic, and wood products.

Various possible modifications of the channel member (201) are possible that may in some circumstances improve the performance of this invention element. These modifications include (but are not limited to) the following:

1. geometrically shaped holes for U-bolt or tie rods;
2. slotted hole for U-bolt or tie rods;
3. slotted geometrically shaped holes for U-bolt or tie rods;
4. internal sleeve (member inside a member);
5. external sleeve (member outside a member);
6. composite straight section; and/or
7. external lugs made from plate, structural steel, bar, and/or bar stock.

One skilled in the art will no doubt be able to extend the teachings of the present invention in other areas not listed above after reading this disclosure.

All of these material selection considerations are well within the skill of one skilled in the mechanical arts when given the teachings of the present invention.

Clamping Jaw Appendage (209) Not Limitive

Within the context of the present invention the channel member (203) as exemplified in FIG. 2 may be augmented with a clamping jaw appendage (209), such as (but not limited to) channel, saw tooth section, bent plate, V-shape, contoured round (semi-circular, arc, etc.) shape, serration (such as in a pipe wrench jaw and the like), roughened surface, knurled surface, stippled surface, checked surface, rubber surface, elastomer surface, and/or the like. These augmentations of the channel member (203) are not limiting on the scope of the teachings of the present invention.

All of these material selection considerations are well within the skill of one skilled in the mechanical arts when given the teachings of the present invention.

Threaded U-Bolt (202) Not Limitive

Within the context of the present invention a variety of threaded U-bolts (202) as exemplified in FIG. 2 may be made of a wide variety of materials and configurations, such as (but not limited to) threaded rod, unthreaded rod threaded at the ends, cable and/or wire rope, rope, bar stock, structural members, pipe and/or tubing, and/or the like.

All of these material selection considerations are well within the skill of one skilled in the mechanical arts when given the teachings of the present invention.

Swingarm (203) Not Limitive

Within the context of the present invention the swingarms (203) as exemplified in FIG. 2 may be comprised of a wide variety of materials and configurations, such as (but not limited to) pipe, pipe fittings, tubing, tubing fittings, channel, beams, angles, Z-shapes, structural shapes, plastic tubing, plastic shapes, fabricated sections, and/or the like.

No limitation on the composition of materials for the swingarm assembly (203) is imposed by the present invention. The exact type of construction material is immaterial to the proper functioning of the invention, but may be in some cases dictated by the loads that the invention is designed to lift. However, it is specifically anticipated that the swingarm assembly (203) is amenable to construction using metal, plastic, and wood products.

All of these material selection considerations are well within the skill of one skilled in the mechanical arts when given the teachings of the present invention.

Lifting Member (204) Not Limitive

Within the context of the present invention the lifting rod member (204) as exemplified in FIG. 2 may be comprised of a wide variety of materials and configurations, such as (but not limited to) an eye bolt, rod end, threaded bar, fabricated lifting device, plate, lugs, rope, rope with crank, cable and/or wire, cable and/or wire with crank, chain, tubing, sling, permanent magnet, electromagnet, Velcro®, structural members, and/or the like. Given this wide variety of application, the terms 'lifting rod' should be broadly interpreted as 'lifting member' within the context of this disclosure.

Note also that while the illustrated lifting members (204) in some embodiments may be relatively short, in other configurations these lifting members (204) may be of considerable length, to both permit dropping the movement object to the ground and/or to permit lifting the movement object above the equipment fixture to which it is or was attached. These variations in length of the lifting member (204) may be accompanied by corresponding increases/decreases in the height of the swingarm assembly (203) so as to permit lifting/lowering of the movement object away from the equipment fixture. Given these observations, nothing in the disclosed invention teachings should be construed as limiting the length of the lifting member (204) or the height of the swingarm assembly (203).

Additionally, it should be noted that nothing within the context of the present invention teachings limits an invention embodiment to the use of a single lifting member (204). Multiple lifting members may be incorporated into some embodiments to provide additional safety features not available in the prior art. For example, referencing FIG. 16, the use of multiple DavaClevis™, brand enhanced clevis retainers (1500, 1654) with one or more lifting members (1656, 1657) can ensure that in the event of a single component failure the movement object will not fall and subsequently injure an operator or other maintenance personnel.

All of these material selection considerations are well within the skill of one skilled in the mechanical arts when given the teachings of the present invention.

DavaClevis™ Brand Enhanced Clevis Retainer Not Limitive

The present invention in some embodiments may make use of a DavaClevis™ brand enhanced clevis retainer (1500, 1654) to support/restrain the movement object and provide attachment to the lifting member (204). While this is configuration may constitute the preferred embodiment in many circumstances, the present invention should not be limited to situations in which the DavaClevis™ brand enhanced clevis retainer is incorporated into the lifting member (204).

Fasteners (205, 206) Not Limitive

Within the context of the present invention the fasteners (205, 206) as exemplified in FIG. 2 may be comprised of a wide variety of materials and configurations, such as (but not limited to) a nut and washer, lever, cam, wheel, ratchet, wing nut, and/or the like. All of these material selection considerations are well within the skill of one skilled in the mechanical arts when given the teachings of the present invention.

Collar/Stop (207) Not Limitive

Within the context of the present invention the swingarm collar/stop (207) as exemplified in FIG. 2 may be comprised of a wide variety of materials and configurations, such as (but not limited to) pipe, tubing, plate, bar, fasteners, pins, bearings, nuts, beams, angles, Z-shapes structural shapes, plastic tubing, plastic shapes, fabricated sections, and/or the like.

No limitation on the composition of materials for the swingarm collar/stop (207) is imposed by the present invention. The exact type of construction material is immaterial to the proper functioning of the invention, but may be in some cases dictated by the loads that the invention is designed to lift. However, it is specifically anticipated that the swingarm collar/stop (207) is amenable to construction using metal, plastic, and wood products.

All of these material selection considerations are well within the skill of one skilled in the mechanical arts when given the teachings of the present invention.

Retaining Sleeve (208) Not Limitive

Within the context of the present invention the swingarm retaining sleeve (208) as exemplified in FIG. 2 may be comprised of a wide variety of materials and configurations, such as (but not limited to) pipe, tubing, rolled plate, bar stock, machined solid bar, bearings (ball, roller, needle, journal, thrust, spherical, and the like), fabricated sections, and/or the like.

No limitation on the composition of materials for the swingarm retaining sleeve (208) is imposed by the present invention. The exact type of construction material is immaterial to the proper functioning of the invention, but may be in some cases dictated by the loads that the invention is designed to lift. However, it is specifically anticipated that the swingarm retaining sleeve (208) is amenable to construction using metal, plastic, and wood products.

Figure 3:
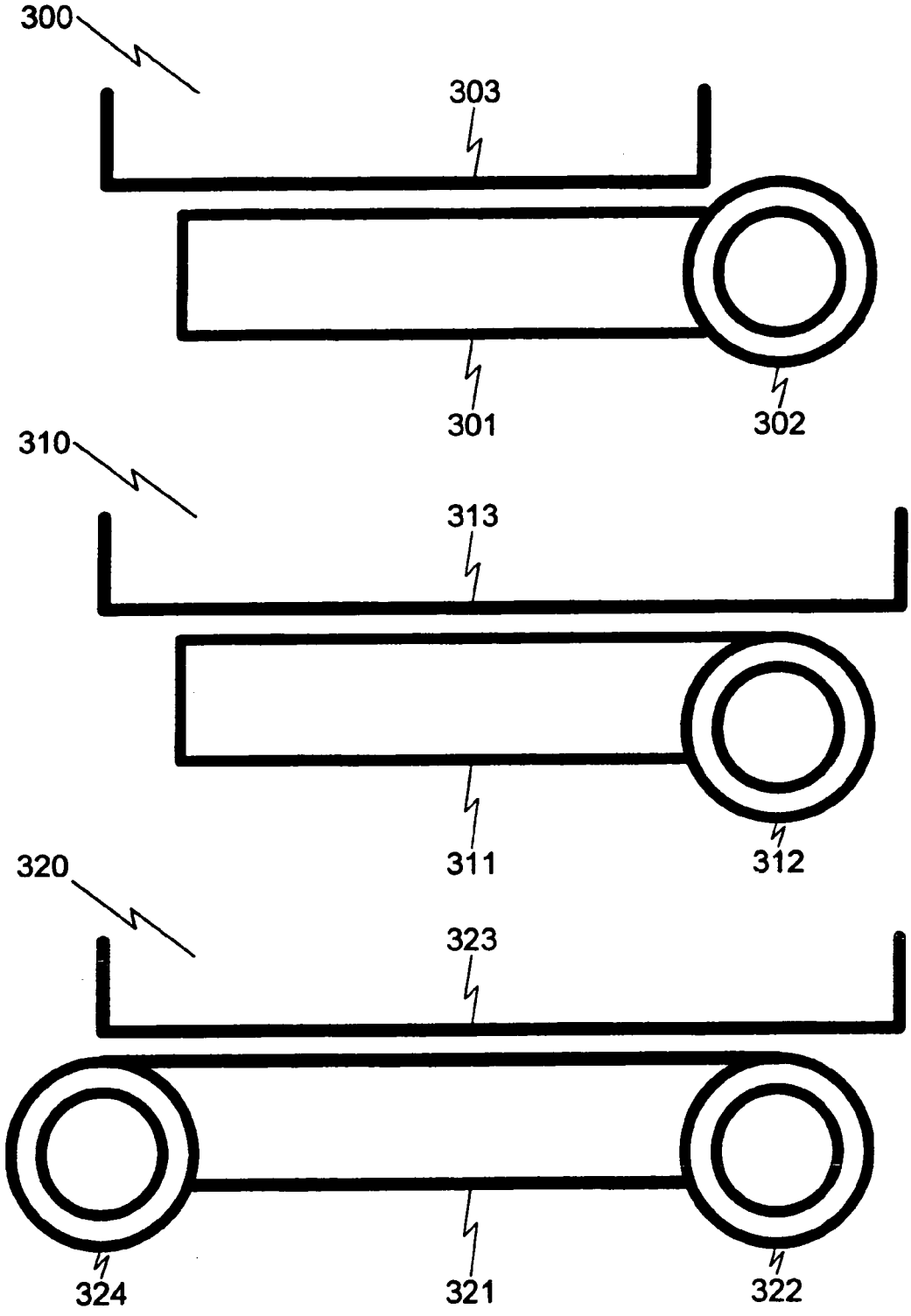
FIG. 3 illustrates an exemplary alternative method of configuring the swingarm retaining sleeve to permit flush mounting of the present invention in space-constricted environments.

Furthermore, as illustrated in the top view of FIG. 3, the relationship between the swingarm sleeve(s) (302, 312, 322) and the channel member(s) (301, 311, 321), may be either centered (300) or offset (310, 320). Centered configurations (300) will work in many situations where there is no obstacle (303), whereas flushmount configurations (310, 320) are amenable to situations where an obstacle (313, 323) presents a space-constricted environment for the channel member (311, 321) and retaining sleeve (312, 322, 324).

The reader is asked to pay particular attention to the preferred retaining sleeve configuration of (320), which indicates that a channel member may contain more than one retaining sleeve (322, 324), and by implication each channel member may support more than one swingarm assembly. Configurations with multiple retaining sleeves and/or swingarms may take any configuration, including but not limited to combinations of the configurations illustrated in FIG. 3. The present invention does not limit the number of swingarms or their configuration with respect to the channel members and/or retaining sleeves.

All of these material selection considerations are well within the skill of one skilled in the mechanical arts when given the teachings of the present invention.

Single Swingarm Not Limitive

As illustrated by the top view of FIG. 3, there can exist more than one swingarm retaining sleeve (322, 324) for a given channel member (321). Thus, the present invention does not limit the number of swingarms and/or swingarm retaining sleeves that may be incorporated into the invention embodiment. This feature permits multiple movement objects to be operated on by a single channel member or set of channel members. This feature is useful in situations where multiple loads originating from a single equipment fixture must be manipulated.

Swingarm/Retaining Sleeve Interface Not Limitive

Within the context of the present invention the interface between the swingarm (203) and the swingarm retaining sleeve (208) as exemplified in FIG. 2 may be comprised of a wide variety of materials and configurations, such as (but not limited to) a normal swingarm in retaining sleeve configuration, a bearing comprising the interface, anti-friction materials at the interface, anti-friction ring interface, anti-friction sleeve interface, lubricated interface, and/or dry interface and/or the like.

All of these material selection considerations are well within the skill of one skilled in the mechanical arts when given the teachings of the present invention.

Lateral Adjustment Not Limitive

Figure 16:
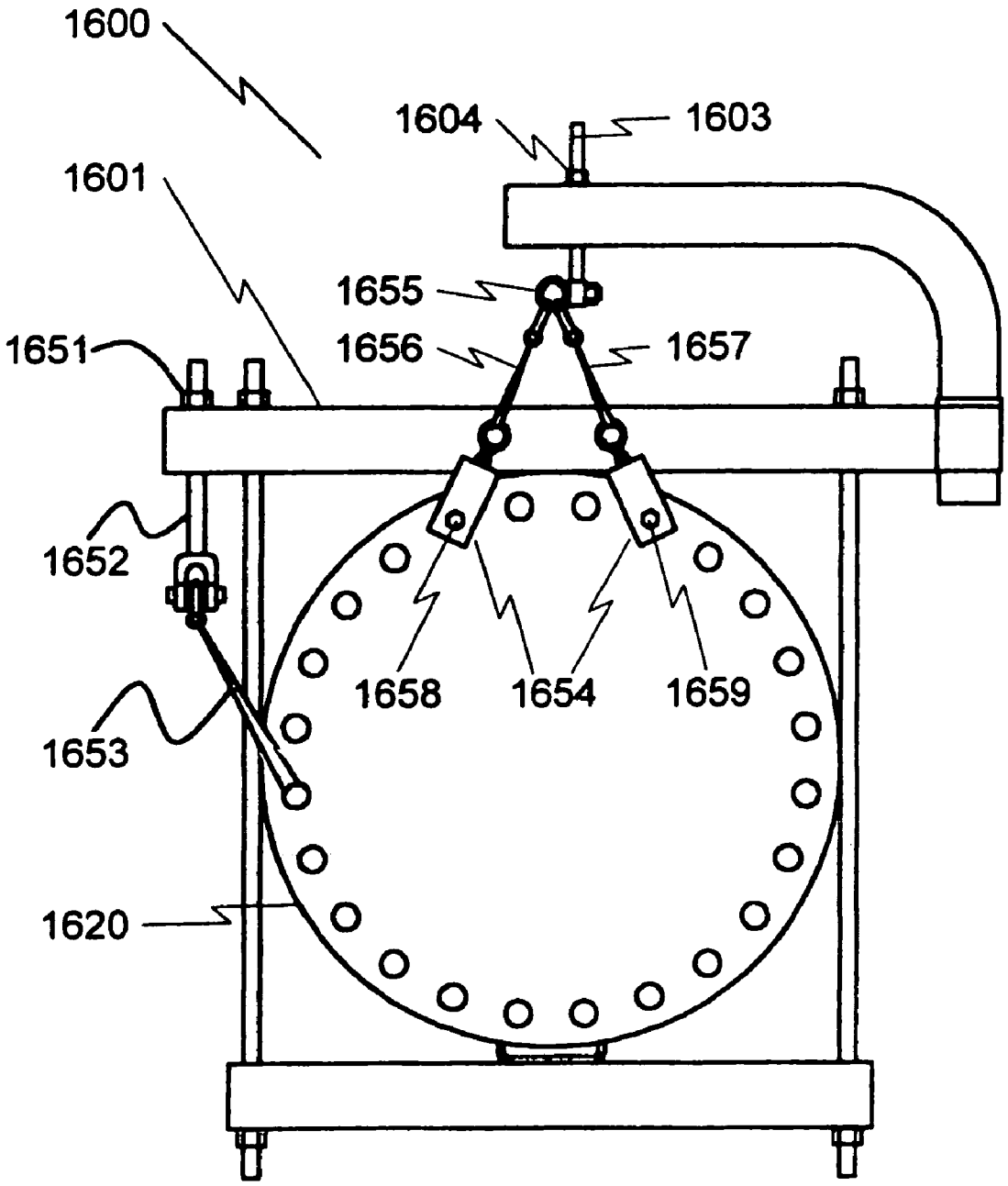
FIG. 16 illustrates an alternate exemplary embodiment of the present invention incorporating additional safety features.

Within the context of the present invention the lifting rod member (204) as exemplified in FIG. 2 may be augmented with a lateral adjustment means, such as (but not limited to) an eye bolt, rod end, threaded bar, fabricated device, plate, lug, pipe, tubing, structural member, and/or the like. The ability of these augmented embodiments to offset the load point of the swingarm (203) is not limiting on the scope of the teachings of the present invention. An exemplary implementation of this lateral adjustment means (1655) is illustrated in FIG. 16.

All of these material selection considerations are well within the skill of one skilled in the mechanical arts when given the teachings of the present invention.

Lifting Lug/Device Not Limitive

Within the context of the present invention the movement object may have associated with it a lifting lug/device to permit support of the movement object during installation, etc. While many of the drawings presented herein depict this feature in the movement object, it is not a requirement that the movement object contain this component. The present invention may be augmented with a variety of clevises and the like to permit attachment of the lifting rod (204) or the like to the movement object. Thus, nothing in the teachings of the present invention should limit the scope of application to situations where the movement object incorporates a lifting lug/device.

All of these material selection considerations are well within the skill of one skilled in the mechanical arts when given the teachings of the present invention.

Safety Enhancements Not Limitive

The present invention is designed to provide in various preferred embodiments both ease of use and increased safety over the prior art. To this end, many preferred embodiments will contain additional safety features, such as (but not limited to) cotter pins, double nutting, end-stop limitations, and the like to prevent the invention embodiment from becoming inadvertently disassembled during use and injuring an operator or bystander.

While many of these techniques are preferred and illustrated in the various embodiments put forth herein, they are not to be interpreted as limiting the scope of the teachings of the present invention.

Figure 15:
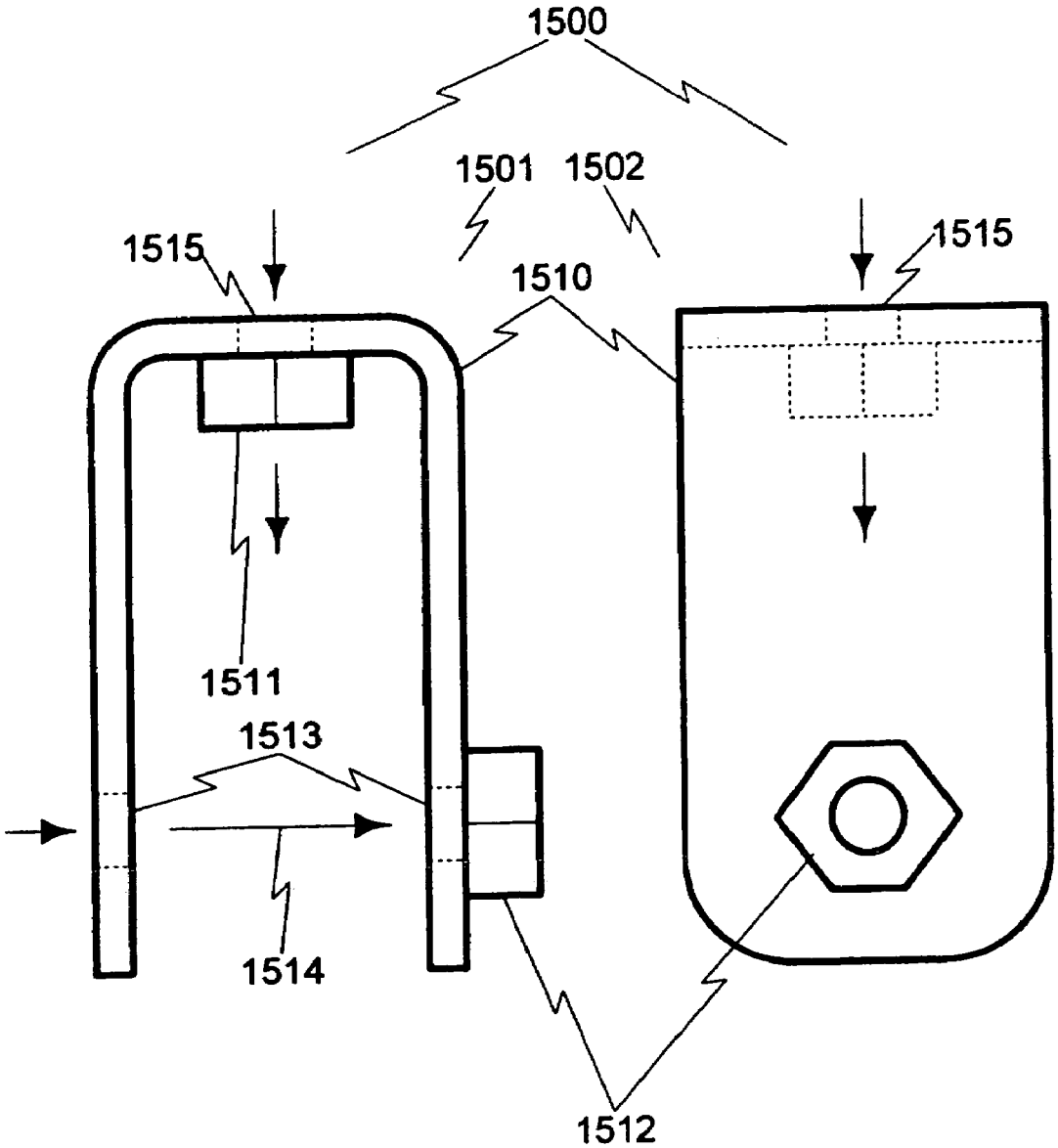
FIG. 15 illustrates an exemplary DavaClevis™ brand enhanced clevis retainer.

With respect to specific safety enhancements such as cotter pins, double nutting, end-stop limitations, rotation limits, and/or the teachings put forth in FIGS. 15-16, the present invention may incorporate any of these or none of these teachings without restriction. Implementation of all of these safety variants is well within the skill of one skilled in the mechanical arts when given the teachings of the present invention.

Exemplary System Architectures

The present invention is amenable to a wide variety of embodiments. However, under certain circumstances these embodiments may be classified as having particular application to various industrial circumstances. Specifically, the following embodiments are anticipated by the teachings of the present invention:

1. Medium Duty U-Bolt Vertical (MDUV) Style (200). Designed for use with vertically oriented tanks, pressure vessels, and the like. This embodiment is illustrated in FIGS. 2-5 and generally utilizes a U-bolt or threaded rod structure in its construction.

Figure 7:
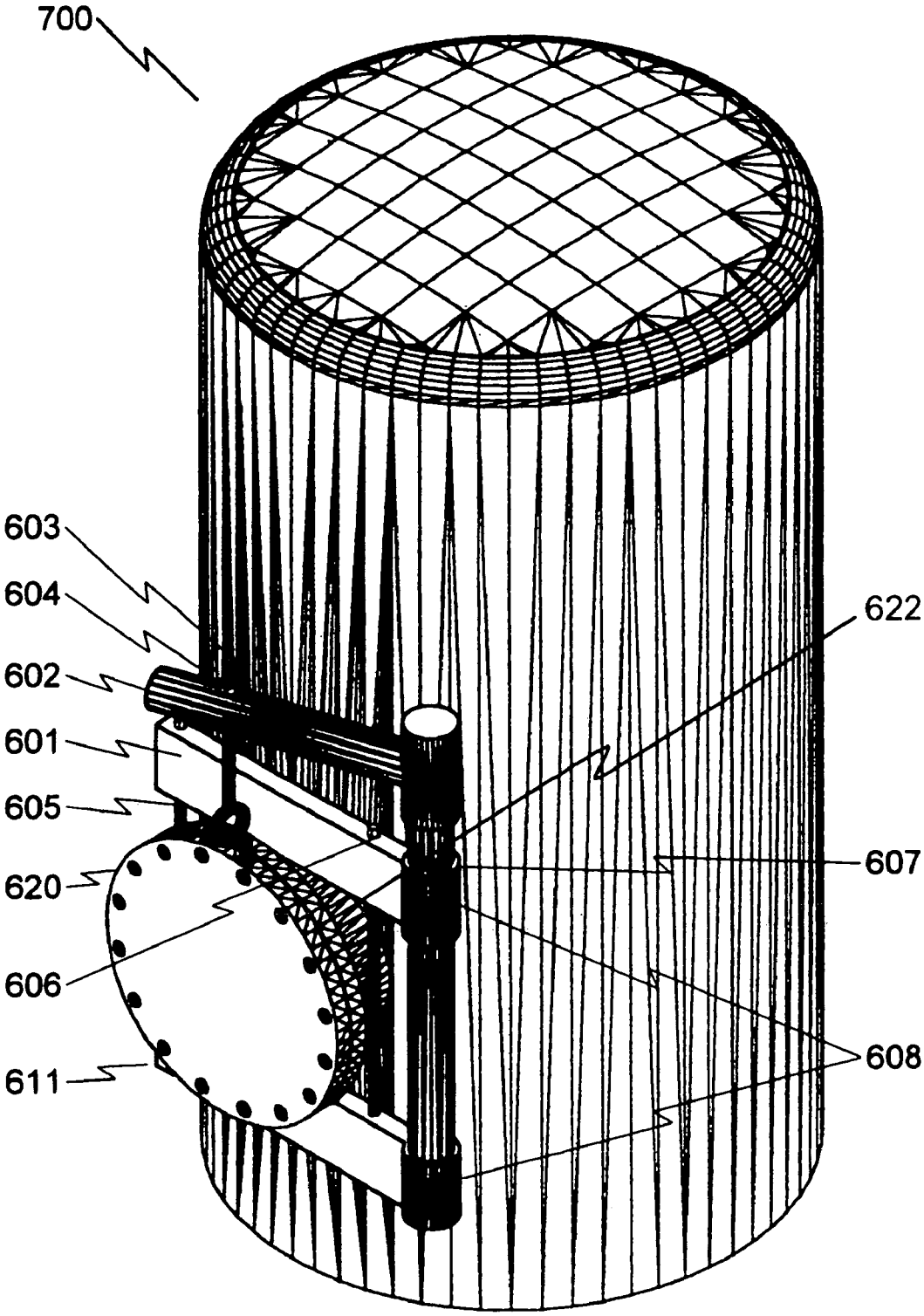
FIG. 7 illustrates an exemplary HDCV-style embodiment of the present invention installed on a tank or pressure vessel on which is located a horizontal manway having said manway cover in the closed position.
Figure 8:
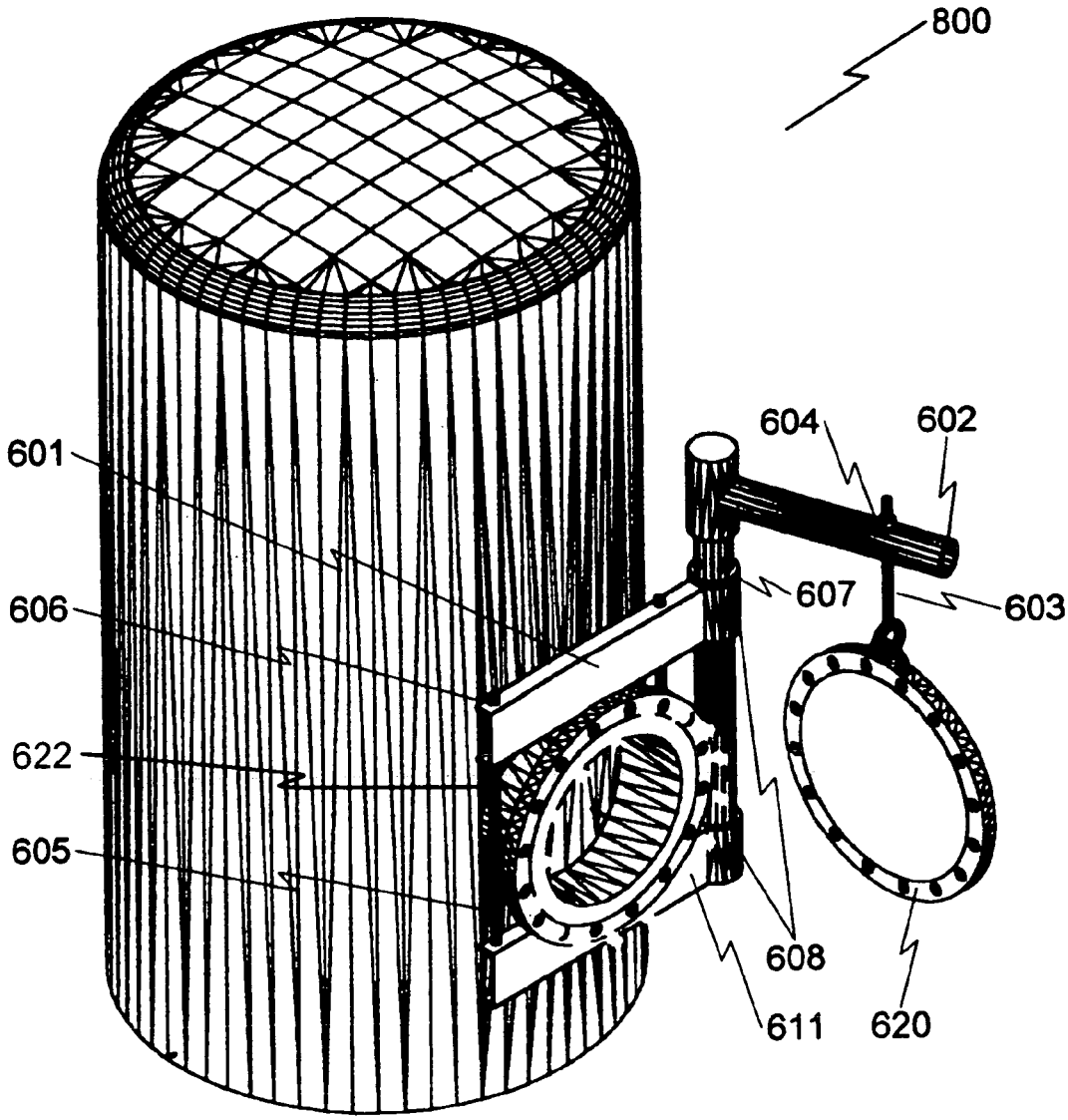
FIG. 8 illustrates an exemplary HDCV-style embodiment of the present invention installed on a tank or pressure vessel on which is located a horizontal manway having said manway cover in the open position.

2. Heavy Duty Tie Rod Clamp Vertical (HDCV) Style (600). Designed for heavy-duty use with vertically oriented tanks, pressure vessels, and the like. This embodiment is illustrated in FIGS. 6-8 and generally incorporates a tie rod type clamping structure in its construction.

Figure 10:
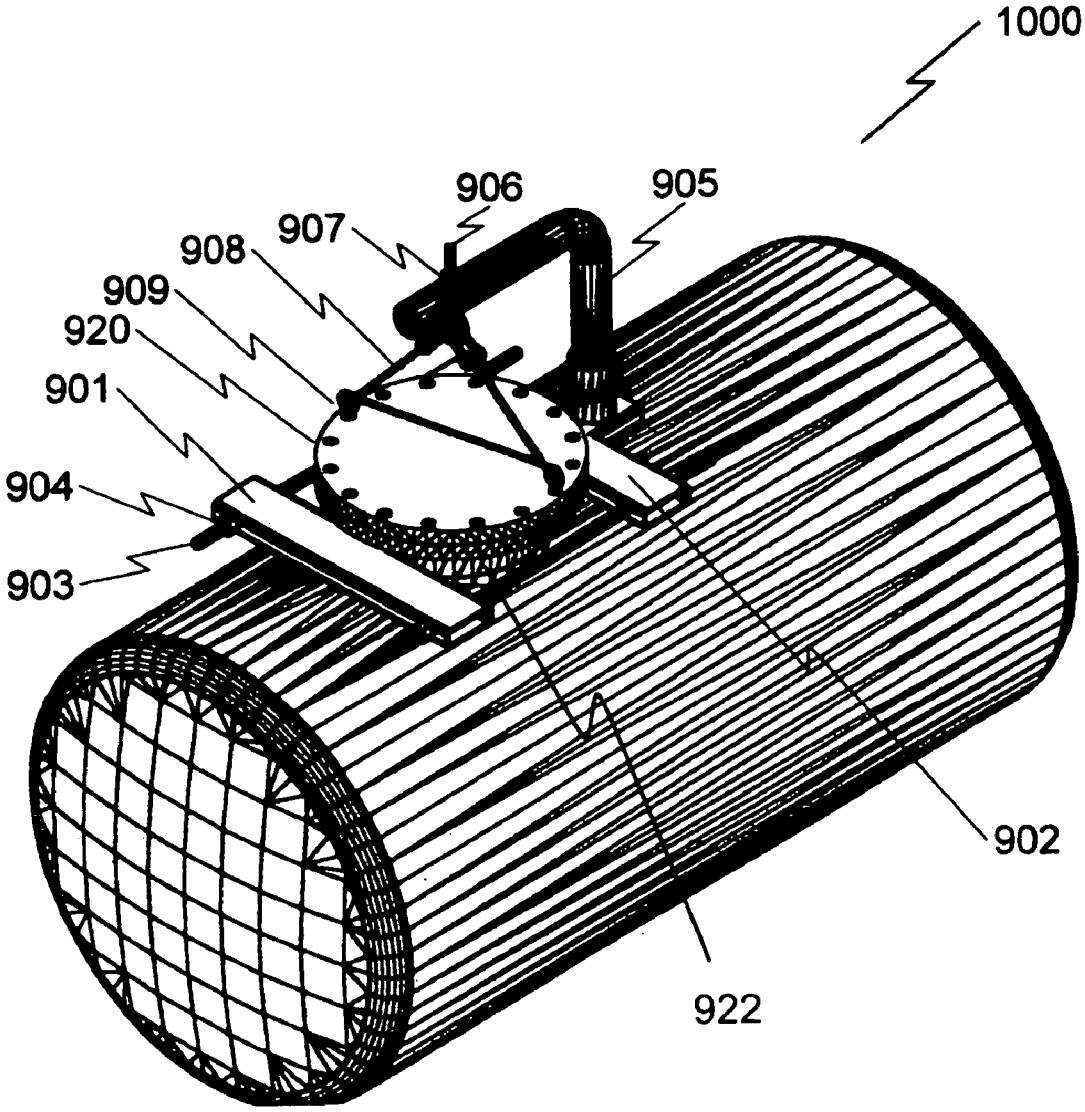
FIG. 10 an exemplary HDCH-style embodiment of the present invention installed on a tank or pressure vessel on which is located a vertical manway having said manway cover in the closed position.
Figure 11:
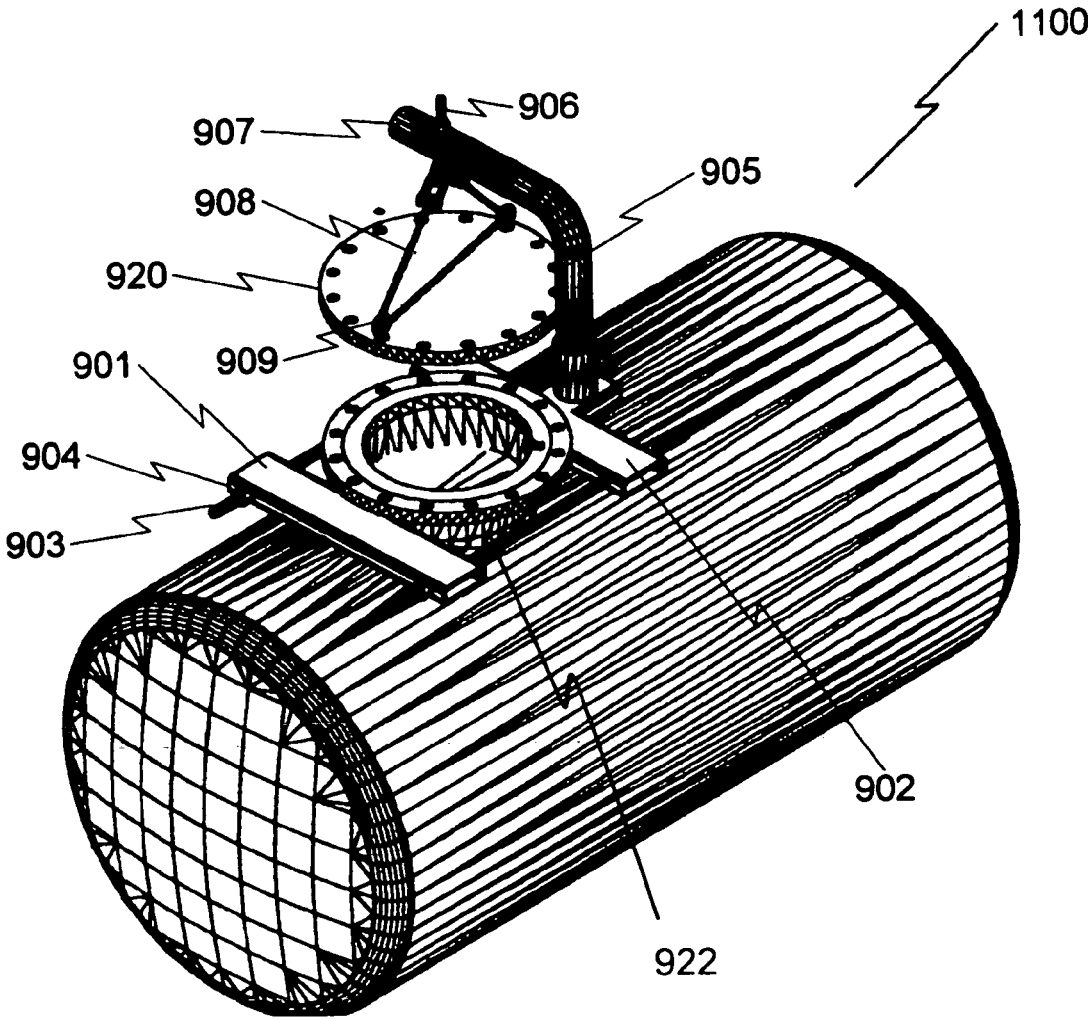
FIG. 11 an exemplary HDCH-style embodiment of the present invention installed on a tank or pressure vessel on which is located a vertical manway having said manway cover in the open position.

3. Heavy Duty Tie Rod Clamp Horizontal (HDCH) Style (900). Designed for heavy-duty use with horizontally oriented tanks, pressure vessels, and the like. This embodiment is illustrated in FIGS. 9-11 and generally incorporates a tie rod type clamping structure in its construction.

Figure 12:
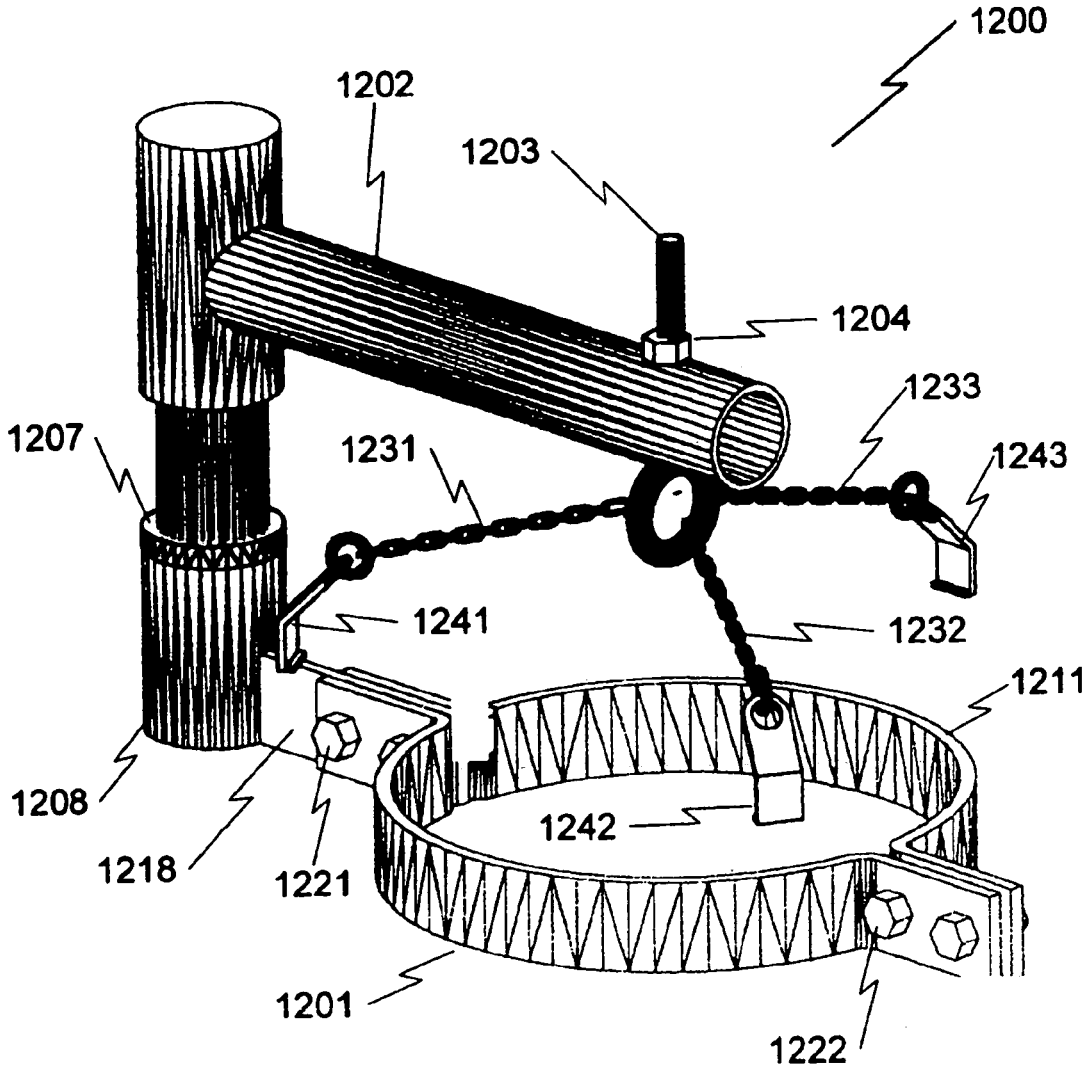
FIG. 12 illustrates an exemplary HDBH-style embodiment of the present invention incorporating band-style equipment fixture support.
Figure 13:
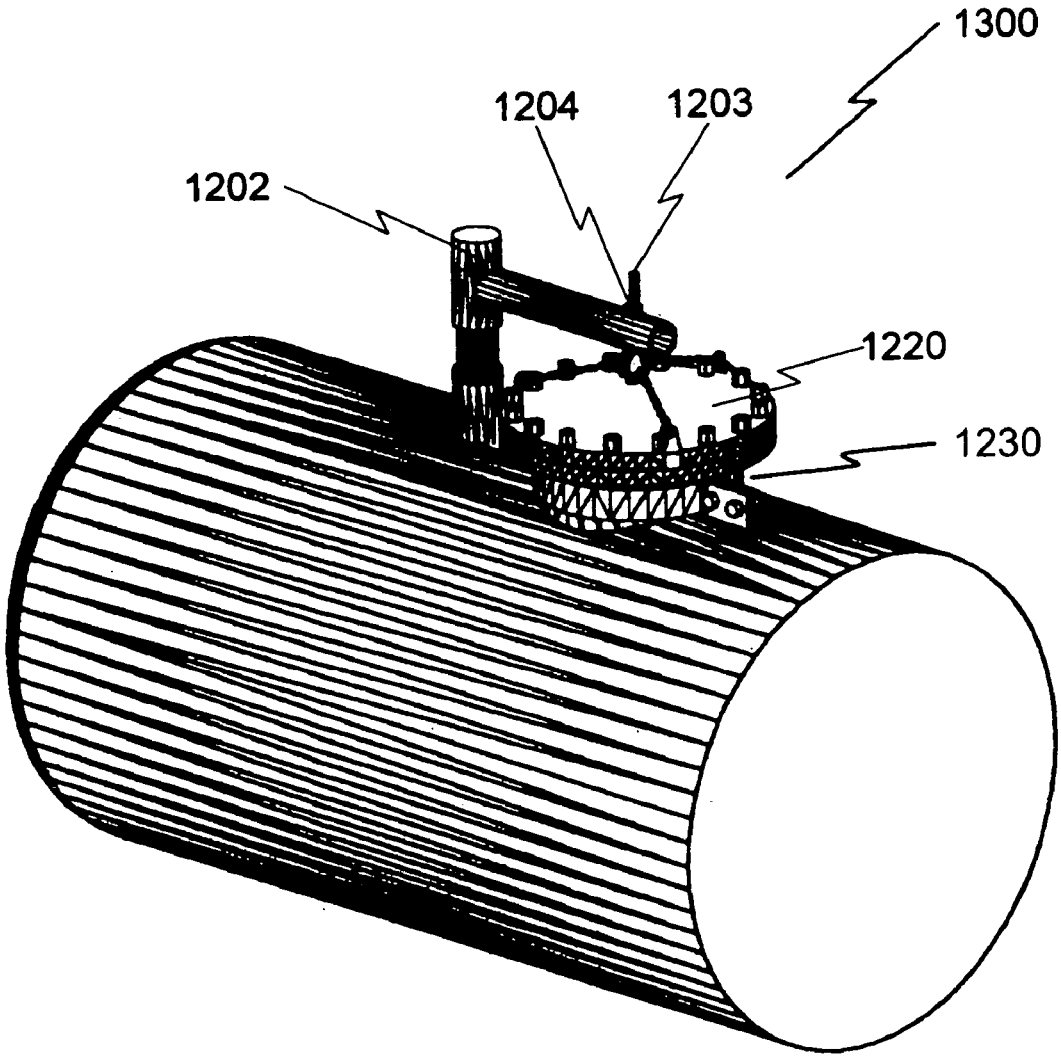
FIG. 13 an exemplary HDBH-style embodiment of the present invention incorporating band-style equipment fixture support installed on a tank or pressure vessel on which is located a vertical manway having said manway cover in the closed position.
Figure 14:
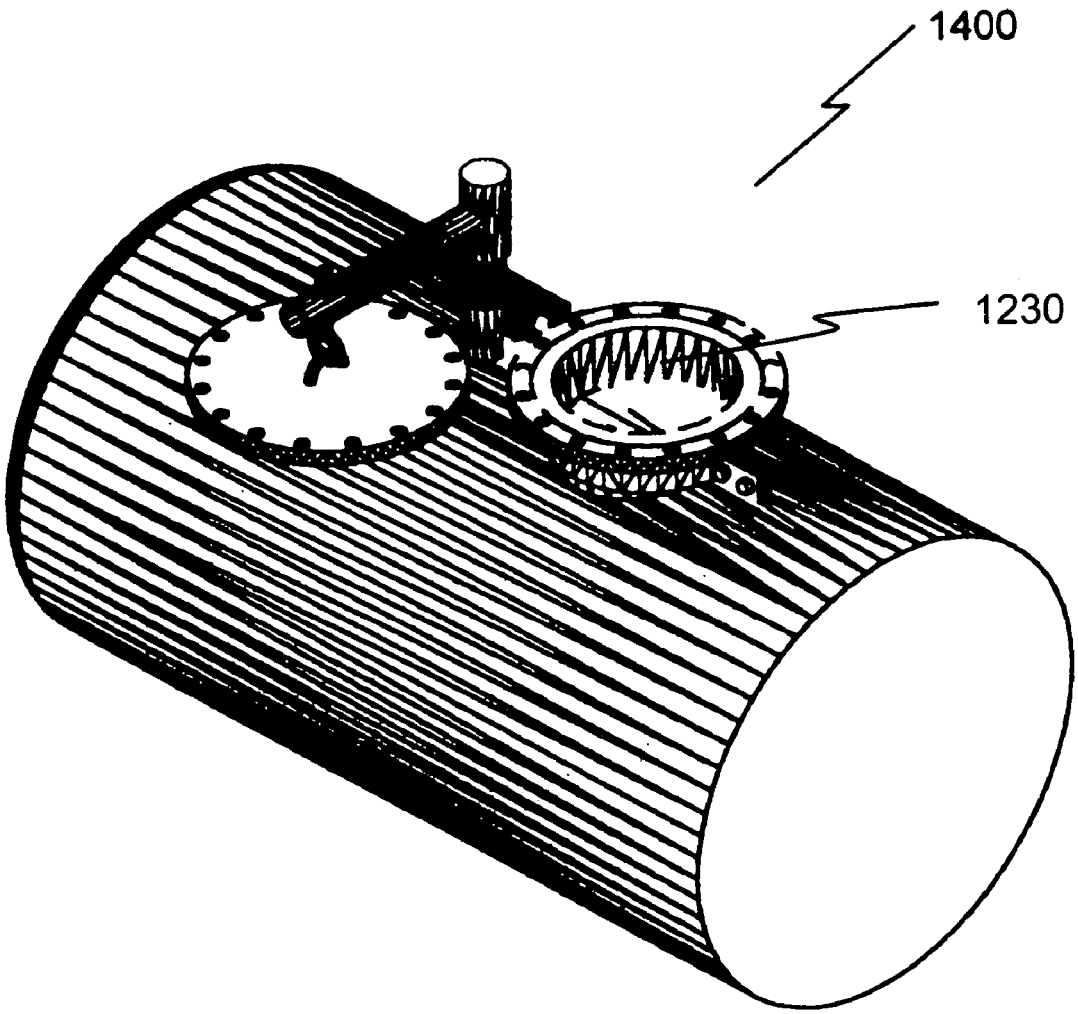
FIG. 14 an exemplary HDBH-style embodiment of the present invention incorporating band-style equipment fixture support installed on a tank or pressure vessel on which is located a vertical manway having said manway cover in the open position.

4. Heavy Duty Band Clamp Horizontal (HDBH) Style (1200). Designed for heavy-duty use with horizontally oriented tanks, pressure vessels, and the like. This embodiment is illustrated in FIGS. 12-14 and generally incorporates a band-style clamping structure in its construction.

5. Through Bolt/Pin Style (2500). Designed for use with vertically oriented tanks, pressure vessels, and the like. This embodiment is illustrated in FIGS. 25-32 and generally incorporates an aligning fastening structure in its construction.

These various embodiments will now be discussed in detail.

MDUV Exemplary Embodiment

General Structure

Referring to FIG. 2, the general structure of the Medium Duty U-Bolt Vertical (MDUV) exemplary embodiment (200) comprises a channel member (201) that secures a U-shaped retaining member (202) (which may be partially or fully threaded) via the use of nuts (205) or other fastening devices forming a capture opening or clamping aperture (223). In conjunction with the channel member (201), there may be optionally one or more additional jaw appendages (209) to facilitate clamping onto manways and other circular and/or rectangular structures.

This structure (201, 202, 205, 209) provides the basis on which the swingarm (203) is supported. The swingarm (203) supports a lifting member (204) having a fastening means (204). The swingarm (203) contains a collar/stop (207) that rotates and rests upon a retaining sleeve (208) that is secured to the channel member (201).

The general embodiment of FIG. 2 may be enhanced (200) as illustrated in FIG. 2 to support attachment to a variety of different types of stationary equipment by drilling the channel member (201) with additional holes (216) for use by additional U-shaped retaining member(s) (212).

One skilled in the art will recognize that this technique may be applied to any of the embodiments presented herein to achieve a better fit to the stationary equipment to which the present invention is attached.

Application

Figure 4:
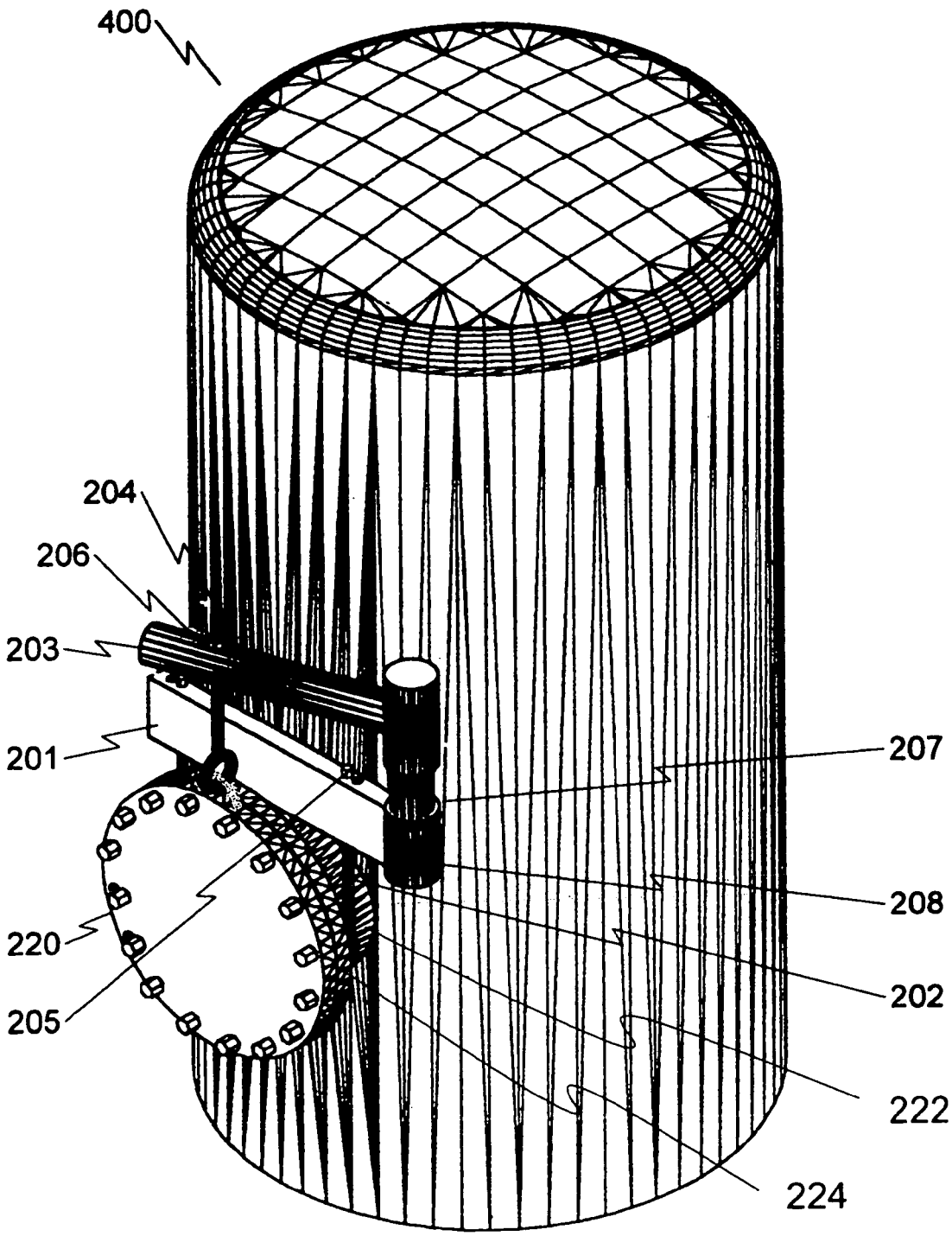
FIG. 4 illustrates an exemplary MDUV-style embodiment the present invention installed on a tank or pressure vessel on which is located a horizontal manway having said manway cover in the closed position.

A typical application of the MDUV-style embodiment is illustrated (400) in FIG. 4. As is generally illustrated in FIG. 4, a vertical tank or pressure vessel containing a horizontal manway will have a manway cover (220). To gain access to the interior of the tank it is necessary to remove the manway cover. The present invention facilitates removal of the manway cover as follows:

1. The threaded U-bolt (202) is placed around the horizontal nozzle extension (222) of the manway behind the cover flange (224). The fixture with sleeve assembly (201) is placed on the U-bolt (202). Two nuts (205) are installed to hold the channel member (201) and U-bolt (202) together and to provide the support for the swingarm (203).

2. The swingarm (203) is inserted into the sleeve (208) that is an integral part of the channel member (201).

3. The swingarm assembly is rotated within the sleeve such that the lifting rod (204) is positioned vertically over the manway cover that is to be removed.

4. The nuts on the manway and/or bolts or studs holding the manway cover (220) are loosened enough to allow the manway cover to be separated from the tank/pressure vessel-mating flange.

5. One or two of the bolts or studs are completely removed from the manway cover and are replaced with a hook, sling, shackle, clevis or other suitable attachment device/means. Any suitably strong attachment means will suffice in this application.

6. The lifting rod (204) is lowered into position by unscrewing (turning counterclockwise) the fastening means (206) (nut, etc.).

7. The lifting rod (204) is connected to the hook, sling, shackle, clevis or other suitable device that has replaced one or two of the bolts or studs removed from the manway cover (220).

8. The manway cover is then lifted by turning/engaging the lifting rod fastening means (206). The manway cover (220) has now been lifted and is supported by the swingarm (203).

9. The remaining nuts, bolts and/or studs are removed from manway cover (220).

10. The swingarm assembly (203) is now rotated in the retaining sleeve (208). The manway cover (220) moves with the swingarm (203) and is thereby removed from the tank and solely supported by the invention.

Figure 5:
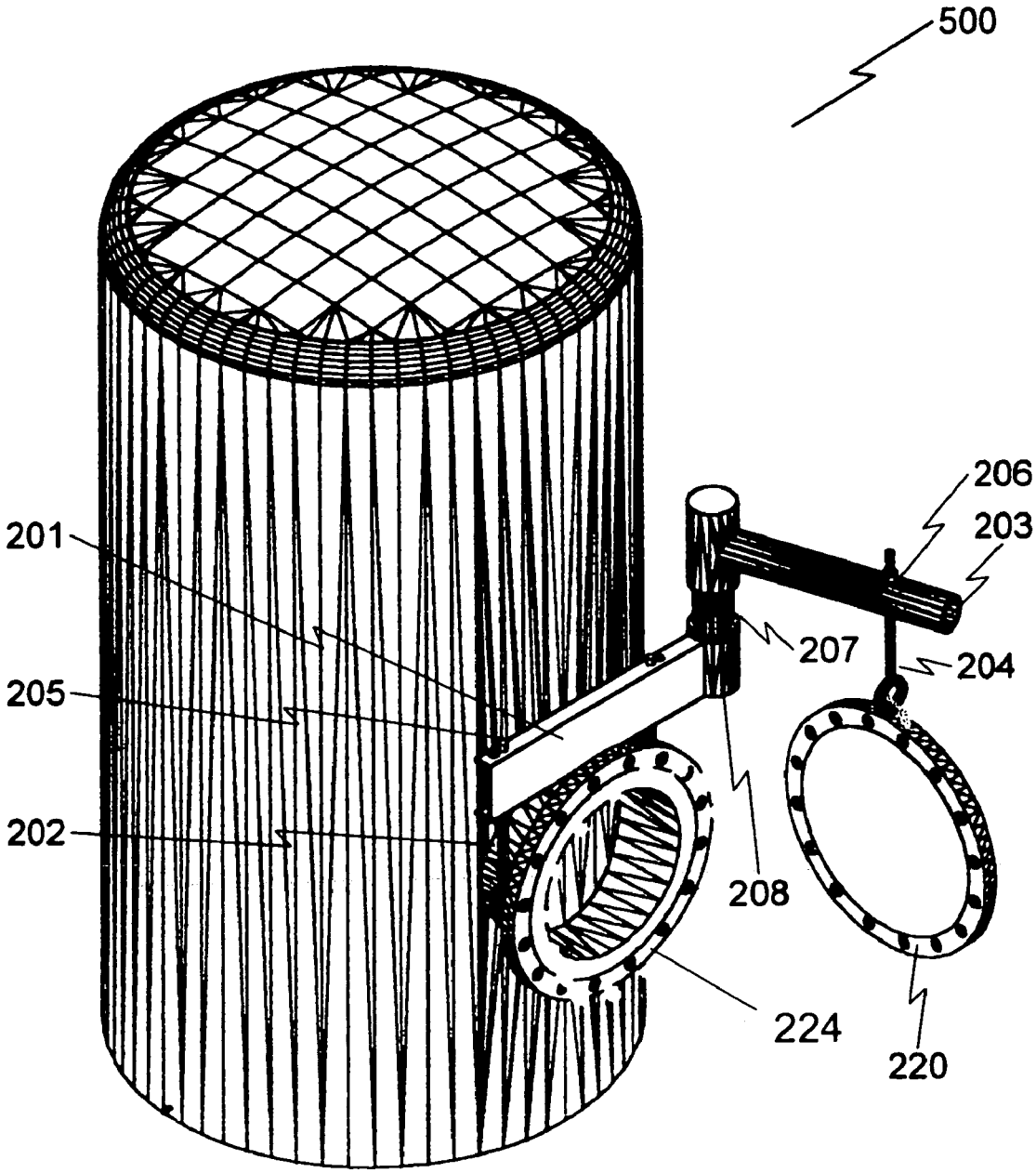
FIG. 5 illustrates an exemplary MDUV-style embodiment of the present invention installed on a tank or pressure vessel on which is located a horizontal manway having said manway cover in the retracted position.

The before/after status of the manway cover is graphically illustrated by comparing FIG. 4 (manway cover attached) and FIG. 5 (manway cover removed).

HDCV Exemplary Embodiment

General Structure

Referring to FIG. 6, the general structure of the Heavy Duty Tie Rod Clamp Vertical (HDCV) exemplary embodiment (600) comprises channel members (601, 611) that secure one or more retaining members (605, 615) (which may be partially or fully threaded) via the use of nuts (606) or other fastening devices. In conjunction with the channel members (601, 611), there may be optionally one or more additional jaw appendages (609, 619) to facilitate clamping onto extension (622) and other circular and/or rectangular structures. With the exception of the extra channel member (611) and retaining member (615), the construction of the HDCV-style embodiment is very similar to that of the MDUV-style embodiment.

However, it should be noted that the incorporation of a second retaining sleeve member (608) in the construction of the HDCV-style embodiment permits the structure to support much heavier loads and much longer swingarm assemblies (602). This is because the torque moment generated by the swingarm is counterbalanced by the torque moment of the retaining sleeves (608) in this configuration. This general principle is applicable to any of the embodiments to which the teachings of the present invention applies.

Application

FIG. 7 illustrates how the HDCV-style invention embodiment may be installed on a tank or pressure vessel that contains a horizontal manway.

The invention facilitates removal of the manway cover in a similar manner as described above except that in lieu of a U-bolt, two additional (typically straight) rods (605, 615) and a channel member (611) are used. Description of the use of this embodiment is as follows:

1. The threaded straight support rods (605, 615) are installed on one of the channel members (601) with integral sleeve by using two nuts (606). This assembly, which is termed the upper assembly, is then placed around the horizontal nozzle extension of the manway. The second fixture with sleeve assembly that is termed the lower assembly (611) is placed on the upper assembly that consists of the two straight rods (605, 615) and the one channel member (601) that has just been assembled. Two nuts (606) are installed to hold the upper and lower assemblies together and to provide the support for the swingarm (602).

2. The swingarm (602) is inserted into the upper and lower retaining sleeves (608) that is an integral part of the channel members (601, 611).

3. The swingarm (602) is rotated within the sleeve such that the lifting rod (603) is positioned vertically over the manway cover that is to be removed.

4. The nuts on the manway bolts or studs holding the manway cover (620) are loosened enough to allow the manway cover (620) to be separated from its mating flange (621).

5. One or two of the bolts or studs are completely removed from the manway cover (620) and are replaced with a hook, sling, shackle, clevis or other suitable device. Any suitably strong attachment means will suffice in this application.

6. The lifting rod (603) is lowered into position by unscrewing (turning counterclockwise) the fastening means (604) (nut).

7. The lifting rod (603) is connected to the hook, sling, shackle, clevis or other suitable device that has replaced one or two of the bolts or studs removed from the manway cover.

8. The manway cover (620) is then lifted by turning/engaging the fastening means (604) (nut, etc.).

9. The manway cover (620) has now been lifted and is solely supported by the swingarm (602).

10. The remaining nuts, bolts, and/or studs are removed from manway cover.

11. The swingarm assembly (602) is now rotated within the retaining sleeves (608). The manway cover (620) moves with the swingarm assembly (602) and is thereby removed from the tank and is solely supported by the swingarm assembly (602).

The before/after status of the manway cover is graphically illustrated by comparing FIG. 7 (manway cover attached) and FIG. 8 (manway cover removed).

HDCH Exemplary Embodiment

General Structure

Referring to FIG. 9, the general structure of the Heavy Duty Tie Rod Clamp Horizontal (HDCH) exemplary embodiment (900) comprises channel members (901, 902) and other components similar to that of the HDCV embodiment. Here, however, one of the channel members (902) has been modified such that the swingarm (905) retaining sleeve (910) is oriented in a different direction than the MDUV-style and HDCV-style embodiments. This reorientation of the swingarm (905) retaining sleeve (910) permits the load supported by the invention embodiment to be in a different plane than the vertical-style embodiments, and thus the swingarm in this embodiment can be oriented in a different capture plane than in the MDUV/HDCV embodiments.

Application

FIG. 10 illustrates the HDCH-style invention embodiment (1000) installed on a tank or pressure vessel that contains a vertical manway extension (922). This invention embodiment facilitates removal of the movement object (manway cover (920), etc.) in a similar manner as previously described. Note that while straight rods are illustrated in FIGS. 9-11 as the retaining member, a band and a separate bolted on sleeve section may be used for this purpose as well. These variations are detailed in the following sections describing the HDBH embodiment.

Description of the HDCH-style embodiment use is identical to that of the HDCV-style embodiment with the exception that the orientation of the swingarm (905) is different in the HDCH-style embodiment. Additionally, the horizontal orientation of the capture plane in this embodiment permits the use of a sling (908) and other lug lifting means (909) to support the movement object.

A useful application of this is in situations where the movement object is lifted by use of rubber inserts (909) in which fasteners are screwed. The rubber inserts (909) are inserted into unplugged (unscrewed) holes in the movement object, and then the fasteners are inserted into the rubber inserts, creating a friction fit and thus permitting a lifting grip to be applied to the movement member.

As an exemplary application of the HDCH-style embodiment, FIG. 10 illustrates the use of this embodiment (1000) on a horizontal equipment fixture (tank, vessel, etc.). Here the movement object (920) (manway cover, etc.) is in the closed position and ready for removal. FIG. 11 illustrates the position of the movement object (920) after removal from the equipment fixture.

HDBH Exemplary Embodiment

General Structure

Referring to FIG. 12, the general structure of the Heavy Duty Band Clamp Horizontal (HDBH) exemplary embodiment (1200) comprises channel members (1201, 1211) and other components similar to that of the HDCH embodiment. Here, however, the channel members take the form of bands (1201, 1211) that wrap around and grip a stationary equipment support. Note that this particular embodiment is especially suitable for situations in which the retaining sleeve (1208) is in a perpendicular plane to the capture plane. Note, however, that this does not limit the scope of the present invention and it is possible to construct retaining sleeves in different orientations than depicted in FIG. 12.

Note that the embodiment illustrated in FIG. 12 may utilize one or more channel member fasteners (1221, 1222) as well as a retaining ring extension (1218) in order to affect the required stationary equipment support contact.

Application

FIG. 13 illustrates the HDBH-style invention embodiment (1300) installed on a tank or pressure vessel that contains a vertical manway extension (1230). This invention embodiment facilitates removal of the manway cover in a similar manner as previously described. Note that while straight rods are illustrated in FIGS. 6-11 as the retaining member, a band (1201, 1211) and a separate bolted on sleeve section (1218) may be used for this purpose as well. Description of the HDBH-style embodiment use is as follows:

1. The band (1201, 1211) in FIG. 13 is comprised of two mirror image halves.

2. The band (1201, 1211) is placed around the nozzle extension (1230) of the vessel. The retaining sleeve extension (1218) is placed between the two band halves (1301, 1311).

3. The two halves of the band (1301, 1311) are bolted (1221, 1222) together thereby creating one assembly that is termed the channel member assembly. This process also installs the channel member assembly on the nozzle extension of the stationary equipment support (vessel, manway trap, equipment nozzle, etc.).

4. The swingarm assembly (1202) is inserted into the channel member retainer sleeve assembly (1208) that has been installed on the stationary equipment support.

5. The swingarm assembly (1202) is rotated within the sleeve (1208) such that the lifting rod (1203) is over the movement object (1220) (manway cover, etc.).

6. The nuts on the manway bolts or studs, holding the movement object (1220) are loosened enough to allow the movement object (1220) to be separated from its equipment fixture (mating flange, etc.).

7. The lifting rod (1203) is lowered into position by unscrewing turning the fastener means (nut, etc.) (1204) counterclockwise.

8. A three-point sling/chain assembly (1231, 1232, 1233) with hooks (1241, 1242, 1243) at each end is wide variety of attachment means are available to perform this same function. The three point sling/chain assembly is only illustrated as a preferred method of implementing this function. For example rubber plugs (909) with friction-fit screw-in inserts may also be utilized as illustrated in FIG. 9.

9. The movement object (1220) is then lifted by turning the lifting fastener means (1204) clockwise.

10. The movement object (1220) has now been lifted and is supported by the swingarm assembly (1202).

11. The nuts, bolts, and/or studs are removed from movement object (1220).

12. The swingarm assembly (1202) is now rotated in the retaining sleeve (1208). The movement object (1220) moves with the swingarm assembly (1202) and is thereby removed from the equipment fixture and is supported by the swingarm assembly (1202).

The before/after status of the movement object (1220) is graphically illustrated by comparing FIG. 13 (1300) (manway cover attached) and FIG. 14 (1400) (manway cover removed).

Exemplary Anti-Rotation Safety Enhancement Embodiment

Overview

It should be recognized that the loads that the present invention is particularly suited to handling may be quite heavy, and as such may represent a significant safety hazard in the event of a mechanical failure. Specifically, it is envisioned that in some circumstances the torque requirements to ensure a secure equipment fixture may not be met by the operator of the present invention. To this end it is desirable to have a safety mechanism to handle this possibility.

In any of the exemplary embodiments described herein there exists the possibility that when the swingarm assembly (203) is loaded with the movement object and rotated away from the equipment fixture as illustrated in FIG. 5, that the channel member (201) may lose frictional contact and slip, causing the movement object (manway cover (220) in FIG. 5) to fall and possibly injure the operator. To alleviate this possibility the optional safety apparatus (1600) illustrated in FIG. 16 may be utilized.

Referencing FIG. 16, the safety apparatus (1600) comprises an additional safety lift mechanism (1652) that is bolted (1651) to the channel member (1601). Attached to the safety lift mechanism is a connecting sling/retainer (1653) that attaches to the equipment support (behind the manway cover in this illustration). This connecting point may be via a bolt, cap screw, or any other fastener device. This configuration, once implemented, prevents the channel member from rotating once the movement object (manway cover here) is moved away from the stationary equipment support when the swingarm is rotated.

Application

The specific application of this safety mechanism is described as follows:

1. A hole is provided at the end of the channel member (1601) and sleeve to receive the safety device.

2. The threaded side of the clevis bolt/retainer (1652) is inserted into the hole provided at the end of the channel member (1601) and sleeve to receive the safety device.

3. The fastener and washer (1651) is threaded on to the clevis bolt/retainer (1652).

4. The connecting member (1653) is attached between the clevis bolt/retainer (1652) and the stationary equipment fixture.

5. The safety device assembly is now installed.

Operation

The operation of the safety device (1600) is described in the METHOD section following.

Exemplary Method

Overview

The present invention has associated with it a variety of exemplary implementation methods that significantly reduce the ease of manipulation of movement devices/objects that must be moved/supported/lifted/etc. with respect to a stationary piece of equipment that the movement device/object is initially attached or will in time be attached. The following discussion illustrates several of the preferred exemplary methods associated with the present invention that generally teach these techniques.

Generic Method

Figure 17:
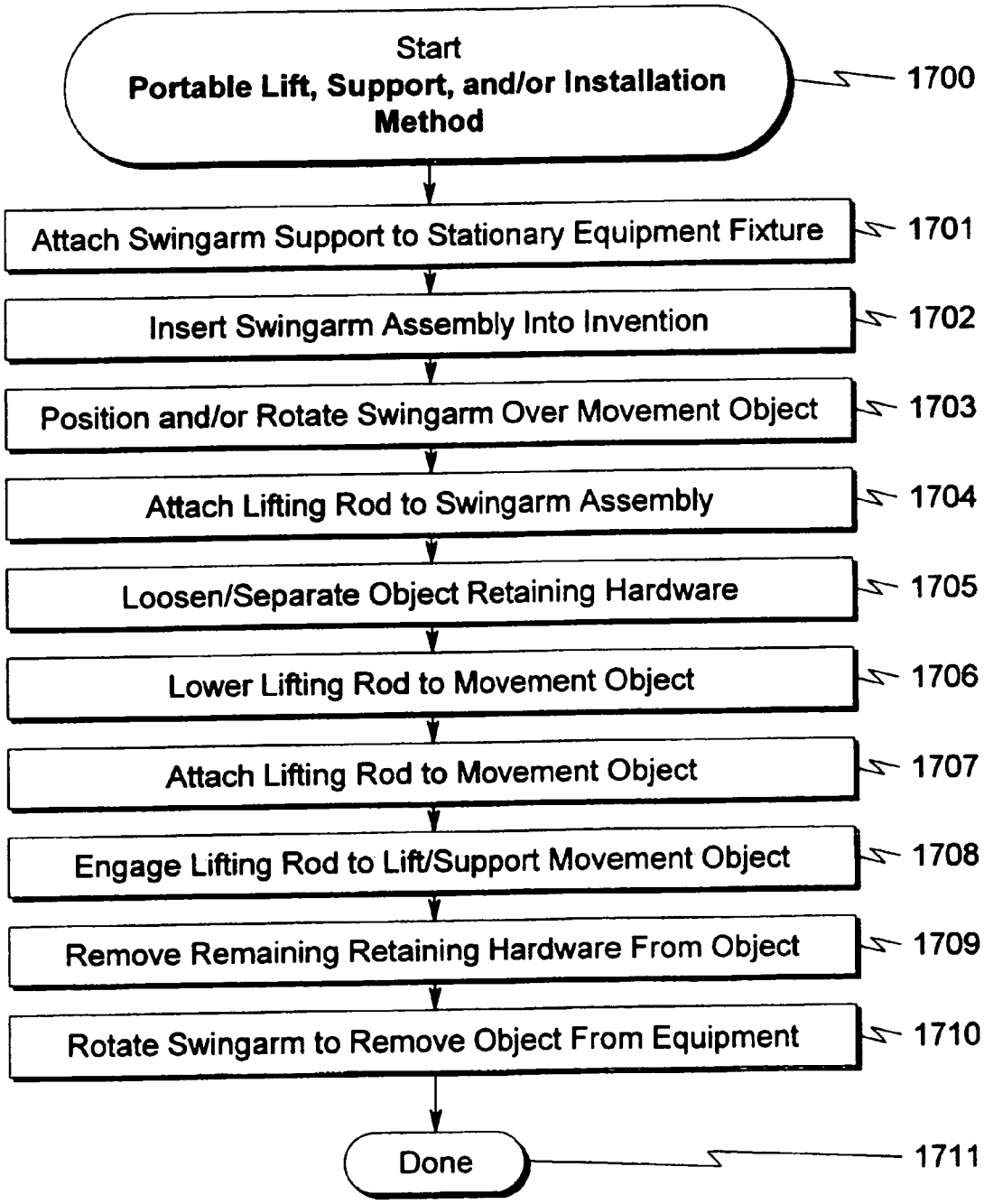
FIG. 17 illustrates exemplary general system process flowchart associated with the operation of the present invention.

Referencing FIG. 17, the general portable lift, support, and/or installation method (1700) generally comprises the following steps:

1. The process begins by attaching a swingarm support to a stationary equipment support (1701). This equipment support (e.g., manway portal, etc.) provides a stable lifting/supporting structure for subsequent manipulation of the movement object (e.g., manway cover, etc.).

2. The swingarm assembly is then inserted into the invention attached to the equipment fixture (1702).

3. The swingarm assembly is positioned (rotated) over the movement object (1703).

4. The lifting rod assembly is attached to the swingarm assembly (1704).

5. The connecting hardware retaining the movement object to the equipment fixture is loosened and the movement object is slightly separated from the equipment fixture (1705).

6. The lifting rod is lowered from the swingarm assembly to the movement object (1706).

7. The lifting rod is attached to the movement object (1707).

8. The lifting rod is engaged (tightened, rotated, etc. as necessary depending on its implementation) to lift and/or support the movement object (1708).

9. The remaining retaining hardware is removed from the movement object, thus freeing it from the equipment fixture (1709).

10. The swingarm assembly is rotated to remove the movement object from the equipment fixture, thus supporting/storing/etc. the movement object (1710).

One skilled in the art will quickly realize that this method may be order reversed to affect installation of the movement object to the equipment fixture.

It should also be noted that within the context of this process and other processes that the equipment support in step (1) need not be the same object as the equipment fixture mentioned in steps (5) and (10). Thus, it is possible to use the present invention method to support the present invention system from a first equipment support, only to remove a movement object from a second equipment fixture that is separate from the first equipment support. This observation leads to the conclusion that the equipment support and equipment fixture may be, but need not be, structurally connected.

MDUV-Style Method

Figure 18:
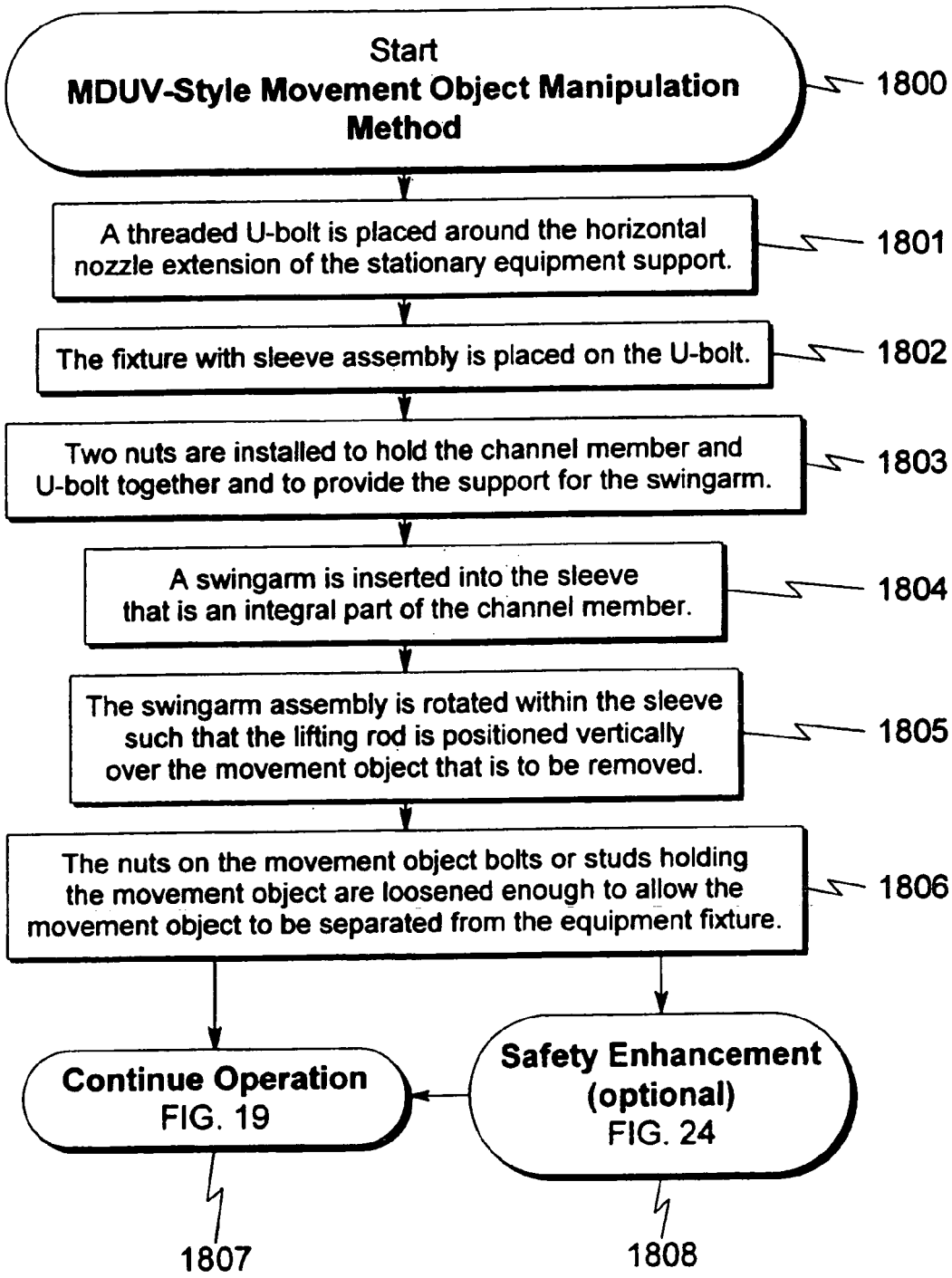
FIGS. 18-19 illustrate exemplary system process flowcharts associated with the operation of a MDUV-style embodiment of the present invention.
Figure 19:
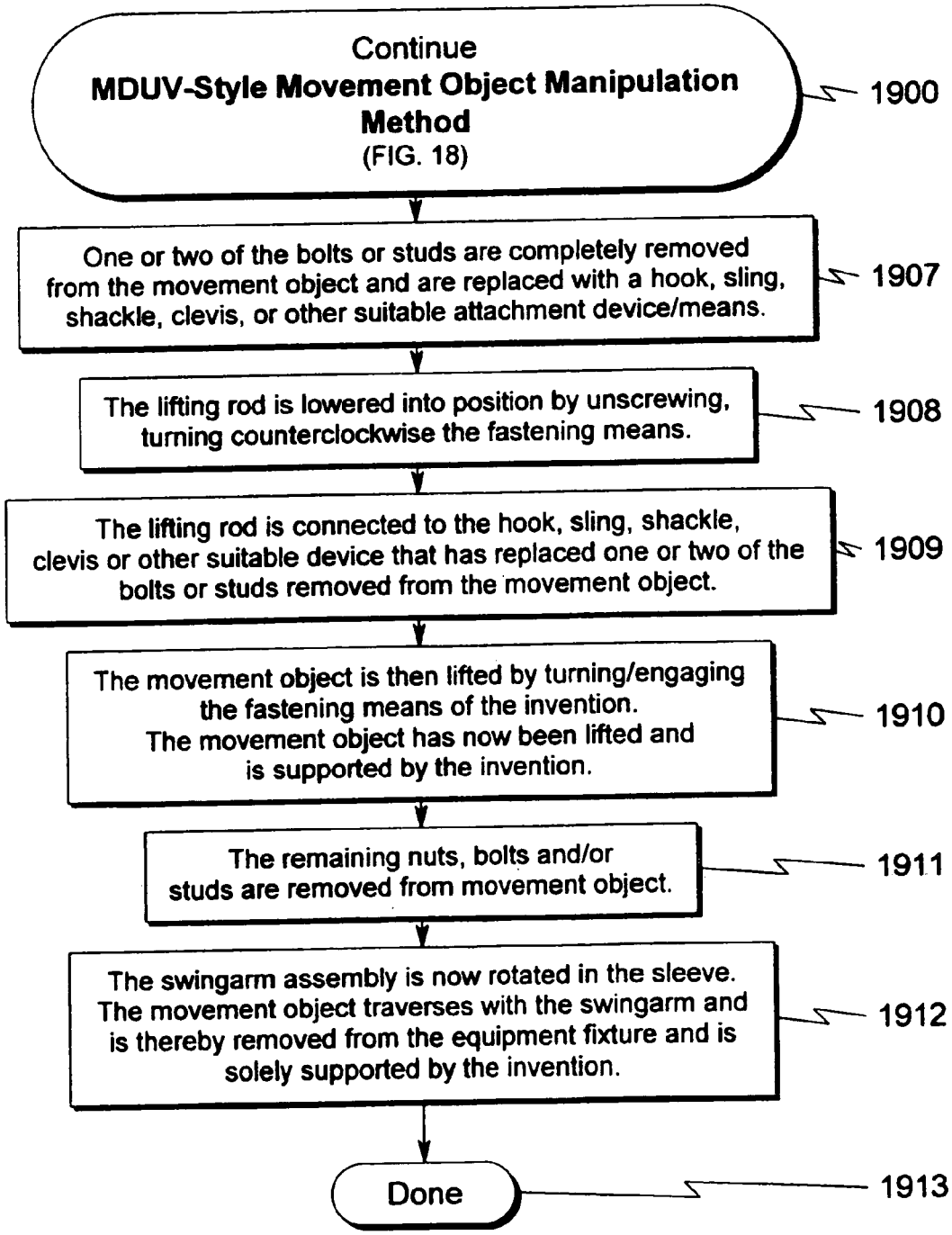

Referencing FIGS. 18-19, the MDUV-style portable lift, support, and/or installation method (1800, 1900) generally includes the following steps:

1. Referencing FIG. 18, a threaded U-bolt (202) is placed around the horizontal nozzle extension of the stationary equipment support (1801).

2. The fixture with sleeve assembly (201) is placed on the U-bolt (202) (1802).

3. Two nuts (205) are installed to hold the channel member (201) and U-bolt (202) together and to provide the support for the swingarm (203) (1803).

4. A swingarm (203) is inserted into the sleeve (208) that is an integral part of the channel member (201)(1804).

5. The swingarm assembly is rotated within the sleeve such that the lifting rod (204) is positioned vertically over the movement object that is to be removed (1805).

6. The nuts on the movement object bolts or studs holding the movement object are loosened enough to allow the movement object to be separated from the equipment fixture (1806).

7. Referencing FIG. 19, one or two of the bolts or studs are completely removed from the movement object and are replaced with a hook, sling, shackle, clevis, or other suitable attachment device/means (1907). Any suitably strong attachment means will suffice in this application.

8. The lifting rod (204) is lowered into position by unscrewing, turning counterclockwise the fastening means (206) (nut, etc.) (1908).

9. The lifting rod (204) is connected to the hook, sling, shackle, clevis or other suitable device that has replaced one or two of the bolts or studs removed from the movement object (1909).

10. The movement object is then lifted by turning/engaging the fastening means (206). The movement object has now been lifted and is supported by the invention (1910).

11. The remaining nuts, bolts and/or studs are removed from movement object (1911).

12. The swingarm assembly (203) is now rotated in the sleeve (208) (1912). The movement object traverses with the swingarm (203) and is thereby removed from the equipment fixture and is solely supported by the invention.

One skilled in the art will quickly realize that this method may be order reversed to affect installation of the movement object to the equipment fixture.

It should also be noted that within the context of this process and other processes that the equipment support in step (1) need not be the same object as the equipment fixture mentioned in steps (6) and (12). Thus, it is possible to use the present invention method to support the present invention system from a first equipment support, only to remove a movement object from a second equipment fixture that is separate from the first equipment support. This observation leads to the conclusion that the equipment support and equipment fixture may be, but need not be, structurally connected.

HDCV-Style Method

Installation

Figure 20:
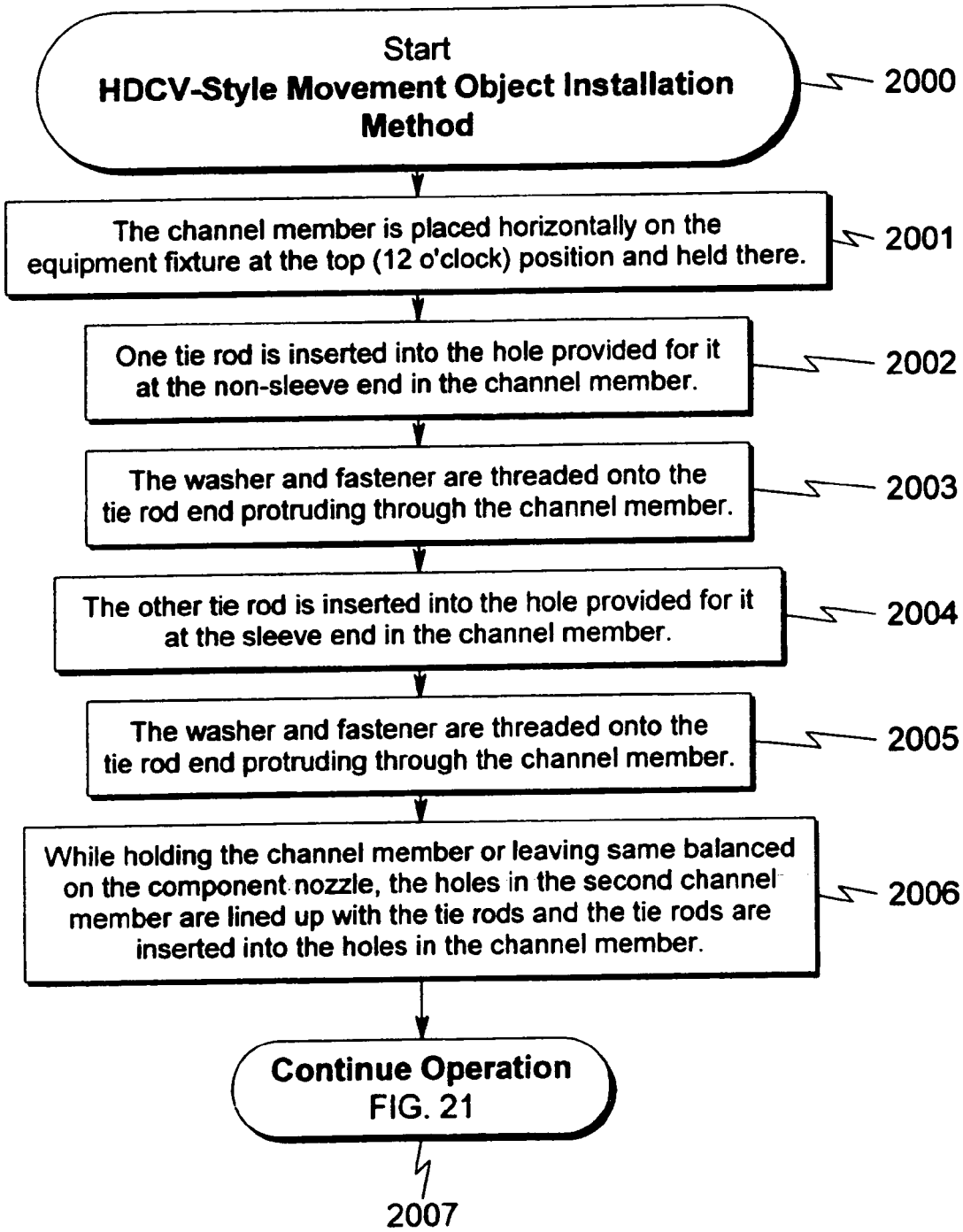
FIGS. 20-21 illustrate exemplary system process flowcharts associated with the installation of a HDCV-style embodiment of the present invention.
Figure 21:
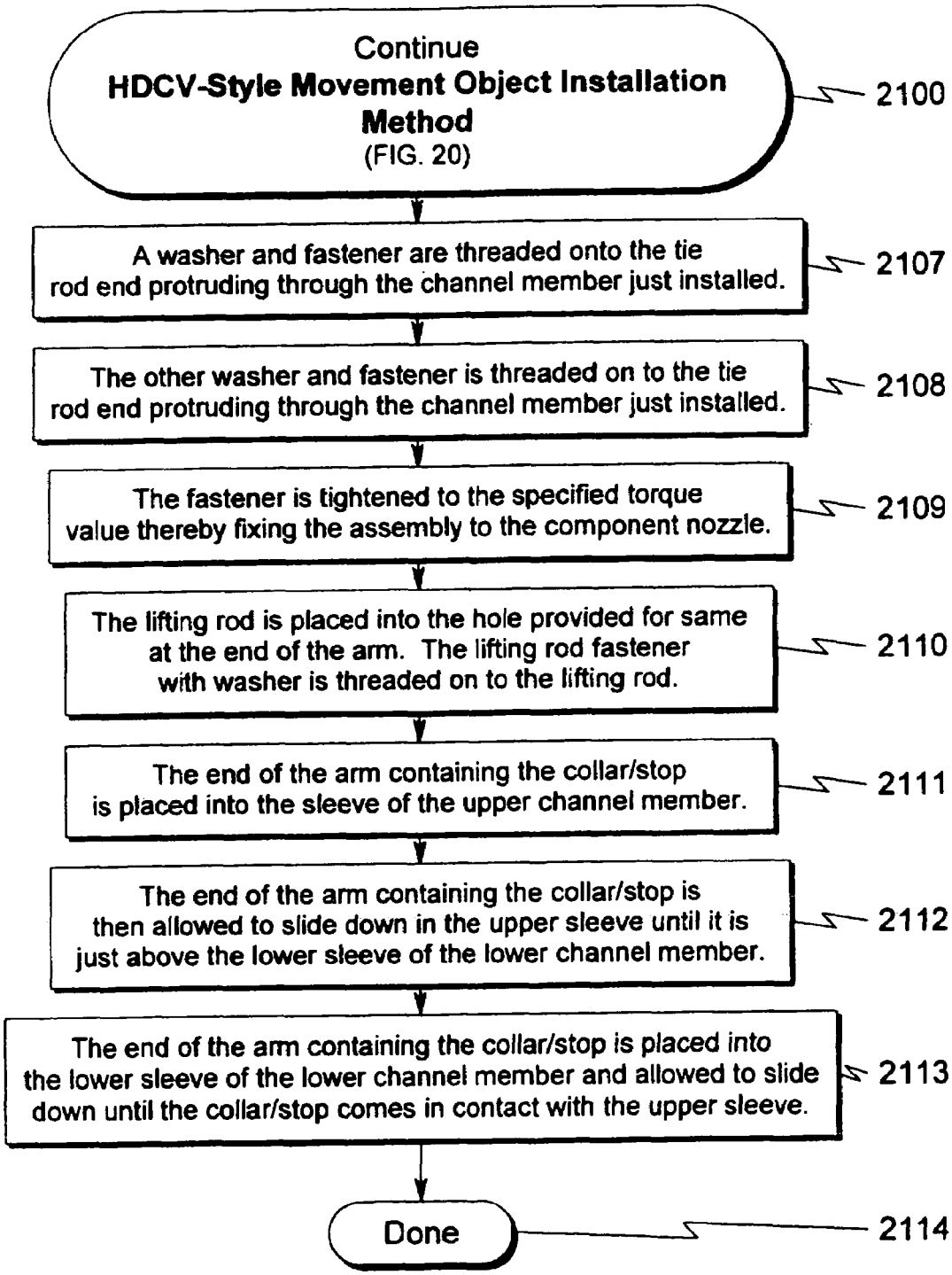

Referencing FIGS. 20-21, the HDCV-style portable lift, support, and/or installation method (2000, 2100) generally includes the following installation steps:

1. Referencing FIG. 20, the channel member (601) is placed horizontally on the component nozzle at the top (12 o'clock) position and held there (2001).

2. One tie rod (605) is inserted into the hole provided for it, at the non-sleeve end, in the channel member (601) (2002).

3. The washer and fastener (606) are threaded onto the tie rod end protruding through the channel member (601)(2003).

4. The other tie rod (605) is inserted into the hole provided for it, at the sleeve end, in the channel member (601) (2004).

5. The washer and fastener (606) are threaded onto the tie rod end protruding through the channel member (601) (2005).

6. While holding the channel member (601) or leaving same balanced on the component nozzle, the holes in the second channel member (601) are lined up with the tie rods and the tie rods are inserted into the holes in the channel member (601) (2006). At this point the procedure may continue (2007) or the optional safety enhancement procedure (2400) detailed in FIG. 24 may be invoked (2008).

7. Referencing FIG. 21, a washer and fastener (606) are threaded onto the tie rod end protruding through the channel member (601) just installed (2107).

8. The other washer and fastener (606) is threaded onto the tie rod end protruding through the channel member (601) just installed (2108).

9. The fastener (606) is tightened to the specified torque value thereby fixing the assembly to the component nozzle (2109).

10. The lifting rod (603) is placed into the hole provided for same at the end of the swingarm (602). The lifting rod fastener with washer (604) is threaded onto the lifting rod (2110).

11. The end of the swingarm (602) containing the collar/stop (607) is placed into the sleeve (608) of the upper channel member (601) (2111).

12. The end of the swingarm (602) containing the collar/stop (607) is then allowed to slide down in the upper sleeve (608) until it is just above the lower sleeve (608) of the lower channel member (611) (2112).

13. The end of the swingarm (602) containing the collar/stop (607) is placed into the lower sleeve (608) of the lower channel member (611) and allowed to slide down until the collar/stop (607) comes in contact with the upper sleeve (608) of the upper channel member (601) (2113).

The unit is now installed on the component nozzle and ready for operation. These steps may be order reversed to affect de-installation of the movement object manipulation system from the stationary equipment support.

Operation

Figure 22:
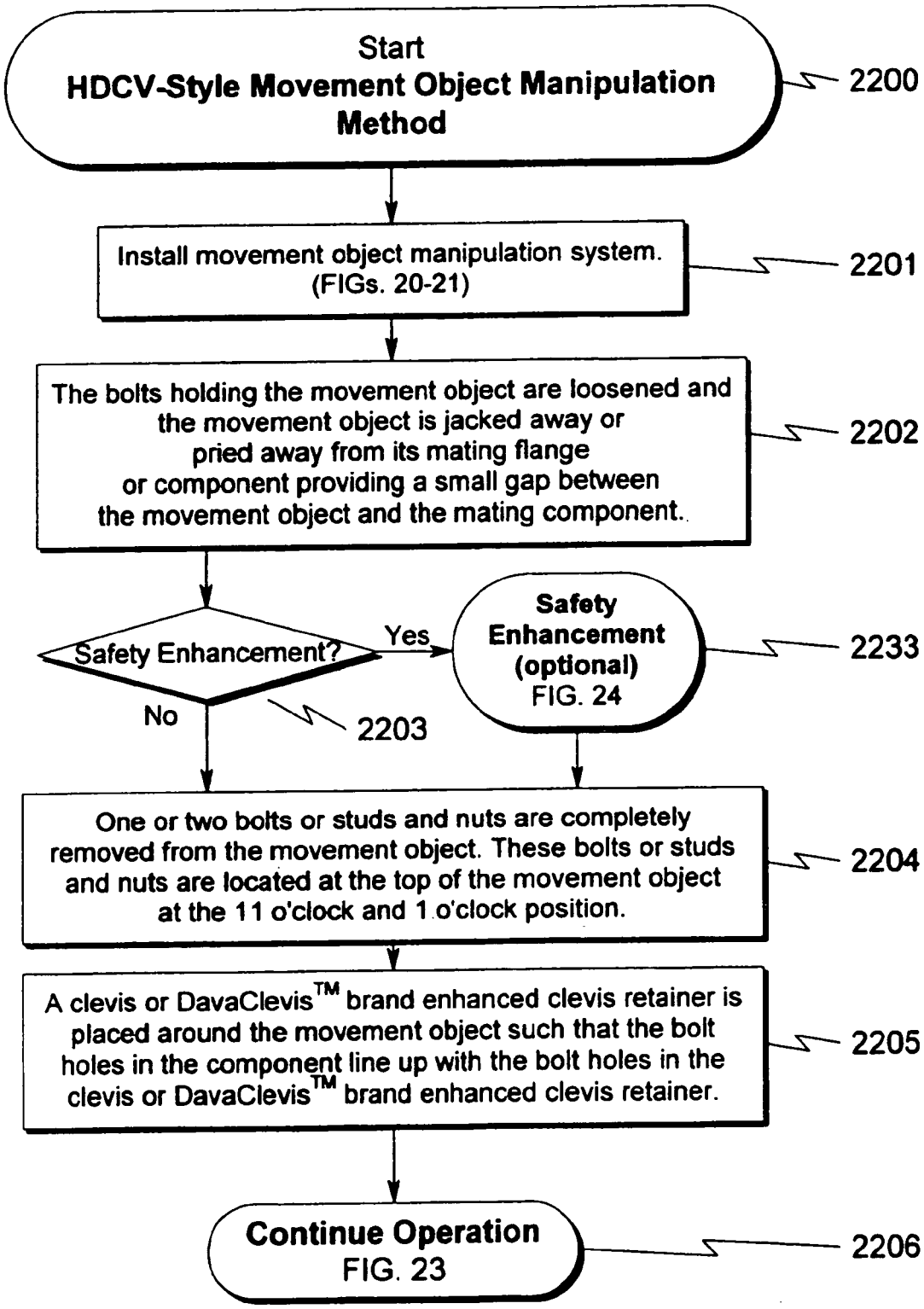
FIGS. 22-23 illustrate exemplary system process flowcharts associated with the operation of a HDCV-style embodiment of the present invention.
Figure 23:
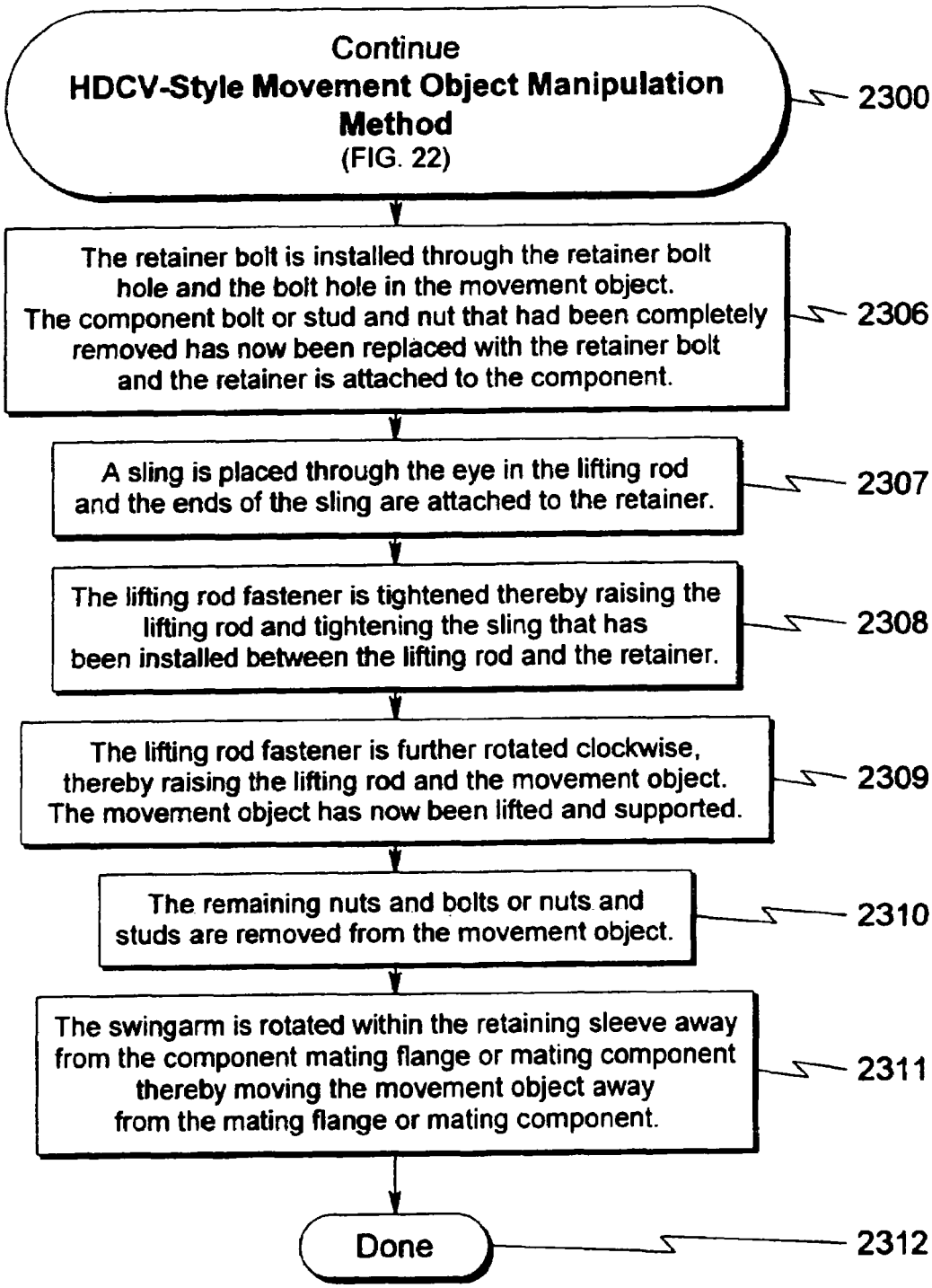

An exemplary method (2200, 2300) of the present invention utilizing the HDCV-style embodiment is illustrated in FIGS. 22-23 and is detailed as follows:

1. Referencing FIG. 22, the first step is to install a movement object manipulation system on a stationary equipment support (2201). An exemplary embodiment of this procedure is described in detail in FIGS. 20-21 (2000, 2100).

2. The bolts holding the movement object are loosened and the movement object is jacked away or pried away from its equipment fixture (mating flange, component, etc.) providing a small gap between the movement object and the mating component (2202).

3. At this point (or equivalently any other step in the procedure) the optional safety enhancement procedure (2233) detailed in FIG. 24 (2400) may be invoked (2203).

4. Two bolts or studs and nuts are completely removed from the movement object. These bolts or studs and nuts are located at the top of the movement object at the 11 o'clock and 1 o'clock position (2204).

5. A clevis or DavaClevis™ brand enhanced clevis retainer (1654) is placed around the movement object such that the bolt holes in the component line up with the bolt holes in the clevis or DavaClevis™ brand enhanced clevis retainer (1654) (2205).

6. Referencing FIG. 23, the clevis or DavaClevis™ brand enhanced clevis retainer bolt is installed through the clevis or DavaClevis™ brand enhanced clevis retainer bolt hole and the bolt hole in the movement object (2306). The component bolt or stud and nut that had been completely removed has now been replaced with the clevis or DavaClevis™ brand enhanced clevis retainer bolt and the clevis or DavaClevis™ brand enhanced clevis retainer is attached to the movement object.

7. A sling is placed through the eye in the lifting rod (603) and the ends of the sling are attached to the clevis or DavaClevis™ brand enhanced clevis retainer (2307).

8. The lifting rod fastener (604) is rotated clockwise (tightening) thereby raising the lifting rod (603) and tightening the sling that has been installed between the lifting rod (603) and the clevis or DavaClevis™ brand enhanced clevis retainer (1654) (2308).

9. The lifting rod fastener (604) is further rotated clockwise, thereby raising the lifting rod (603) and the movement object. The movement object has now been lifted and is supported by the invention (2309).

10. The remaining nuts and bolts or nuts and studs are removed from the movement object (2310).

11. The swingarm (602) is rotated within the retaining sleeve (608) away from the equipment fixture (component mating flange, mating component, etc.) thereby moving the movement object away from the equipment fixture (2311). This has removed the movement object from the equipment fixture and has provided access to the equipment fixture. At this time the movement object is also stored by the invention. There is no need to find a lay down area for the movement object or other location in which to place the movement object. The invention has now lifted, removed and is storing the movement object.

12. Reinstallation is the reverse of the above process. The first step in the reinstallation operation is to rotate the swingarm (602) within the retaining sleeve (608) toward from the component mating flange or mating component there by moving the movement object toward the mating flange or mating component. This locates the movement object close to the mating flange or mating component.

13. The bolts that hold the movement object are reinserted and the movement object is moved toward its mating flange or component by tightening the nuts and bolts. A small gap between the movement object and the mating component is still maintained at this time.

14. The lifting rod fastener (604) is rotated counterclockwise, thereby lowering the lifting rod (603) and the component to be reinstalled. The component to be reinstalled is now supported by the bolts and nuts or studs and nuts. The lifting rod fastener (604) is further rotated counterclockwise (loosening) thereby lowering the lifting rod (603) and loosening the sling that has been installed between the lifting rod (603) and the clevis or DavaClevis™ brand enhanced clevis retainer (1654).

15. The sling is removed from the eye in the lifting rod (603) and the ends of the sling are removed from the clevis or DavaClevis™ brand enhanced clevis retainer.

16. The clevis or DavaClevis™ brand enhanced clevis retainer bolt is removed from the clevis or DavaClevis™ brand enhanced clevis retainer bolt hole and the bolt hole in the movement object. The clevis or DavaClevis™ brand enhanced clevis retainer (1654) is removed from around the movement object.

17. The two bolts or studs and nuts that were completely removed from the movement object, at the 11 o'clock and 1 o'clock position are reinstalled.

18. The bolts originally holding the movement object are tightened and the movement object is drawn close to its mating flange or mating component and secured. The movement object has now been reinstalled.

One skilled in the art will quickly realize that this method may be order reversed to affect installation of the movement object to the equipment fixture.

It should also be noted that within the context of this process and other processes that the equipment support in step (1) need not be the same object as the equipment fixture mentioned in steps (2) and (11). Thus, it is possible to use the present invention method to support the present invention system from a first equipment support, only to remove a movement object from a second equipment fixture that is separate from the first equipment support. This observation leads to the conclusion that the equipment support and equipment fixture may be, but need not be, structurally connected.

Safety Enhancement Method

Figure 24:
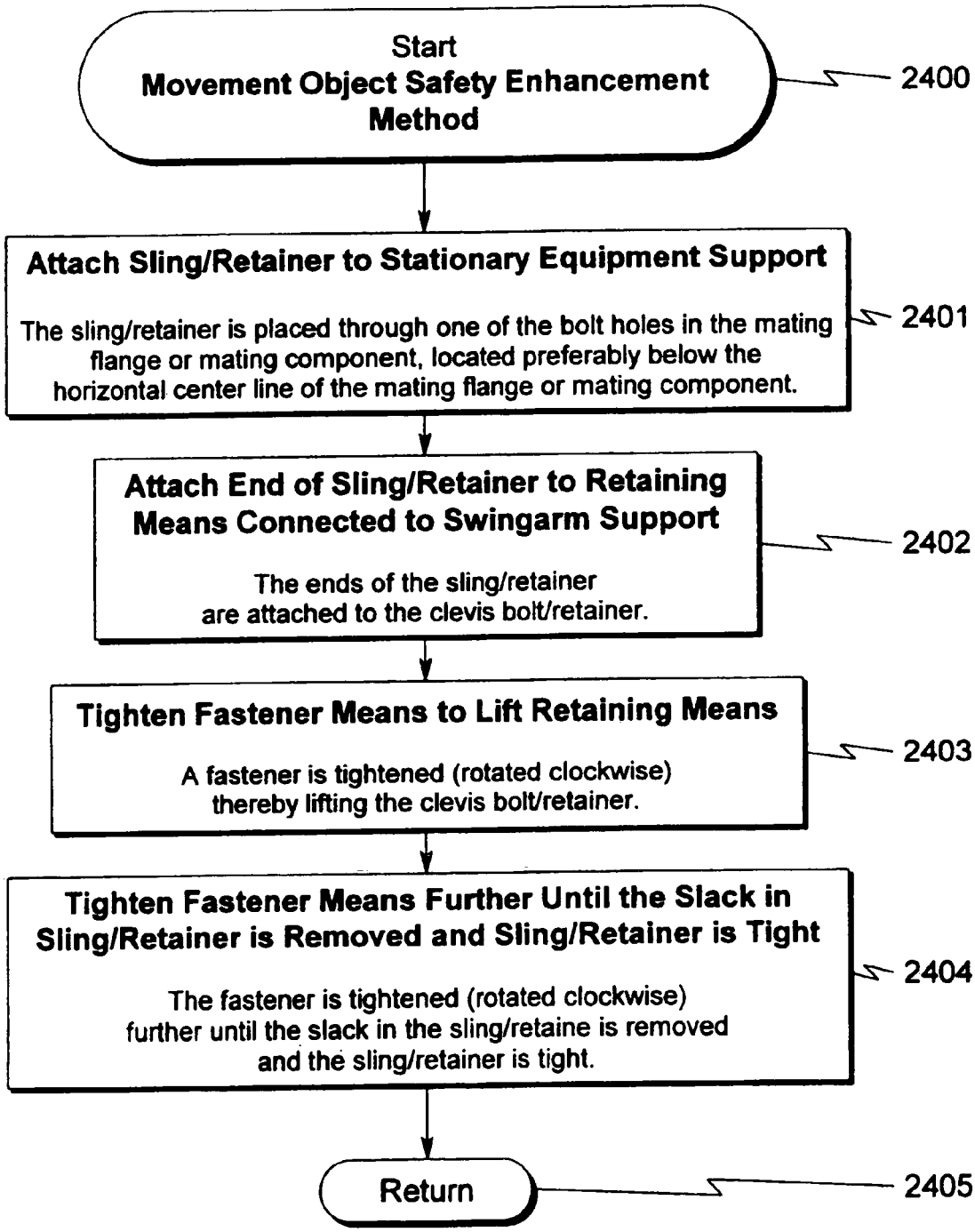
FIG. 24 illustrates an exemplary safety enhancement procedure that may be utilized with various embodiments of the present invention.

The optional safety device (1600) illustrated in FIG. 16 may be operated using an optional safety enhancement method. Typically after the remaining nuts and bolts or nuts and studs of the movement object have been loosened as exemplified in steps (1806, 2203) the following procedure (1808, 2223, 2400) illustrated in FIG. 24 is utilized to operate the safety device:

1. The sling/retainer (1653) is placed through one of the bolt holes in the mating flange or mating component, located preferably below the horizontal center line of the mating flange or mating component (2401).

2. The ends of the sling/retainer, (1653) are attached to the clevis bolt/retainer (1652) (2402).

3. A fastener (1651) is tightened (rotated clockwise) thereby lifting the clevis bolt/retainer (1652) (2403).

4. The fastener (1651) is tightened (rotated clockwise) further until the slack in the sling/retainer (1653) is removed and the sling/retainer (1653) is tight (2404). As soon as the sling/retainer (1653) is tight the safety device is engaged (2405). While friction from the clamping force of the channel member and sleeve (210) and the U-bolt (202) is the main force preventing the assembly from rotating around the nozzle or mating equipment, as a result of the weight of the movement object the disclosed safety enhancement further prevents the assembly from rotating around the nozzle or mating equipment.

The disclosed safety enhancement provides a positive stop preventing the side of the channel member and sleeve (201) containing the safety enhancement from rising and the side containing the swingarm (203) from falling. The safety enhancement thus prevents the invention assembly from rotating around the nozzle or mating equipment.

Of course, one skilled in the art will recognize that while the disclosed safety enhancement procedure may be performed optimally after the movement object has been loosened from its mounting fixture, the steps may occur at any point in any operational method using the present invention system.

Lifting Lug Not Required

Overview

The installation and operation procedures described above do not require that the movement object be fitted with a lifting lug and/or lifting device. This is one of the additional advantages of the present invention. Should the movement object be fitted with or have a lifting lug or other lifting device attached to it the present invention may be used and is viable as shown. An example of this is illustrated in FIG. 16.

However, if the movement object does not have such lifting support attachments, the operating procedure under these circumstances would be modified to include attachment of clevises and/or a DavaClevis™ brand enhanced clevis retainer to the lifting lug or other fixed lifting device. The figures included (c.f. FIGS. 4/5/7/8/10/11 with FIGS. 12/14/15/16) illustrate that the present invention may be utilized either with lifting lugs and/or other lifting devices attached to the movement object. As the operating procedures indicate these lifting lugs/devices are not necessary for operation of the present invention.

DavaClevis™ Brand Enhanced Clevis Retainer

As mentioned in the previous paragraph, clevises and/or a DavaClevis™ brand enhanced clevis retainer to the lifting lug or other fixed lifting device. The DavaClevis™ brand enhanced clevis retainer as illustrated in FIG. 15 (1500) is a special variant of existing clevis retainers that addresses a variety of issues associated with lifting/supporting heavy/thick movement objects such as manway covers and the like.

Since these types of movement objects may have thickness of six (6) inches and weigh in excess of 2000 pounds, conventional clevises do not generally have the necessary jaw width size to support such loads.

Referencing FIG. 15, the DavaClevis™ brand enhanced clevis retainer (1500) as shown in the various views (1501, 1502) is essentially a C-shaped or U-shaped metal retainer (1501, 1502) having two coincidentally drilled holes (one on each side of the U-formation) (1513) in which a cap screw or other fastener is inserted and tightened (1514). One of the drilled holes is tapped to accommodate the cap screw or other fastener (1512). The retainer (1500) is generally supported by a nut or other fastener (1511) that captures a cap screw or other fastener through a hole (1515) at the top of the U-shaped member.

It should be noted that one or more of the nuts (1511, 1512) illustrated in the construction may be dispensed with by tapping the corresponding bolt hole (1513, 1515) in whole or in part to permit fixation of a cap screw or bolt. Additionally, while the construction of the structure as illustrated in FIG. 15 is that of a C-shaped member, many embodiments are more easily constructed with better load bearing performance if fabricated using a C-shaped construction where the support hole (1515) is at the apex of the semicircle and the radius of curvature generally extends the length of the retaining bolt travel length (1514).

One skilled in the art will quickly realize the advantages of these two modifications on the basic construction methodology.

Generally the construction of this device is composed of carbon steel, but any suitably strong material consistent with the weight of the movement object is acceptable. Cotter pins and/or other conventional safety interlocks may be incorporated into this structure for additional safety if desired. As indicated in FIG. 16, more than one DavaClevis™ brand enhanced clevis retainer may be utilized to accommodate especially heavy movement object loads.

The DavaClevis™ brand enhanced clevis retainer has been specifically mentioned here because actual reduction to practice of various embodiments of the present invention revealed that clevises that could accommodate wide/heavy loads and which were suitable for use with manway covers and the like were not commonly available on a commercial basis.

Through Bolt/Pin Style Design

FIGS. 25-32 describe a removable cover support without the lifting mechanism and/or all or part of the swingarm assembly for clarity in describing the cover flange securing base assembly. The lifting mechanism and swingarm assembly can be configured in the various ways described above in FIGS. 2-24.

Figure 25A:
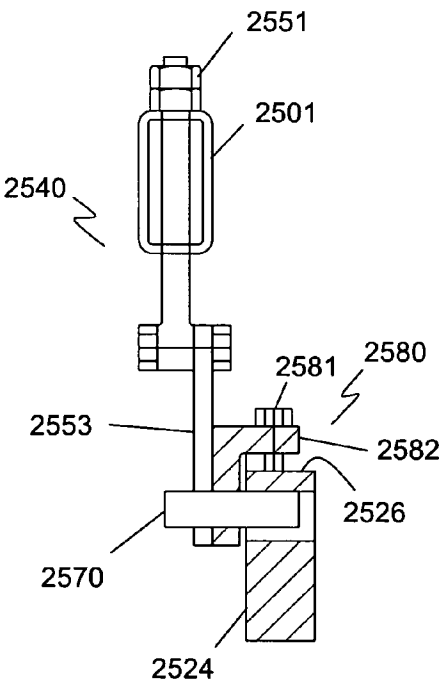
FIG. 25*a* illustrates a side view of the bolt/pin type securing mechanism of the embodiment in FIG. 25.
Figure 25:
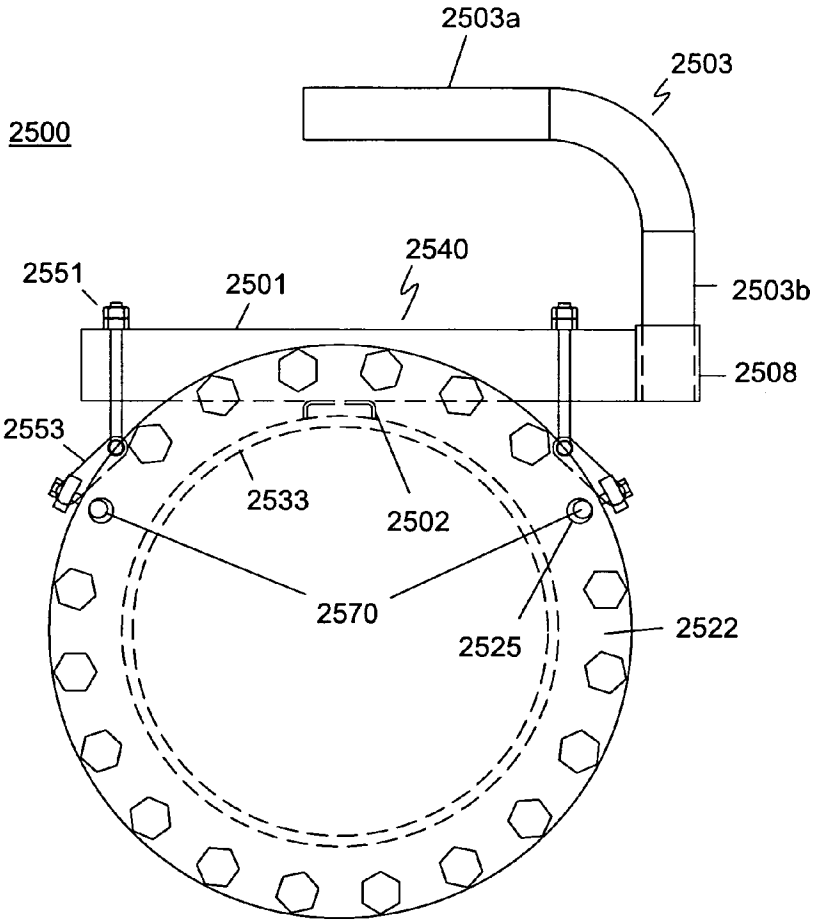
FIG. 25 illustrates a front view of another embodiment of the present invention showing the use of a bolt/pin type securing mechanism where a cover bolt or other pin is inserted into a cover flange hole to secure the present invention to the equipment with the cover.

FIG. 25 illustrates a front view of a removable cover support system 2500 of the present invention with a cover 2522 attached to a cover flange (not shown) with two of the cover bolts removed. Removable cover support system 2500 includes a securing base assembly 2540, a swingarm assembly 2503 having a swingarm 2503*a* and a swingarm post 2503*b*, and a retainer sleeve 2508. Securing base assembly 2540 has a base member 2501 which in the current embodiment is a channel member. Base member 2501 rests upon cover support extension 2533 of a manway or other circular and/or rectangular structure. Base member 2501 may optionally have one or more jaw appendages 2502 to facilitate clamping onto cover support extension 2533. Bolt 2551 is attached to or through base member 2501. A securing mechanism linkage 2553 is attached to bolt 2551 on one end and a securing mechanism 2570 on the other end. Securing mechanism 2570 is inserted through cover flange hole 2525.

FIG. 25*a* is a side view of securing mechanism linkage 2553 and securing mechanism 2570 with optional set screw assembly 2580. Bolt 2551 is shown inserted through base member 2501 and connected to securing mechanism linkage 2553. The other end of securing mechanism linkage 2553 is attached to securing mechanism 2570. Securing mechanism 2570 is shown inserted through cover flange hole 2525. Optionally, set screw assembly 2580 can be used. Set screw assembly 2580 has a set screw 2581 and a set screw support 2582. Set screw support 2582 can be an L-shaped bracket or other angled member in which one end can receive securing mechanism 2570 and the other can receive set screw 2581. Set screw 2581 is threaded through set screw support 2582 until the end meets peripheral edge 2526 of cover flange 2524. It should be understood by one of ordinary skill in the art that securing mechanism linkage 2553 can be any material, size, or configuration that can connect base member 2501 to securing mechanism 2570. It should also be understood by one of ordinary skill in the art that a variety of bolts/pins can be used to secure the present invention to the cover flange. For example, securing mechanism 2570 can be a bolt or pin such as the existing studs or bolts from the cover and cover flange assembly, a close fit pin, a special bolt/pin with an interference fit at the flange hole, a bolt with threads for the nuts, a tapered pin, a bolt/pin that is eccentric or concentric to the hole in the cover flange and could be a loose or tight fit to the hole.

Figure 25B:
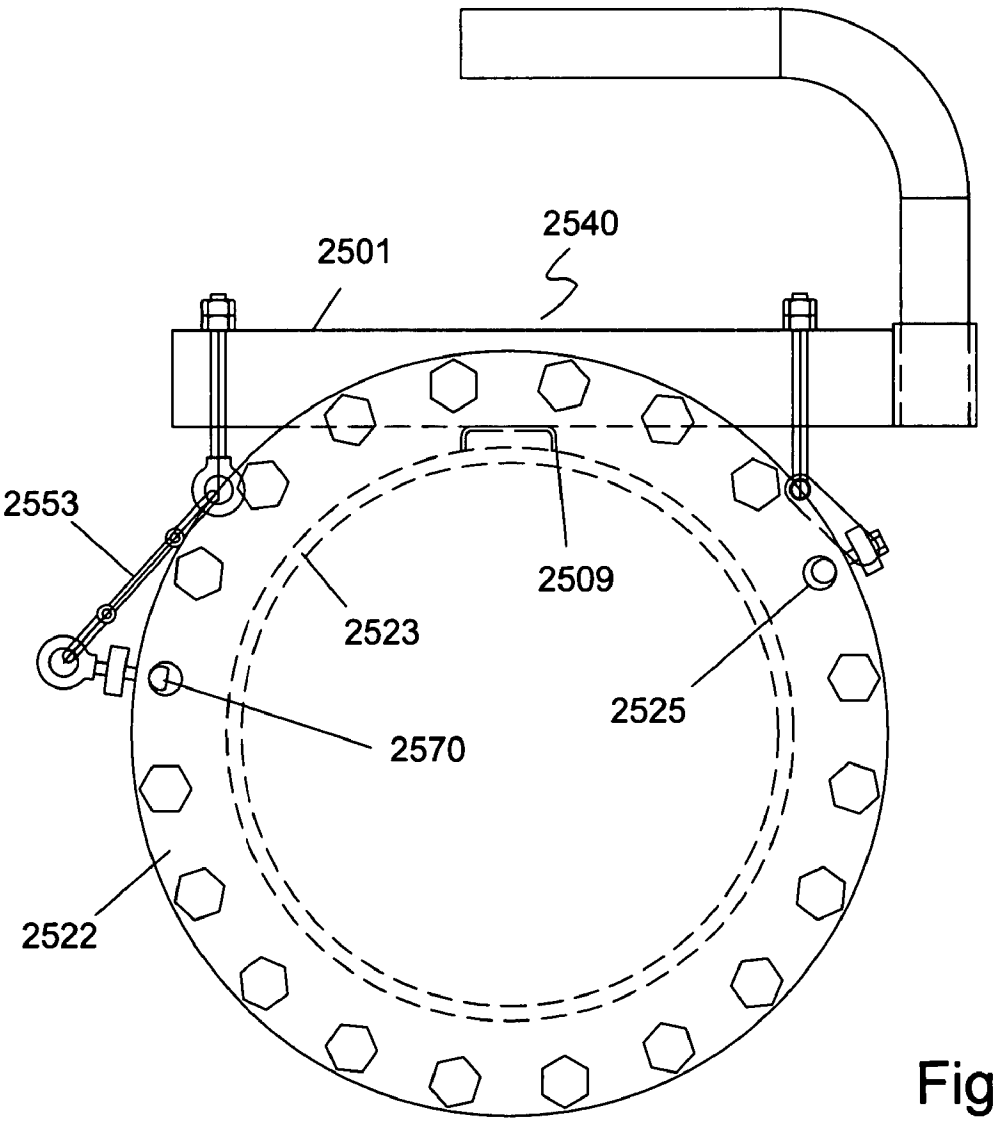
FIG. 25*b* illustrates a front view of another variation of the bolt/pin type securing mechanism of the embodiment in FIG. 25.

FIG. 25*b* shows a front view of an alternative embodiment of the securing mechanism 2553 linkage. In this embodiment, securing mechanism linkage 2553 is connected to bolt 2551 on one end and securing mechanism 2570 on the other end. Securing mechanism linkage 2553 is this embodiment is a flexible member such as a cord, cable and the like with appropriate connecting members on each end connected to bolt 2551 and securing mechanism 2570, respectively.

Figure 26:
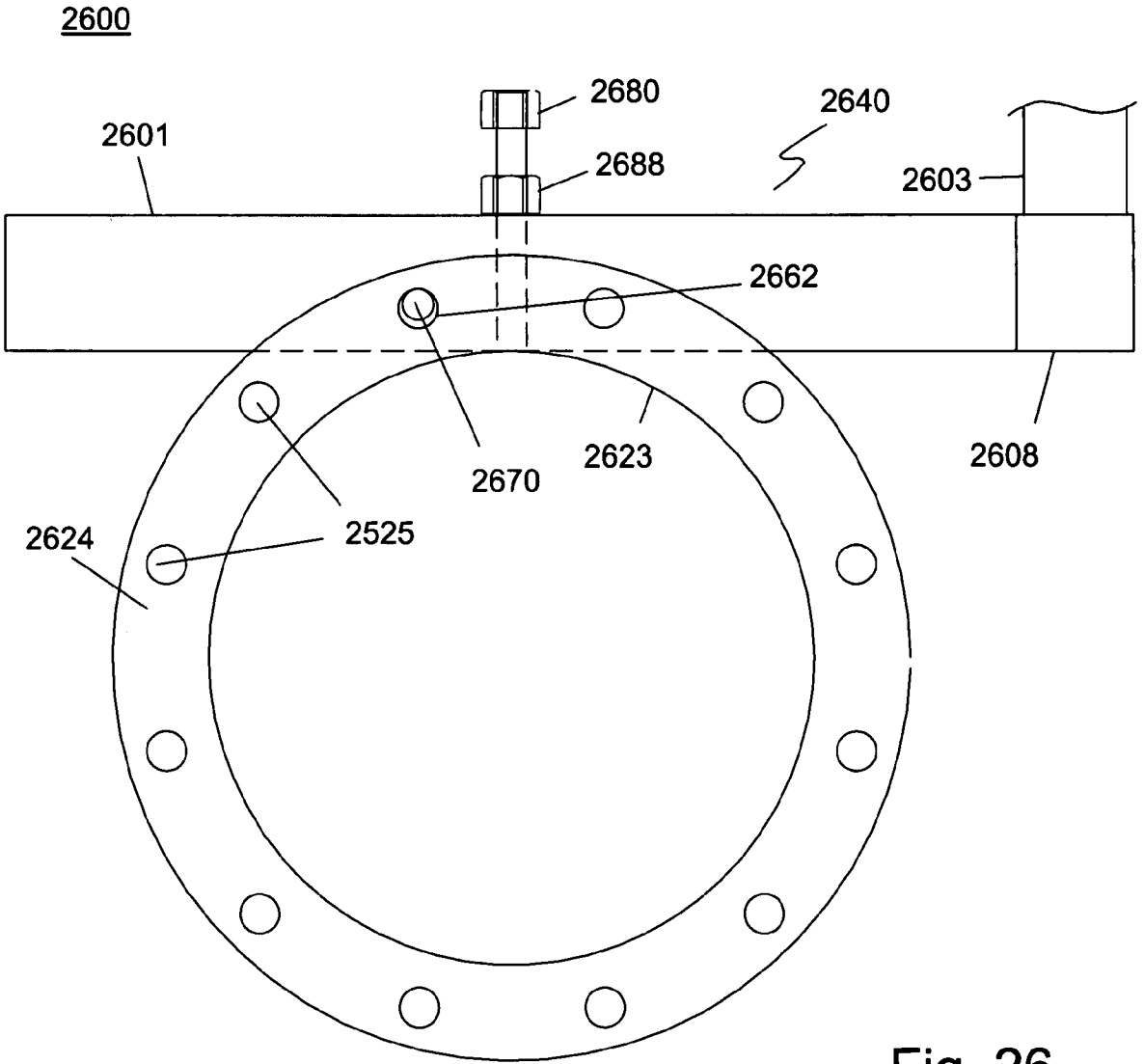
FIG. 26 illustrates a front view of another embodiment of the present invention showing the use of a bolt/pin type securing mechanism where the cover flange bolt/pin passes through the channel member and the use of an optional set screw.

Turning now to FIG. 26, there is illustrated a front view of a removable cover support system 2600 of the present invention attached to a cover flange with the cover removed for clarity. Removable cover support system 2600 includes a securing base assembly 2640. Securing base assembly 2640 includes base member 2601, which rests upon cover support extension 2623 of a manway or other circular and/or rectangular structure and securing mechanism 2670. Base member 2601 may optionally have one or more jaw appendages (not shown) to facilitate clamping onto cover support extension 2623. Retaining sleeve 2608 is secured to base member 2601. Retaining sleeve 2608 contains the swingarm 2603 (only partially shown) which supports a lifting mechanism (not shown) for removably securing a cover. Base member 2601 has at least one base hole 2662 which is spaced and sized comparable to cover flange hole 2625 on cover flange 2624. Securing mechanism 2670 is inserted through base hole 2662 and cover flange hole 2625 to secure the cover support system 2600 to the structure.

Securing base assembly 2640 can also have an optional set screw 2680 which is secured to base member 2601 by threaded portion 2688. Set screw 2680 is positioned between the base holes 2662 and threaded through threaded portion 2688 until the end of set screw 2680 meets cover support extension 2623.

Figure 26A:
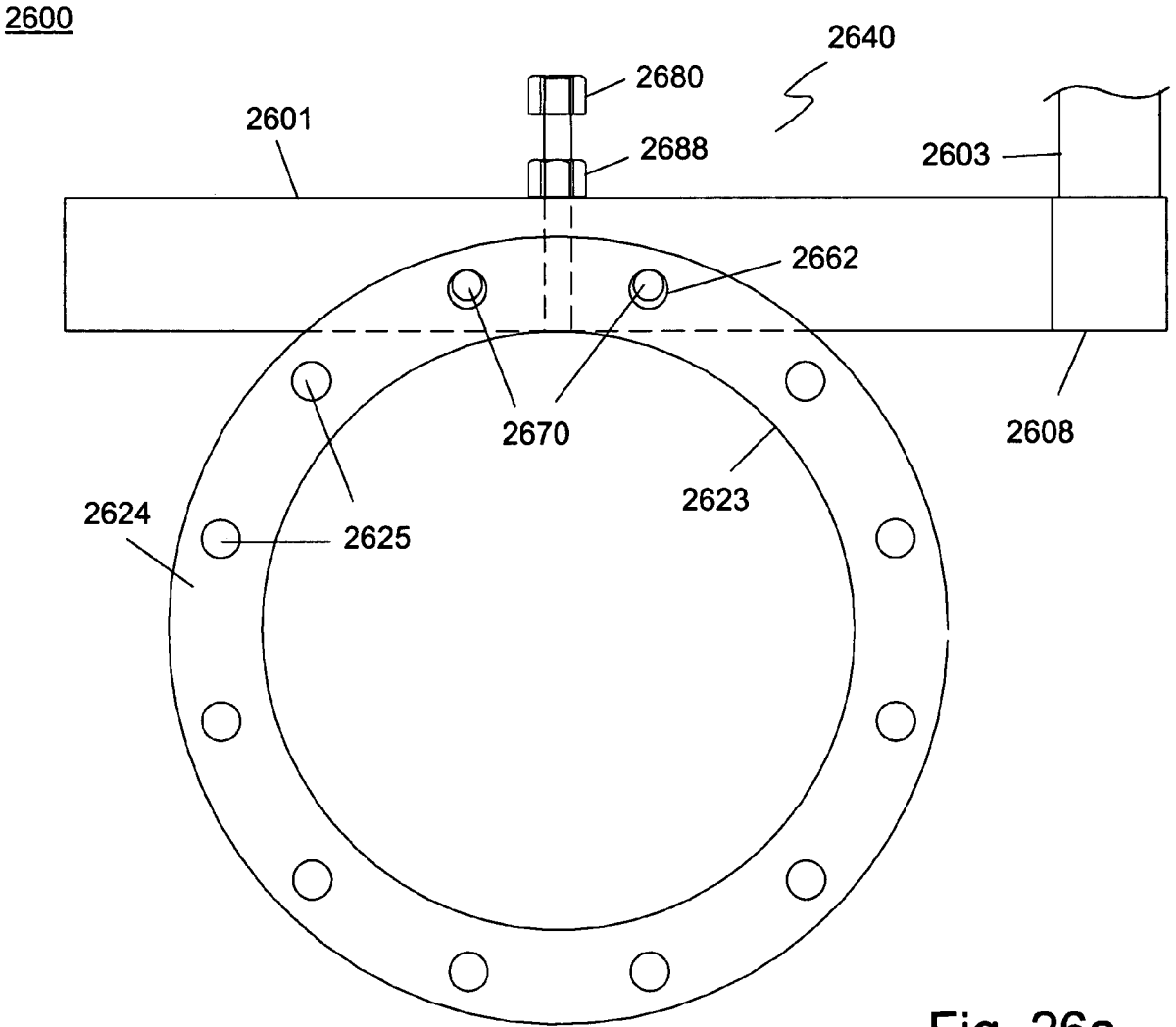

FIG. 26*a* illustrates the embodiment in FIG. 26 but showing the use of an additional securing mechanism 2670 through an additional base hole 2662' and cover flange hole 2625.

Figure 27:
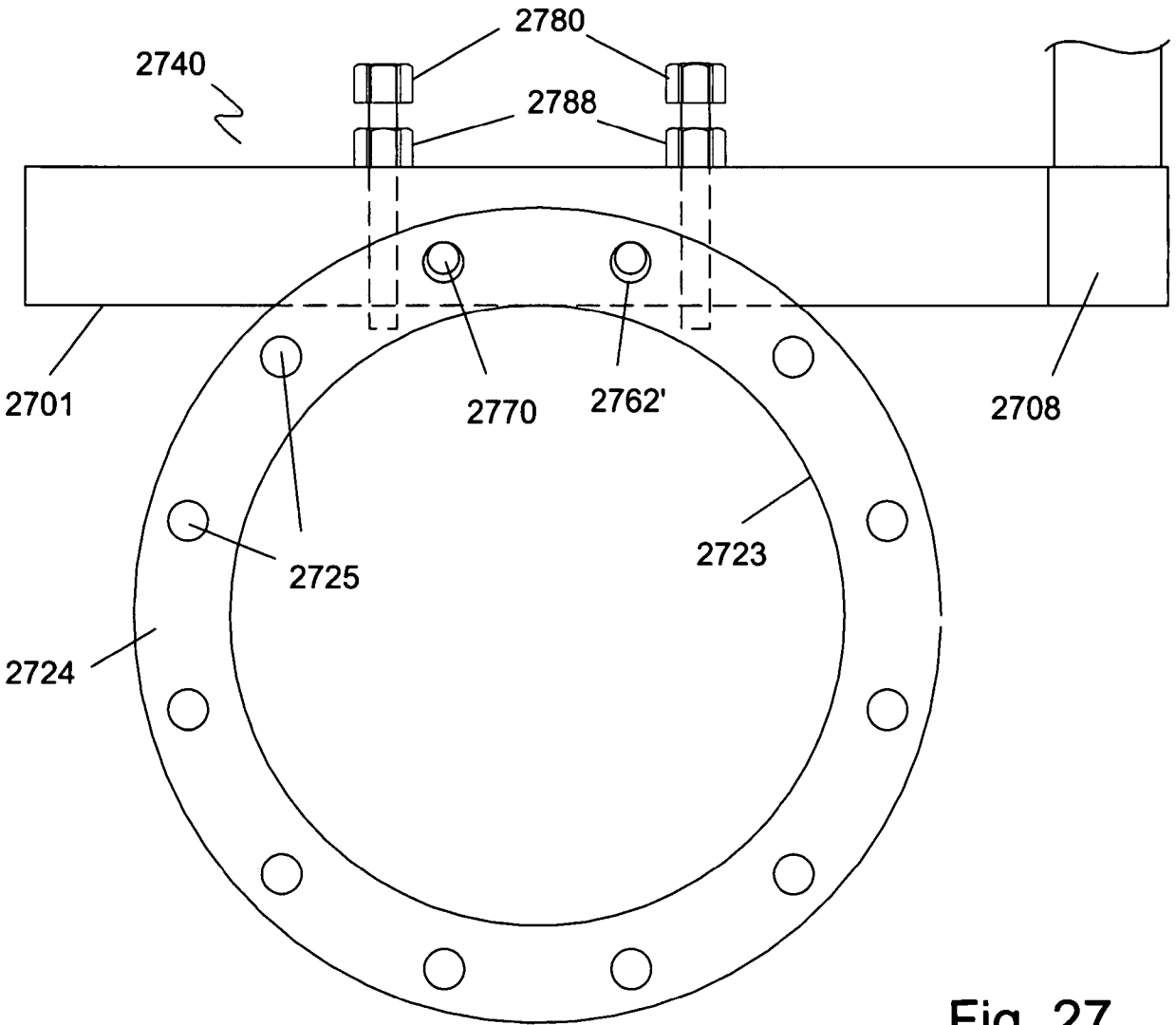
FIG. 27 illustrates a front view of the embodiment of FIG. 26 showing the use of optional set screws.

It should be understood by one of ordinary skill in the art that more set screws can also optionally be used in any configuration, such as that shown in FIG. 27. FIG. 27 shows two set screws 2780 positioned on the outside of two base holes 2762.

Figure 28:
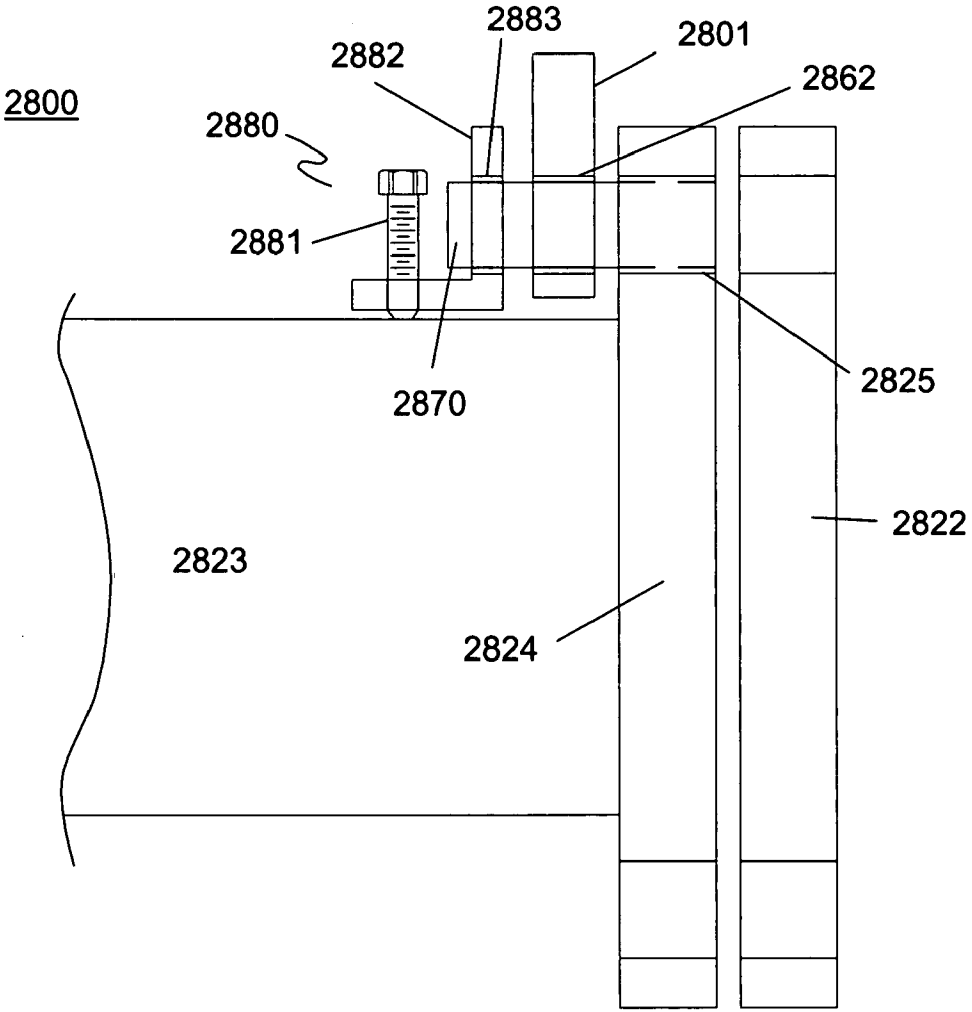
FIG. 28 illustrates a partial cross-sectional view of the embodiment of FIG. 26 showing another variation of the optional set screw where the bolt/pin passes through an angle plate and the angle plate and set screw are configured such that the set screw abuts the peripheral edge of the cover flange.

Turning now to FIG. 28, there is illustrated another embodiment of the through bolt/pin design using a set screw assembly. FIG. 28 is a partial cross-sectional view showing a securing base assembly 2840 having a base member 2801 which may be any one of the optional structures previously discussed, and a securing mechanism 2870. It should be understood that this embodiment, although not shown, includes a retaining sleeve, a swingarm assembly and a lifting mechanism with the retaining sleeve being secured to base member 2801. Base member 2801 has a base hole 2862 which is sized comparable to cover flange holes 2825 on cover flange 2824. Securing mechanism 2870 is inserted through base hole 2862 and cover flange hole 2825 to secure the cover support system 2800 to the structure. An optional set screw assembly 2880 can be used to provide additional support for the securing base assembly 2840. Set screw assembly 2880 includes a set screw support 2882 and a set screw 2881. Set screw support 2882 has a securing mechanism hole 2883 on one end for receiving securing mechanism 2870 therethrough. Securing mechanism 2870 is inserted through securing mechanism hole 2883 of set screw support 2882 and set screw 2881 is threaded into the other end so that the end of set screw 2881 meets cover support extension 2823.

Figure 29:
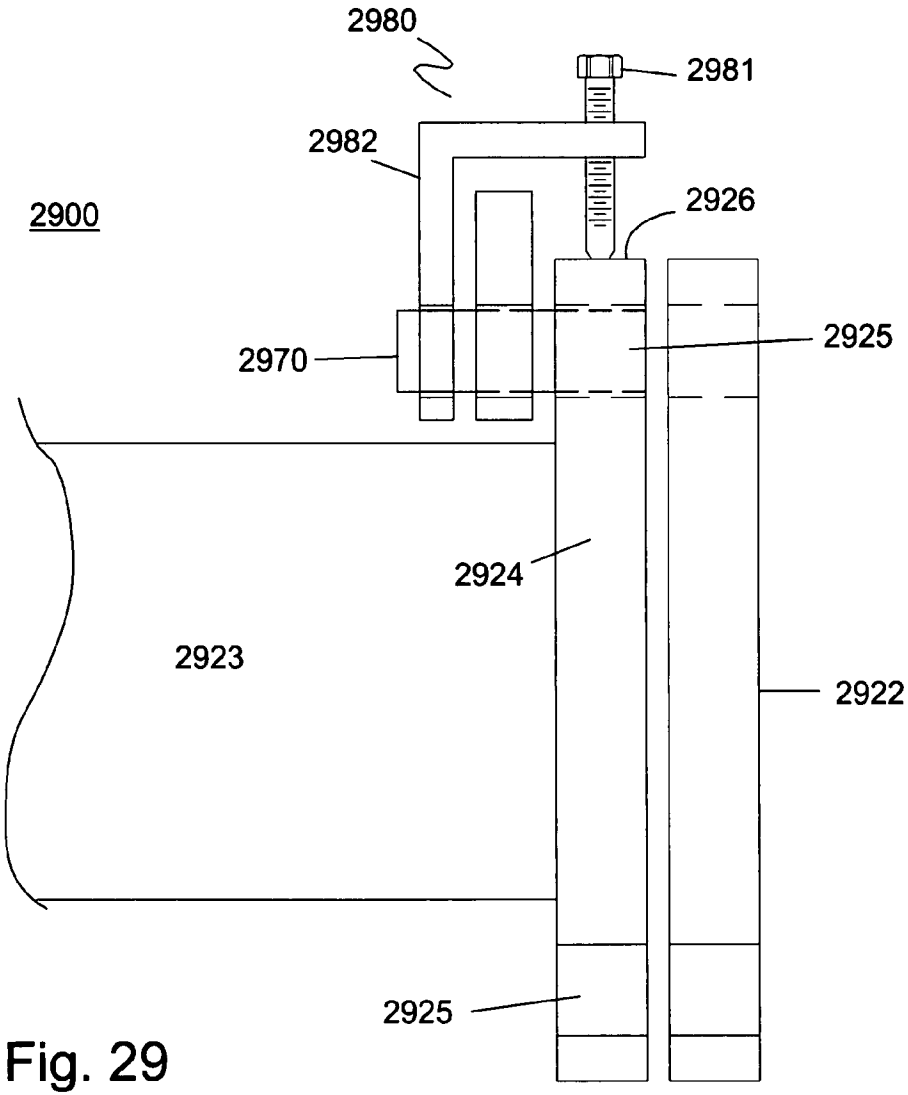
FIG. 29 illustrates a partial cross-sectional view of the embodiment of FIG. 26 showing another variation of the optional set screw where the bolt/pin passes through an angle plate and the angle plate and set screw are configured such that the set screw abuts the cover flange extension.

Additionally as illustrated in FIG. 29, the optional set screw assembly 2980 may be configured so that set screw support 2982 positions set screw 2981 in an opposing alignment with the peripheral edge 2926 of cover flange 2924. In this embodiment, set screw support 2982 is aligned with securing mechanism 2970 such that the end of set screw 2980 is capable of contacting peripheral edge 2926 of cover flange 2924.

Figure 30:
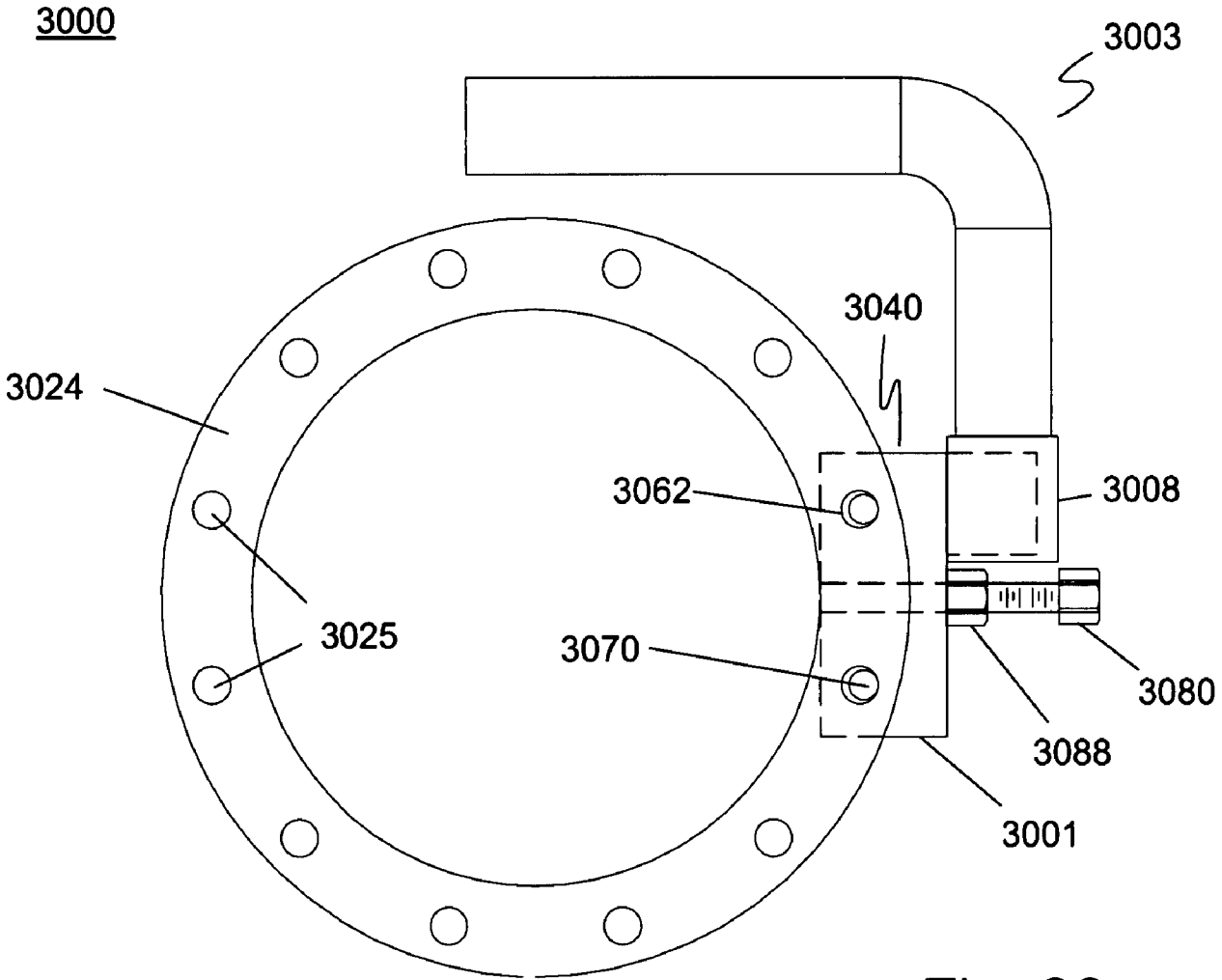
FIG. 30 illustrates a side view of another embodiment of the present invention showing securing mechanism having a bolt/pin type system that includes a plate or gusset member attached to the retainer sleeve and with a bolt/pin passing through a cover flange hole.

FIG. 30 is a side view of the removable cover support system 3000 of the present invention. Removable cover support system 3000 has a securing base assembly 3040. Securing base assembly 3040 includes a base member 3001 which is shown as a channel member but may be any other structure know to those of ordinary skill in the art such as, for example, a gusset, a bar, an angle or other structural member, and a securing mechanism 3070. Retaining sleeve 3008 is secured to base member 3001. Retaining sleeve 3008 contains the swingarm assembly 3003 which supports a lifting mechanism (not shown) for removably securing cover 3022 (not shown).

Figure 30A:
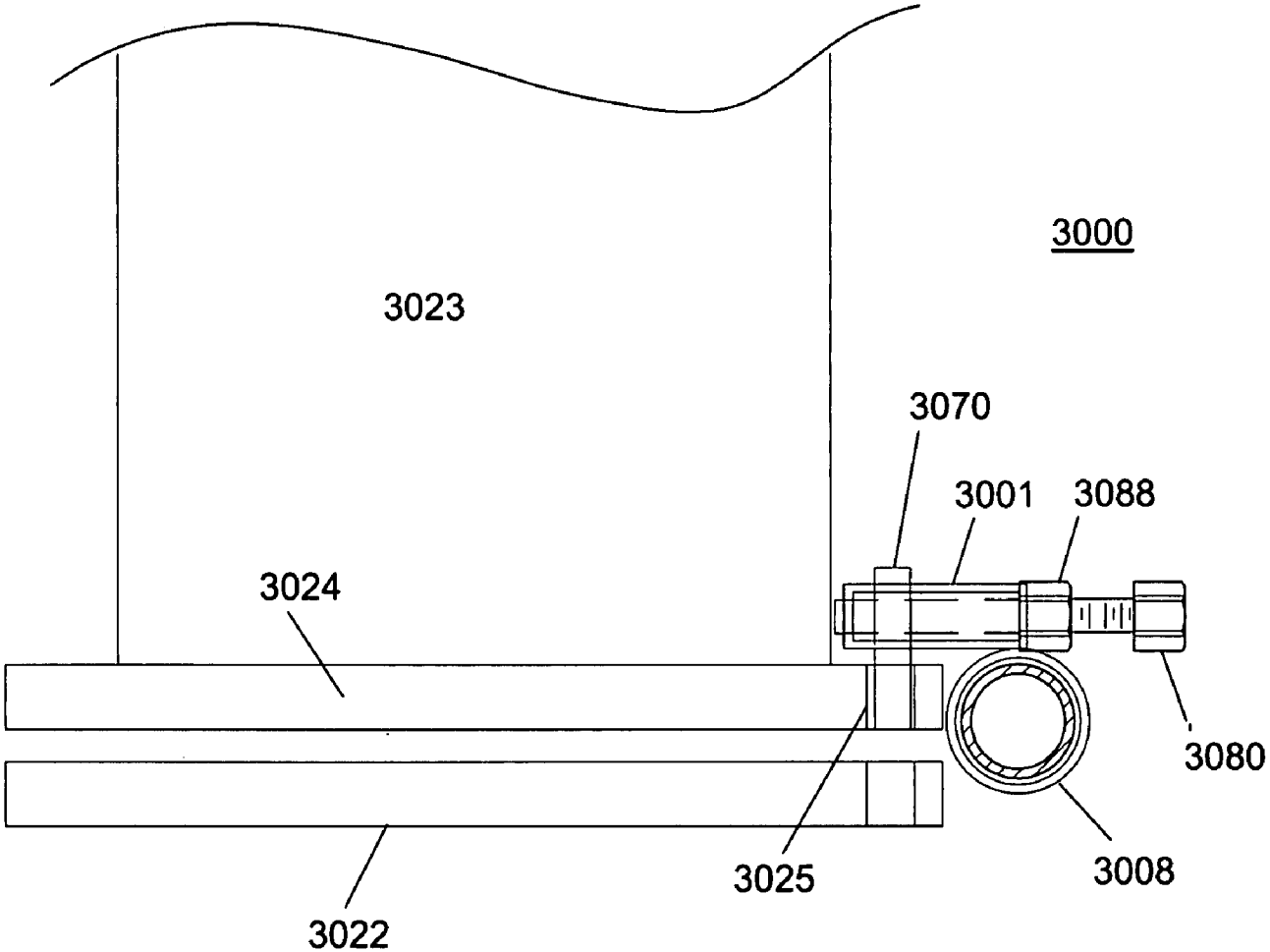
FIG. 30*a* illustrates a top view of the embodiment of FIG. 30.

Base member 3001 has two base holes 3062 which are spaced for substantial alignment with and sized comparable to cover flange holes 3025 on cover flange 3024. Securing mechanism 3070 is inserted through base holes 3062 and cover flange holes 3025 to hold the cover support system 3000 to the structure. An optional set screw 3080 can be used to provide additional support for the securing base assembly 3040. Set screw 3080 is threaded into lock nut 3088 which is attached to base member 3001. Alternatively, base member 3001 may include a threaded portion therein for set screw 3080 and lock nut 3088 may be used to lock set screw 3080 against base member 3001 to prevent it from loosening. FIG. 30*a* is a top view of the embodiment shown in FIG. 30.

Figure 31:
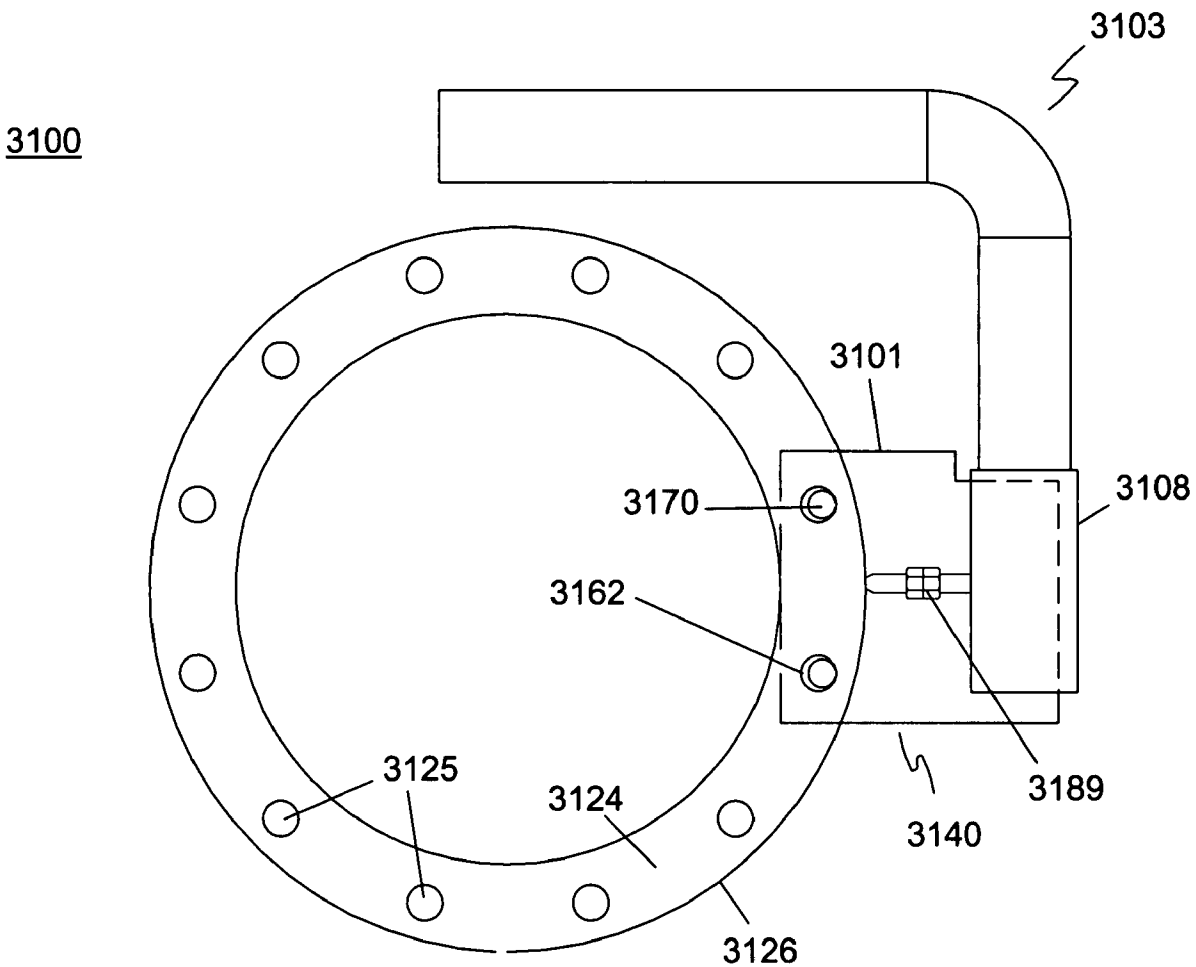
FIG. 31 illustrates a side view of another embodiment of the present invention showing securing mechanism having a bolt/pin type system that includes a plate or gusset member attached to the retainer sleeve and with a bolt/pin passing through a cover flange hole where the retaining sleeve is spaced from the cover flange with an offset pin between the retainer sleeve and the peripheral edge of the cover flange.

Turning now to FIG. 31, there is illustrated a side view of another embodiment of the removable cover support system 3100 of the present invention. Removable cover support system 3100 has a securing base assembly 3140. Securing base assembly 3040 includes a base member 3101. Retaining sleeve 3108 is secured to base member 3101. Retaining sleeve 3108 contains the swingarm assembly 3103 which supports a lifting mechanism (not shown) for removably securing cover 3122.

Base member 3101 has two base holes 3162 which are spaced for substantial alignment with and sized comparable to cover flange holes 3125 on cover flange 3124. Securing mechanism 3170 is inserted through base holes 3162 and cover flange holes 3125 to secure the cover support system 3100 to the structure. A spacer rod 3189 is connected, preferably by welding, on one end to retaining sleeve 3108 and extends towards the peripheral edge 3126 of cover flange 3124 so that the other end is sufficiently adjacent peripheral edge 3126 for engagement with peripheral edge 3126 when the present invention is mounted to the cover assembly. Spacer rod 3189 may be a rod, screw, bolt or any structure that acts as a spacer between retaining sleeve 3108 and peripheral edge 3126, but is preferably a Jack screw or expanding screw. When a Jack screw or expanding screw is used, spacer rod 3189 also serves as a set screw.

Figure 31A:
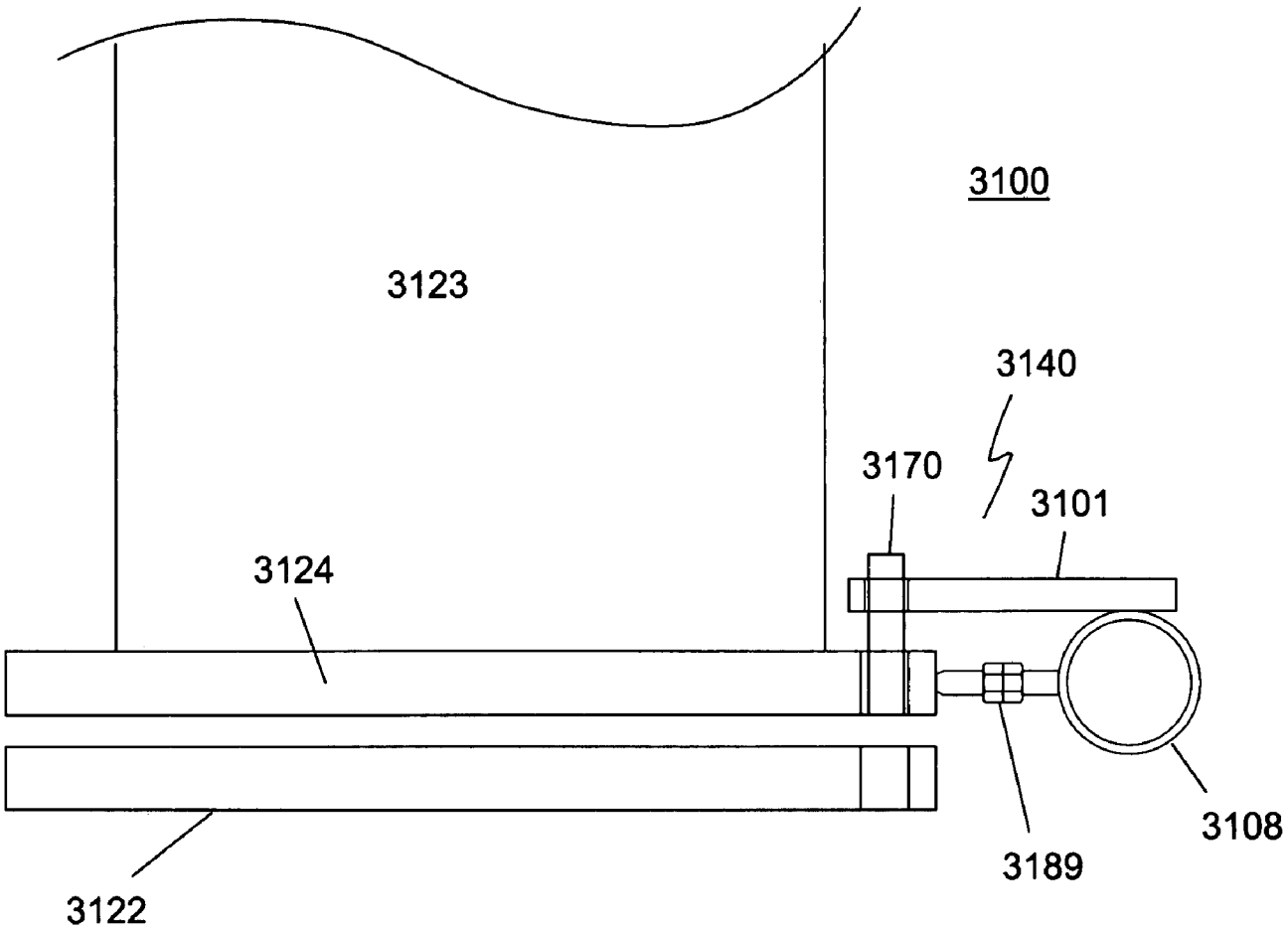
FIG. 31*a* illustrates a top view of the embodiment of FIG. 30.

FIG. 31*a* is a top view of the embodiment shown in FIG. 31. Securing mechanism 3170 is inserted through base holes 3162 and cover flange holes 3125 to secure cover support system 3100 to the structure. Spacer rod 3189 is located between retaining sleeve 3108 and peripheral edge 3126 of cover flange 3124.

Figure 32:
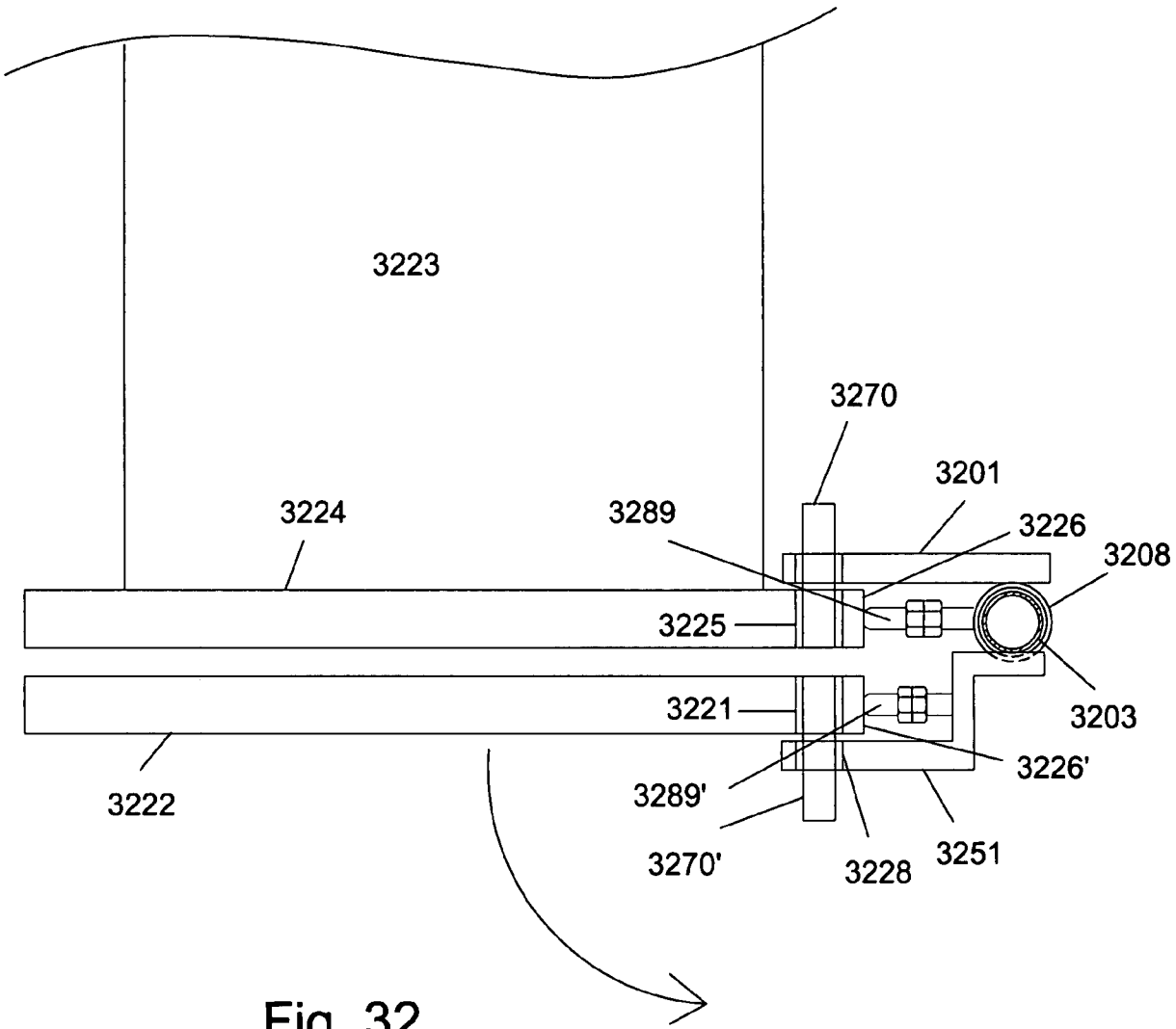
FIG. 32 illustrates a top view of another embodiment of the present invention showing the securing mechanism of FIG. 31 coupled with a similarly structured cover lifting member.

FIG. 32 is a top view of another embodiment of the present invention showing the securing mechanism of FIG. 31 coupled with a similarly structured cover lifting member. The base member 3201 is secured to retaining sleeve 3208. Securing member 3270 is passed through cover flange hole 3225 and base hole 3262. Spacer rod 3289 is located between retaining sleeve 3208 and peripheral edge 3226 of cover flange 3224. Retaining sleeve 3208 contains swingarm assembly 3203. The arm 3203*a* of swingarm assembly 3203 is attached to swingarm post 3203*b* which is aligned and fitted into retaining sleeve 3208. It should be understood to one of ordinary skill in the art that the arm can also be configured in series with the post as shown in FIG. 31, or at any other angle to the post. Arm 3203*a* has two arm holes 3228 which are sized for substantial alignment with and spaced comparably to cover holes 3221. Lifting mechanism 3204 is then inserted through arm hole 3228 and cover hole 3221 to support cover 3222. A spacer rod 3289' is located between the peripheral edge 3226' of cover 3222 and swingarm 3203.

Figure 32A:
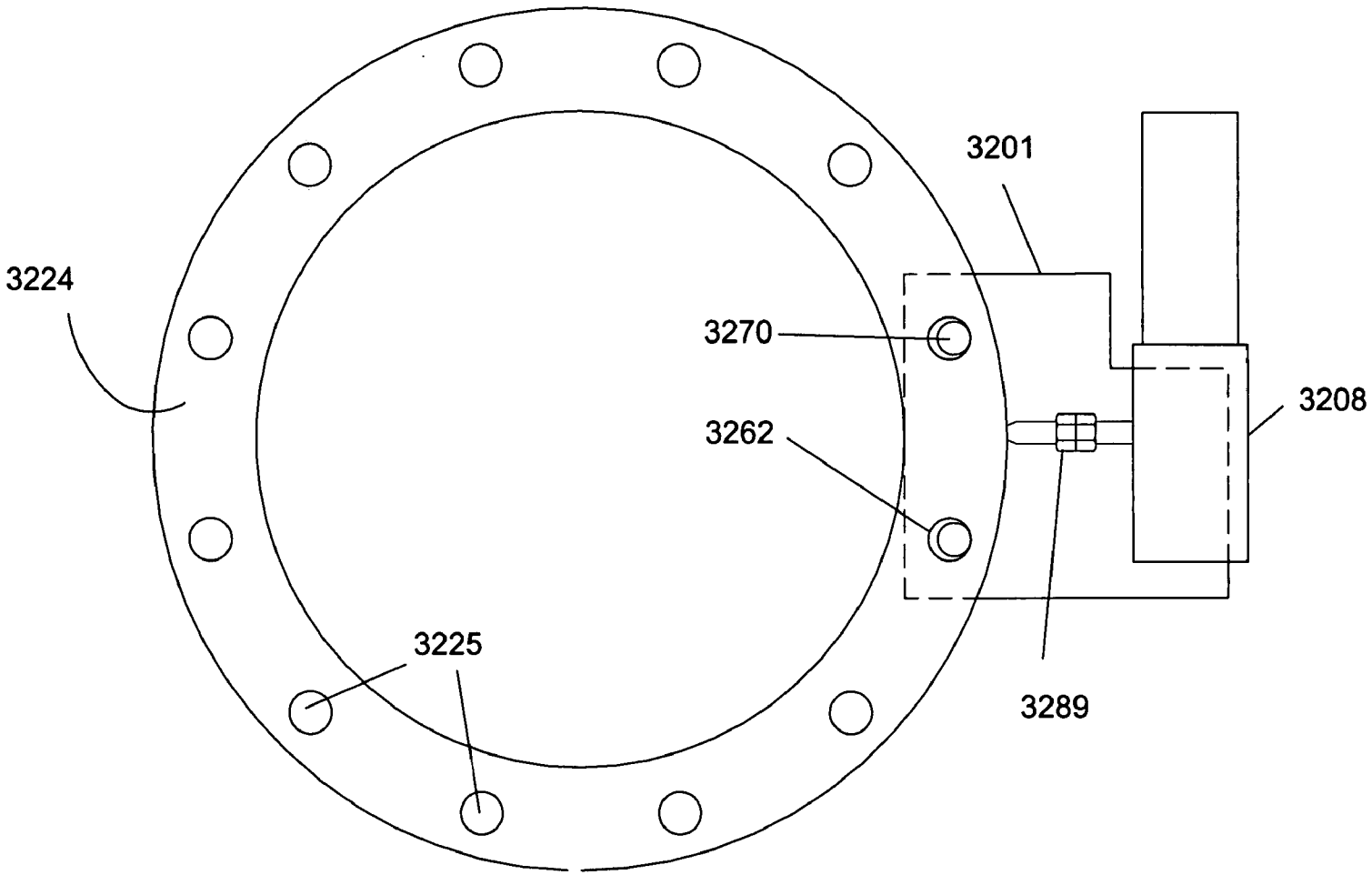
FIG. 32*a* illustrates a side view of the embodiment of FIG. 32 showing the securing mechanism for the cover flange.

FIG. 32*a* illustrates a side view of the embodiment of FIG. 32 showing the securing mechanism for the cover flange. This securing mechanism is similar to that of FIG. 31.

Figure 32B:
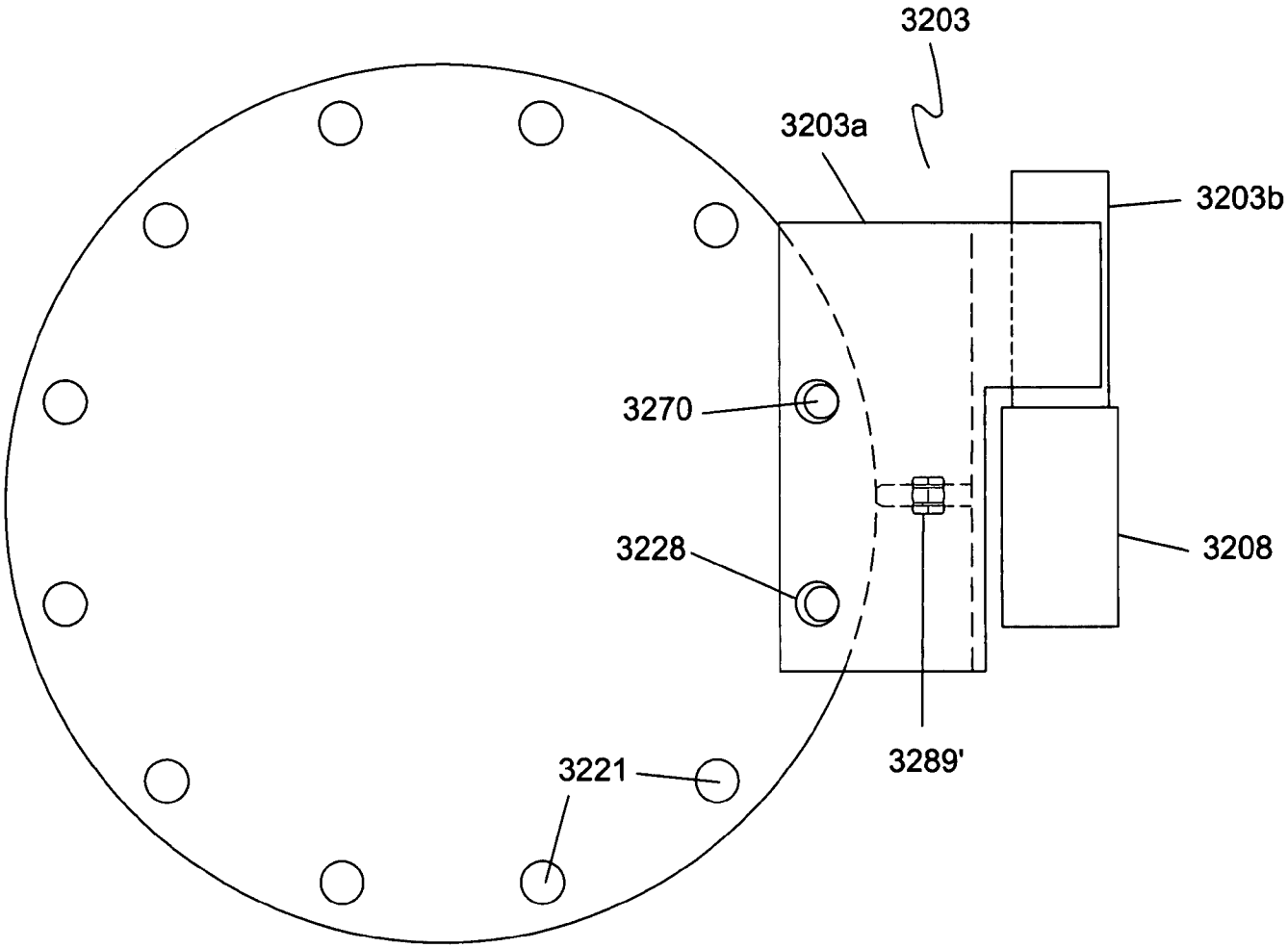
FIG. 32*b* illustrates a side view of the embodiment of FIG. 32 showing the cover lifting mechanism structure.

FIG. 32*b* illustrates a side view of the embodiment of FIG. 32 showing the swingarm and cover lifting mechanism structure. Swingarm post 3203*b* is connected to retaining sleeve 3208. Arm 3203*a* is attached to swingarm post 3203*b* to form swingarm assembly 3203. Swingarm 3203 has two arm holes 3228 which are sized for substantial alignment with and spaced comparably to cover holes 3221. Lifting mechanism 3204 is then inserted through arm hole 3228 and cover hole 3221 to support cover 3222 when cover 3222 is rotated by swingarm assembly 3203 in retaining sleeve 3208.

It should be understood by one of ordinary skill in the art that the base member and securing mechanism of FIGS. 25-32 as well as the cover lifting mechanism can be a single bolt/pin rod or other comparable fastening configuration like that discussed in FIG. 26.

PREFERRED SYSTEM CONTEXT OF THE PRESENT INVENTION

Overview

The numerous innovative teachings of the present application will be described with particular reference to the presently preferred embodiment, wherein these innovative teachings are advantageously applied to the particular problems of a PORTABLE LIFT, SUPPORT, AND/OR INSTALLATION SYSTEM AND METHOD. However, it should be understood that this embodiment is only one example of the many advantageous uses of the innovative teachings herein. In general, statements made in the specification of the present application do not necessarily limit any of the various claimed inventions. Moreover, some statements may apply to some inventive features but not to others.

The invention is not limited to removal of manway covers. A wide variety of items can be removed and/or installed using the invention.

The invention is also suitable for but not limited to the following applications:

1. Removal and/or installation of manway covers on vertical and/or horizontal manways.
2. Removal and/or installation of heat exchanger covers.
3. Removal and/or installation of heat exchanger bonnets.
4. Removal and/or installation of inspection covers.
5. Removal and/or installation of piping components including but not limited to valves, fittings and pipe sections.
6. Removal and/or installation of other equipment.

These applications are only exemplary and not limitive of the scope of the present invention.

Constructive Reduction to Practice

The present invention teachings may be further understood by examination of a variety of embodiments that have been reduced to practice in contrast to the existing prior art.

Prior Art Safety Hazard

The deficiencies of the prior art in handling attached manway covers, in which the cover is removed and placed to the side of the equipment fixture. This is a hazardous operation, as the manway cover could fall or otherwise injure the maintenance personnel.

Hoists are often used in the prior art to lift manway covers. These hoists may typically be attached to overhead infrastructure. However, in many circumstances this infrastructure is not available and must be fabricated.

When pulleys and the like are used to hoist manway covers, the overhead infrastructure must be modified with welding, etc., to support the pulley. This modification often ignores the risk that the overhead structure could fail due to the load imposed by lifting the manway cover.

This presents an additional safety hazard in the prior art.

MDUV-Style Embodiments

FIG. 2 illustrates a partially assembled MDUV-style invention embodiment. As mentioned previously, there are many variations possible within the scope of the present invention. Referencing FIG. 16 is an HDCV-style with two lifting members (1656, 1657). This can be configured to incorporate a sling and extended lifting member to enable heavy loads to be dropped to the floor with a high degree of safety. It is particularly important to mention as before that there is no limit on the length of the lifting member. Additionally, as mentioned previously, the swingarm assembly may be of any length as needed. Wherein a long swingarm can be integrated with an inverted MDUV-style embodiment to permit the load to be either lifted to a higher elevation or lowered to the floor using an extended lifting member. All of the embodiments presented herein may be rotated or inverted to accommodate a wide variety of equipment supports and the like.

MDUV/HDCV Comparison

The MDUV-style embodiment FIG. 2 can be clearly contrasted with the HDCV-style embodiment FIG. 6. However, note that many of the components between the two configurations are interchangeable as has been mentioned previously.

Lifting Means Variants

In all the embodiments mentioned previously, there are a wide variety of lifting member means possible. A conventional lifting member as illustrated in FIG. 2 may be used (204), but it is also possible to incorporate a lateral adjustment means (1655) as illustrated in FIG. 16 to offset the load point with respect to the swingarm. This advantage is clearly indicated by (1655) in FIG. 16.

HDCV-Style Embodiments

The HDCV-style embodiment installed on an equipment fixture is illustrated in FIG. 7. Note that a single operator can manipulate the movement object with no additional help. The operation of the present invention in contrast to the prior art wherein the manway cover of the equipment fixture is "swung down" using a bolt at the 6 o'clock position. This technique can cause injury, especially if the manway cover is heavy. However, with the present invention this hazard is eliminated with the techniques described herein.

The present invention may make use of a variety of slings. These may incorporate the use of a lateral adjustment means (1655) as illustrated in FIG. 16. FIGS. 2 and 6 illustrate the contrast in attachment and structure between the HDCV-style embodiment FIG. 6 and the MDUV-style embodiment FIG. 2.

In general, the only functional difference between the units is the load that they are capable of supporting. The MDUV-style embodiment attaches to the equipment fixture. The use of fully threaded rod in this application generally aids in the gripping function between the U-bolt member and the equipment fixture. Of course, other gripping aids are also possible.

Installation Procedure

This procedure as described herein is one preferred method but has many variants. Referencing FIGS. 2 and 4, the procedure starts by placing the U-bolt member (202 or 212) over the equipment fixture. Then the channel member (201) is attached to the U-bolt member (202 or 212) and fastened to it loosely. This assembly is rotated to the top of the equipment fixture and then the U-bolts are securely fastened. The swingarm assembly (203) is then placed in the retaining sleeve (208). As illustrated in FIG. 4, the swingarm assembly is then rotated over and attached to the movement object/manway cover (220).

The present invention is not limited in scope to use with manway covers.

CONCLUSION

The present invention as disclosed provides a means for manipulating a wide variety of movement objects. Key features of the present invention as compared to the prior art are the portable nature and retrofit capabilities of the present invention in various exemplary embodiments. In essence, the present invention constitutes a portable and/or retrofit-compatible hoist that may be used in situations where manual manipulation of the movement object is unwieldy, inconvenient, and/or unsafe, and is especially applicable in situations where welding is impractical or prohibited. Given that the prior art techniques for movement object manipulation do not address many situations in which the movement object is nonmetallic, the access space is restricted, and/or there are little if any means for permanent attachment of a davit or the like, the present invention represents a significant opportunity to both simplify industrial maintenance operations and improve overall plant safety.

Finally, it should be restated as indicated in the above disclosure that the present invention is also amenable to situations where the stationary equipment support is different than the equipment fixture on which the movement object is initially/finally attached. Thus, in situations where a heavy and/or unwieldy object must be manipulated to/from a piece of equipment that has no hoisting mechanism, the present invention can be attached to a nearby equipment support and used to hoist/lower the movement object to/from the equipment fixture.

What is claimed is:

1. A removable cover support system for supporting a cover of a cover assembly having a cover support extension and a cover flange having cover flange holes, said system comprising:

a cover flange securing base assembly having a base member and a securing mechanism slidably insertable through at least one of said cover flange holes, said securing mechanism operably connected to said base member;

a retaining sleeve connected to said securing base assembly;

a swingarm assembly having a swingarm post rotatably supported by said retaining sleeve;

a set screw connected to one of the group consisting of said cover flange securing base assembly and said retaining sleeve wherein one end of said set screw is configured for engagement with one of the group consisting of said cover support extension and the peripheral edge of said cover flange; and a lifting mechanism connected to a swingarm of said swingarm assembly, said lifting mechanism operably connected to said cover.

2. The removable cover support system of claim 1 wherein said base member further includes a securing mechanism base hole configured to align with one of said cover flange holes and through which said securing mechanism is slidably engaged.

3. The removable cover support system of claim 2 wherein said base member includes a second securing mechanism base hole configured to align with another of said cover flange holes and through which a second securing mechanism is slidably engaged.

4. The removable cover support system of claim 1 wherein said cover flange securing base assembly further includes a securing mechanism linkage connected on one end to said base member and on another end to said securing mechanism.

5. The removable cover support system of claim 1 wherein said lifting mechanism includes a cover securing mechanism slidably insertable through a hole of said cover, and a cover spacer member connected on one end to said swingarm and having a second end sufficiently adjacent a peripheral edge of said cover to prevent said cover from disengaging with said securing mechanism when said cover is removed from said cover flange.

6. The removable cover support system of claim 5 wherein said base member further includes a securing mechanism base hole configured to align with one of said cover flange holes and through which said securing mechanism is slidably engaged.

7. The removable cover support system of claim 6 wherein said base member includes a second securing mechanism base hole configured to align with another of said cover flange holes and through which a second securing mechanism is slidably engaged.

8. A method of attaching a removable cover support system to a cover assembly having a support extension and a cover flange with cover flange holes, said method comprising:

placing a base member of said removable cover support system behind a cover flange of said cover assembly; and slidably inserting a securing mechanism of said removable cover support system into a cover flange hole, said securing mechanism being sized to fill a major portion of said cover flange hole thereby holding said base member in operable engagement with said cover flange for removing a cover from said cover assembly.

9. The method of claim 8 further comprising tightening a set screw that is operably connected to said base member or said securing mechanism thereby forcing said securing mechanism against the inside surface of said cover flange hole.

* * * * *